US011384308B2

(12) United States Patent
Barton et al.

(10) Patent No.: US 11,384,308 B2
(45) **Date of Patent: *Jul. 12, 2022**

(54) ALKYL PHOSPHATE AMINE SALTS FOR USE IN LUBRICANTS

(71) Applicant: The Lubrizol Corporation, Wickliffe, OH (US)

(72) Inventors: William R. S. Barton, Belper (GB); Daniel J. Saccomando, Sheffield (GB); Jamal Kassir, Dearborn, MI (US); Paul E. Adams, Willoughby, OH (US); Lisa Blanazs, Mannheim (DE); Michael R. Sutton, Matlock (GB); Stephen J. Cook, Belper (GB); Paul R. Vincent, Belper (GB); Ewan E. Delbridge, Concord Township, OH (US); Yanshi Zhang, Solon, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/318,775

(22) PCT Filed: Jul. 17, 2017

(86) PCT No.: PCT/US2017/042325

§ 371 (c)(1),
(2) Date: Jan. 18, 2019

(87) PCT Pub. No.: WO2018/017454

PCT Pub. Date: Jan. 25, 2018

(65) Prior Publication Data

US 2019/0241824 A1 Aug. 8, 2019

Related U.S. Application Data

(60) Provisional application No. 62/364,603, filed on Jul. 30, 2016.

(51) Int. Cl.

| | |
|---|---|
| ***C10M 137/08*** | (2006.01) |
| ***C10M 107/02*** | (2006.01) |
| ***C10M 169/04*** | (2006.01) |
| *C10N 20/02* | (2006.01) |
| *C10N 30/02* | (2006.01) |
| *C10N 30/06* | (2006.01) |
| *C10N 30/00* | (2006.01) |
| *C10N 40/04* | (2006.01) |
| *C10N 40/12* | (2006.01) |
| *C10N 40/25* | (2006.01) |
| *C10N 40/30* | (2006.01) |

(52) U.S. Cl.

CPC ..... *C10M 137/08* (2013.01); *C10M 107/02* (2013.01); *C10M 169/04* (2013.01); *C10M 2205/0206* (2013.01); *C10M 2205/0285* (2013.01); *C10M 2215/224* (2013.01); *C10M 2215/28* (2013.01); *C10M 2219/022* (2013.01); *C10M 2219/106* (2013.01); *C10M 2223/043* (2013.01); *C10N 2020/02* (2013.01); *C10N 2030/02* (2013.01); *C10N 2030/06* (2013.01); *C10N 2030/36* (2020.05); *C10N 2040/04* (2013.01); *C10N 2040/044* (2020.05); *C10N 2040/12* (2013.01); *C10N 2040/25* (2013.01); *C10N 2040/30* (2013.01)

(58) Field of Classification Search

CPC ..... C10M 137/08; C10M 2223/043; C10M 107/02; C10M 169/04; C10N 2030/06; C10N 2030/36

USPC ..... 508/424, 436

See application file for complete search history.

(56) References Cited

U.S. PATENT DOCUMENTS

| | | | | |
|---|---|---|---|---|
| 2,664,400 A | | 12/1953 | Woodstock | |
| 2,848,414 A | * | 8/1958 | Chenicek | C10L 1/2658 508/424 |
| 2,961,408 A | | 11/1960 | Havely et al. | |
| 3,354,189 A | | 11/1967 | Revukas | |
| 3,535,241 A | * | 10/1970 | Revukas | C10L 1/2641 508/362 |
| 3,609,077 A | * | 9/1971 | Breitigam | C07F 9/301 508/424 |
| 5,552,068 A | * | 9/1996 | Griffith | C10M 137/08 508/436 |
| 6,339,052 B1 | | 1/2002 | Dohhen et al. | |

(Continued)

FOREIGN PATENT DOCUMENTS

| | | |
|---|---|---|
| EP | 0721978 | 6/1997 |
| GB | 1365288 A | 8/1971 |

(Continued)

OTHER PUBLICATIONS

David A. Jaeger, Yapin Wang, and Richard L. Pennington, "Pyrohosphate-Based Gemini Surfactants", Langmuir, 2002, vol. 18, p. 9259-9266, University of Wyoming, Wyoming US.

(Continued)

*Primary Examiner* — Ellen M McAvoy

(74) *Attorney, Agent, or Firm* — Iken Sans; Teresan Gilbert

(57) ABSTRACT

A lubricant composition comprising an oil of lubricating viscosity and 0.01 to 5 percent by weight of a substantially sulfur-free alkyl phosphate amine salt, where at least 30 mole percent of the phosphorus atoms are in an alkyl pyrophosphate salt structure, exhibits good antiwear performance. In the phosphate amine salt, at least 80 mole percent of the alkyl groups are typically secondary alkyl groups of 3 to 12 carbon atoms.

14 Claims, No Drawings

(56) References Cited

U.S. PATENT DOCUMENTS

| | | | | |
|---|---|---|---|---|
| 6,525,004 | B1 | 2/2003 | Hartley et al. | |
| 6,756,346 | B1 | 6/2004 | Baba et al. | |
| 7,534,539 | B2 | 5/2009 | Obata et al. | |
| 8,084,404 | B2 | 12/2011 | Tobias et al. | |
| 9,382,275 | B2 | 7/2016 | Knapton et al. | |
| 9,550,799 | B2 | 1/2017 | Knapton et al. | |
| 9,574,156 | B2 | 2/2017 | Tang et al. | |
| 10,005,979 | B2 | 6/2018 | Saccomando et al. | |
| 10,011,802 | B2 | 7/2018 | Narita et al. | |
| 10,519,395 | B2 * | 12/2019 | Saccomando | C10M 141/10 |
| 10,738,263 | B2 | 8/2020 | Sutton et al. | |
| 10,954,465 | B2 | 3/2021 | Barton | |
| 10,961,479 | B2 | 3/2021 | Kawamoto et al. | |
| 11,072,758 | B2 * | 7/2021 | Saccomando | C10M 137/10 |
| 2004/0242437 | A1 | 12/2004 | Reyes-Gavlian et al. | |
| 2006/0210895 | A1 | 9/2006 | Obata et al. | |
| 2008/0200357 | A1 | 8/2008 | Chasan et al. | |
| 2010/0105585 | A1 | 4/2010 | Carey et al. | |
| 2011/0021394 | A1 | 1/2011 | Nakao et al. | |
| 2012/0208731 | A1 * | 8/2012 | Lann | C10M 141/12 508/187 |
| 2013/0133243 | A1 | 5/2013 | Roeger-Goepfert et al. | |
| 2013/0252864 | A1 * | 9/2013 | Knapton | C07F 9/09 508/425 |
| 2013/0324448 | A1 | 12/2013 | Najman et al. | |
| 2014/0024569 | A1 * | 1/2014 | Bera | C10M 133/04 508/423 |
| 2014/0038866 | A1 * | 2/2014 | Barton | C10M 163/00 508/287 |
| 2014/0057818 | A1 | 2/2014 | Barton et al. | |
| 2015/0210952 | A1 * | 7/2015 | Desantis | C10M 133/06 508/262 |
| 2016/0369200 | A1 | 12/2016 | Sakanoue | |
| 2017/0073604 | A1 * | 3/2017 | Saccomando | C10M 137/08 |
| 2018/0119046 | A1 * | 5/2018 | Edwards | C10M 137/105 |
| 2018/0201862 | A1 | 7/2018 | Delbridge et al. | |
| 2019/0040336 | A1 * | 2/2019 | Iwai | C10M 133/12 |
| 2019/0062666 | A1 | 2/2019 | Hobson et al. | |
| 2019/0078035 | A1 * | 3/2019 | Kassir | C10M 129/56 |
| 2019/0225911 | A1 * | 7/2019 | Sutton | C10M 169/044 |
| 2020/0048573 | A1 * | 2/2020 | Filippini | C10M 139/00 |
| 2020/0157457 | A1 | 5/2020 | Iwasaki | |
| 2021/0024848 | A1 | 1/2021 | Saccomando et al. | |

FOREIGN PATENT DOCUMENTS

| | | | |
|---|---|---|---|
| JP | 47013237 | A | 7/1972 |
| JP | 2000063866 | A | 2/2000 |
| SU | 1129224 | | 12/1984 |
| WO | 2012/030590 | | 3/2012 |
| WO | 2012/177529 | | 12/2012 |
| WO | 2015/171676 | A1 | 11/2015 |
| WO | 2017/079016 | A1 | 5/2017 |
| WO | 2018/017454 | | 1/2018 |

OTHER PUBLICATIONS

Martin J.P. Harger, "Phosphoramidic acid monoesters as phosphorylating agents: steric effects and reluctance to form monomeric metaphosphate intermediates", ChemComm, Jul. 28, 2004. pp. 1952-1953, Dept. of Chemistry, University of Leicester, Leicester UK.

Rihua Wang, "Study of AEP-water soluble EP additives", Runhua Yu Mifeng, Dec. 31, 1994, vol. 3, 31, pp. 17-18.

* cited by examiner

ALKYL PHOSPHATE AMINE SALTS FOR USE IN LUBRICANTS

CROSS REFERENCE TO RELATED APPLICATION

This application claims priority from PCT Application Serial No. PCT/US2017/042325 filed on Jul. 17, 2017, which claims the benefit of U.S. Provisional Application No. 62/364,603 filed on Jun. 20, 2016, both of which are incorporated in their entirety by reference herein.

FIELD OF THE INVENTION

The disclosed technology relates to lubricants containing a phosphorus composition which provide good wear and seals protection in lubricating, for example, gears.

BACKGROUND

It is known that lubricating compositions become less effective during their use due to exposure to the operating conditions of the device they are used in, and particularly due to exposure to heat generated by the operation of the device or contaminants present in the lubricant. The heat and contaminants may oxidize hydrocarbons found in the lubricating oil, yielding carboxylic acids and other oxygenates. These oxidized and acidic hydrocarbons can then go on to cause corrosion, wear and deposit problems.

Base-containing additives, such as amines, can be added to lubricating compositions in order to neutralize such byproducts, thus reducing the harm they cause to the lubricating composition and to the device. However, the amine additives can lead to additional detrimental effects. For example, it is known that some amines tend to degrade fluoroelastomeric seals materials. The amines are believed to cause the first step in seals degradation, dehydrofluorination in fluoroelastomeric seals materials, such as Viton® seals. Seal degradation may lead to seal failure, such as seal leaks, harming engine performance and possibly causing device damage. Generally, only a small amount of amine-containing additives can be added before seals degradation becomes a significant issue, limiting the amount of neutralization that can be provided by such additives.

Further, gear oil antiwear and extreme pressure agent chemistry and development has been driven by the desire to provide chemistries that meet modern lubricating requirements, provide thermo-oxidative stability and cleanliness, and have non-objectionable odor. Many current phosphorus antiwear or extreme pressure additives contain sulfur. Due to increasing environmental concerns, the presence of sulfur in antiwear or extreme pressure additives is becoming less desirable. In addition, many of the sulfur-containing antiwear or extreme pressure additives evolve volatile sulfur species, resulting in lubricating compositions containing antiwear or extreme pressure additives having an odor, which may also be detrimental to the environment or evolve emissions that may be higher than increasingly tighter health and safety legislation specifies.

Driveline power transmitting devices (such as gears or transmissions, especially axle fluids and manual transmission fluids (MTFs)) and grease applications, present highly challenging technological problems and solutions for satisfying the multiple and often conflicting lubricating requirements, while providing durability and cleanliness. For example, many antiwear or extreme pressure additives used to lubricate power transmitting devices can have deleterious effects on the device seals.

As such, there is an escalating demand to provide antiwear chemistry that provides good performance at low levels of phosphorus and/or which performs well in low viscosity lubricant formulations. It is also desirable to have a lubricant or additive therefor which has an acceptable appearance, that is, without haze or objectionable color; the final lubricant may ideally be clear or homogenous.

Driveline power transmitting devices (such as gears or transmissions, especially axle fluids and manual transmission fluids (MTFs)) and grease applications, present highly challenging technological problems and solutions for satisfying the multiple and often conflicting lubricating requirements, while providing durability and cleanliness. For example, many antiwear or extreme pressure additives used to lubricate power transmitting devices can have deleterious effects on the device seals.

SUMMARY

The disclosed technology is an antiwear additive that is both low in sulfur and contains a "seals friendly" amine that can neutralize acidic components in the lubricant with minimal negative impact seal tensile strength and elasticity. Accordingly, the disclosed technology provides a lubricant composition comprising an oil of lubricating viscosity and about 0.01 to about 5 percent by weight of a substantially sulfur-free alkyl phosphate amine salt ("phos-amine salt") wherein at least about 30 mole percent of the phosphorus atoms are in an alkyl pyrophosphate salt structure. At least about 80 mole percent of the alkyl groups of the phosphate structure are secondary alkyl groups of about 3 to about 12 carbon atoms. The amine portion is a hydrocarbyl amine that is a hindered hydrocarbyl amine, an aromatic hydrocarbyl amine, or a combination thereof.

The phos-amine salt may comprise a species represented by formula (I) or (II):

(I)

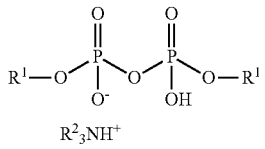

or (II)

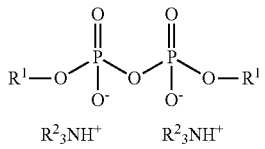

The phos-amine salt is prepared or preparable by the reaction of phosphorus pentoxide with a secondary alcohol having about 3 to about 12 carbon atoms and reacting the product thereof with a hydrocarbyl amine. The hydrocarbyl amine may comprise at least one $C_1$-$C_{30}$, $C_1$-$C_{20}$, $C_4$-$C_{18}$, or $C_6$-$C_{14}$ hydrocarbyl group. In the reaction to prepare the alkyl phosphate amine salt, the phosphorus pentoxide may be reacted with about 2.2 to about 3.1 moles, or about 2.3 to about 2.8 moles, or 2.4 to 2.4 per mole of P2O5, of the secondary alcohol at a temperature of about 30° C. to about 60° C.

The alkyl phosphate amine salt may comprise up to about 60 mole percent of the phosphorus atoms in mono- or di-alkyl-orthophosphate salt structures. In other embodiments, the alkyl phosphate amine salt may comprise at least about 50 to about 80, or 55 to 65 mole percent of the phosphorus atoms in an alkyl pyrophosphate salt structure.

In other embodiments, the hydrocarbyl amine can be a hindered amine represented by formula (III)

$$R^3—NR^5—R^4 \quad \text{(III)}$$

wherein $R^3$, $R^4$, and $R^5$ are independently a $C_1$-$C_{30}$ hydrocarbyl group. In other embodiments, $R^3$, $R^4$, and $R^5$ can independently be a $C_1$-$C_{20}$, $C_4$-$C_{18}$, or $C_6$-$C_{14}$ hydrocarbyl group. In another embodiment, the hindered hydrocarbyl amine may have at least one aromatic group.

In other embodiments, the hydrocarbyl amine can be an aromatic amine having an alkyl group attached directly to a nitrogen atom that salts with the phosphate and wherein the nitrogen atom may optionally be further alkylated. In yet other embodiments the hydrocarbyl amine can be a tertiary alkyl amine with at least two branched alkyl groups. The at least two branched alkyl groups can independently be branched at the α or the β position. In yet other embodiments, the at least two branched alkyl groups can both be branched at the β position. In some embodiments, the alkyl group or groups of the alkylphosphate structure may comprise 4-methylpent-2-yl groups.

In one embodiment, the lubricant composition the oil of lubricating viscosity may have a kinematic viscosity at 100° C. by ASTM D445 of about 3 to about 7.5, or about 3.6 to about 6, or about 3.5 to about 5 mm2/s. In another embodiment, the oil of lubricating viscosity may comprise a poly alpha olefin having a kinematic viscosity at 100° C. by ASTM D445 of about 3 to about 7.5.

In other embodiments, the lubricant composition may optionally comprise an overbased alkaline earth metal detergent in an amount to provide 1 to about 500, or 1 to about 100, or 10 to about 50 parts by million by weight alkaline earth metal. In some embodiments, the lubricant composition may optionally comprise 1 to about 30, or about 5 to about 15, percent by weight of a polymeric viscosity index modifier. In yet other embodiments, the lubricant composition may optionally comprise an extreme pressure agent. In other embodiments, a composition prepared by admixing the components as described above is disclosed.

Methods of lubricating a mechanical device are also disclosed. The methods may comprise supplying any of the lubricant compositions described above to the mechanical device. Exemplary mechanical devices include, but are not limited to, gears, axels, manual transmissions, automatic transmission (or a dual clutch transmission "DCT").

In other embodiments, methods of reducing seal deterioration are disclosed. The methods may comprise supplying any of the lubricant compositions described above to the mechanical device. In one embodiment, the seal elongation of a fluoro-elastomeric seal at rupture is less than 40% using ASTM D 5662.

In other embodiments, methods of preparing a substantially sulfur-free alkyl phosphate amine salt ("phos-amine salt") are also disclosed. The methods may comprise reacting phosphorus pentoxide with about an equivalent amount of a secondary alcohol or a mixture of secondary alcohols having about 3 to about 12 carbon atoms, at a temperature of about 40 to about 60° C., and reacting the product thereof with an amine. At least about 30 mole percent of the phosphorus atoms may be in an alkyl pyrophosphate salt structure; wherein at least about 80 mole percent of the alkyl groups are secondary alkyl groups of about 3 to about 12 carbon atoms. The amine may be a hydrocarbyl amine that is a hindered hydrocarbyl amine, an aromatic hydrocarbyl amine, or a combination thereof.

DETAILED DESCRIPTION

Various preferred features and embodiments will be described below by way of non-limiting illustration.

Oil of Lubricating Viscosity

One component of the disclosed technology is an oil of lubricating viscosity, also referred to as a base oil. The base oil may be selected from any of the base oils in Groups I-V of the American Petroleum Institute (API) Base Oil Interchangeability Guidelines (2011), namely

| Base Oil Category | Sulfur (%) | Saturates (%) | Viscosity Index |
|---|---|---|---|
| Group I | >0.03 and/or <90 | | 80 to less than 120 |
| Group II | ≤0.03 and ≥90 | | 80 to less than 120 |
| Group III | ≤0.03 and ≥90 | | ≥120 |
| Group IV | All polyalphaolefins (PAOs) | | |
| Group V | All others not included in Groups I, II, III or IV | | |

Groups I, II and III are mineral oil base stocks. Other generally recognized categories of base oils may be used, even if not officially identified by the API: Group II+, referring to materials of Group II having a viscosity index of 110-119 and lower volatility than other Group II oils; and Group III+, referring to materials of Group III having a viscosity index greater than or equal to 130. The oil of lubricating viscosity can include natural or synthetic oils and mixtures thereof. Mixture of mineral oil and synthetic oils, e.g., polyalphaolefin oils and/or polyester oils, may be used.

In one embodiment the oil of lubricating viscosity has a kinematic viscosity at 100° C. by ASTM D445 of 3 to 7.5, or 3.6 to 6, or 3.5 to mm2/s. In one embodiment the oil of lubricating viscosity comprises a poly alpha olefin having a kinematic viscosity at 100° C. by ASTM D445 of 3 to 7.5 or any of the other aforementioned ranges.

Phosphate Amine Salt

The lubricant of the disclosed technology will include a substantially sulfur-free alkyl phosphate amine salt, as further described. In this salt composition, at least 30 mole percent of the phosphorus atoms are in an alkyl pyrophosphate structure, as opposed to an orthophosphate (or monomeric phosphate) structure. The percentage of phosphorus atoms in the pyrophosphate structure may be 30 to 100 mole %, or 40 to 90% or 50 to 80% or 55 to 65%. The remaining amount of the phosphorus atoms may be in an orthophosphate structure or may consist, in part, in unreacted phosphorus acid or other phosphorus species. In one embodiment, up to 60 or up to 50 mole percent of the phosphorus atoms are in mono- or di-alkyl-orthophosphate salt structure.

The substantially sulfur-free alkyl phosphate amine salt, as present in the pyrophosphate form (sometimes referred to as the POP structure), may be represented in part by the following formulas (I) and/or (II):

(I)

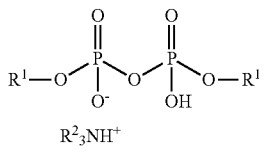

$R^2{}_3NH^+$ or

-continued (II)

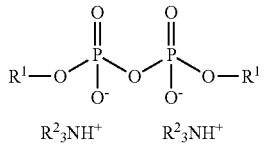

Formula (I) represents a half-neutralized phosphorus salt; formula (II) a fully neutralized salt. It is believed that both of the two hydroxy hydrogen atoms of the first-formed phosphate structure are sufficiently acidic to be neutralized by an amine, so that formula (II) may predominate if a stoichiometrically sufficient amount of amine is present. The extent of neutralization in practice, that is, the degree of salting of the —OH groups of the phosphorus esters, may be 50% to 100%, or 80% to 99%, or 90% to 98%, or 93% to 97%, or about 95%, which may be determined or calculated on the basis of the amount of amine charged to the phosphate ester mixture. Variants of these materials may also be present, such as a variant of formula (I) wherein the —OH group is replaced by another —$OR^1$ group or one or more —$OR^1$ groups are replaced by —OH groups, or those comprising a third phosphorus structure in place of a terminal $R^1$ group.

The structures of formulas (I) and (II) are shown as entirely sulfur-free species, in that the phosphorus atoms are bonded to oxygen, rather than sulfur atoms. However, it is possible that a small molar fraction of the O atoms could be replaced by S atoms, such as 0 to 5 percent or 0.1 to 4 percent or 0.2 to 3 percent or 0.5 to 2 percent.

These pyrophosphate salts may be distinguished from orthophosphate salts of the general structure of formula

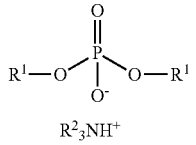

which optionally may also be present in amounts as indicated above.

In formulas (I) and (II), each $R^1$ is independently an alkyl group of 3 to 12 carbon atoms. In certain embodiments at least 80 mole percent, or at least 85, 90, 95, or 99 percent, of the alkyl groups will be secondary alkyl groups. In some embodiments the alkyl groups will have 4 to 12 carbon atoms, or 5 to 10, or 6 to 8 carbon atoms. Such groups include 2-butyl, 2-pentyl, 3-pentyl, 3-methyl-2-butyl, 2-hexyl, 3-hexyl, cyclohexyl, 4-methyl-2-pentyl, and other such secondary groups and isomers thereof having 6, 7, 8, 9, 10, 11, or 12 carbon atoms. In some embodiments the alkyl group will have a methyl branch at the α-position of the group, an example being the 4-methyl-2-pentyl (also referred to as 4-methylpent-2-yl) group.

Such alkyl (including cycloalkyl) groups will typically be provided by the reaction of the corresponding alcohol or alcohols with phosphorus pentoxide (taken herein to be $P_2O_5$ although it is recognized the more probable structure may be represented by $P_4O_{10}$). Typically 2.2 to 3.1 moles of alcohol will be provided per mole of $P_2O_5$ to provide a mixture of partial esters including mono- and diesters of the orthophosphate structure and diesters of the pyrophosphate structure:

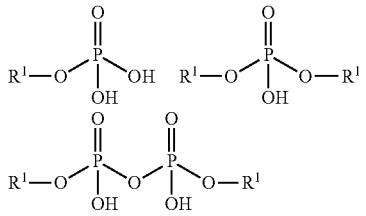

In certain embodiments 2.5 to 3 moles of alcohol may be provided per mole of $P_2O_5$. The 2.5 to 3 moles of alcohol typically may be made available to react with the $P_2O_5$ (i.e., included in the reaction mixture) but normally the actual reaction will consume less than 3 moles/mole. Thus the alkyl phosphate amine salt may be prepared by the reaction of phosphorus pentoxide with a secondary alcohol having 3 to 12 carbon atoms, and reacting the product thereof with an amine, as described in further detail below.

Reaction conditions and reactants may be selected which will favor formation of the esters of the pyrophosphate structure and will relatively disfavor formation of the orthophosphate mono- and di-esters. The use of secondary alcohols, rather than primary alcohols, is found to favor formation of the pyrophosphate structure. Favorable synthesis temperatures include 30 to 60° C. or 35 to 60° C. or 40 to 60° C., or 30 to 40° C., or about 35° C., although subsequent heating at 60 to 80° C. or about 70° C. after the initial mixing of components may be desirable. Favorable conditions may also include exclusion of extraneous water. The relative amounts of the various phosphorus species may be determined by spectroscopic means known to those skilled in the art, including infrared spectroscopy and P or H NMR spectroscopy.

While the pyrophosphate ester may be isolated, if desired, from the orthoesters, it is also possible, and may be commercially preferable, to use the reaction mixture without separation of the components.

Amine Component

The pyrophosphate phosphate ester or mixture of phosphate esters will be reacted with an amine to form an amine salt. The amine portion is a hydrocarbyl amine that is a hindered hydrocarbyl amine, an aromatic hydrocarbyl amine, or a combination thereof. Suitable hydrocarbyl amines include monoamines, diamines, and polyamines having 1 to 30 carbon atoms, 1 to 20 carbon atoms, 4 to 18 carbon atoms, or 6 to 14 carbon atoms. The amines may be primary, secondary or tertiary amines, or even mixtures thereof. Further as the hydrocarbyl groups may comprise hetero substituents, suitable amines also include amine esters. The hydrocarbyl groups may be linear, branched or cyclic (aromatic). In some embodiments, the hydrocarbyl amine may be an aromatic hydrocarbyl amine wherein at least one hydrocarbyl substituent on the nitrogen comprises an aromatic hydrocarbon ring. In other embodiments, the hydrocarbyl amine may be a hindered hydrocarbyl amine wherein the attached hydrocarbyl groups create an amine that is sterically hindered. In some embodiments, the hydrocarbyl amine may comprise a mixture of aromatic hydrocarbyl amines and hindered hydrocarbyl amines. In yet other embodiments, the hindered hydrocarbyl amines may have at least one hydrocarbyl group that is an aromatic hydrocarbyl group.

As used herein, the term "hydrocarbyl", "hydrocarbyl substituent", or "hydrocarbyl group" is used in its ordinary sense, which is well-known to those skilled in the art.

Specifically, it refers to a group having a carbon atom directly attached to the remainder of the molecule and having predominantly hydrocarbon character. Examples of hydrocarbyl groups include:

hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy);

hetero substituents, that is, substituents which, while having a predominantly hydrocarbon character, in the context of this invention, contain other than carbon in a ring or chain otherwise composed of carbon atoms and encompass substituents as pyridyl, furyl, thienyl and imidazolyl. Heteroatoms include sulfur, oxygen, and nitrogen. In general, no more than two, or no more than one, non-hydrocarbon substituent will be present for every ten carbon atoms in the hydrocarbyl group; alternatively, there may be no non-hydrocarbon substituents in the hydrocarbyl group.

1. Suitable hindered hydrocarbyl amines are not overly limited. They include monoamines, diamines, and polyamines with linear, branched, or cyclic $C_1$-$C_{30}$ hydrocarbyl groups. The hydrocarbyl groups may be substituted with other atoms, typically oxygen. In some embodiments, the hindered hydrocarbyl amine may be represented by a structure of formula (III)

$$R^3—NR^5—R^4 \quad (III)$$

wherein $R^3$, $R^4$, and $R^5$ are independently a $C_1$-$C_{30}$ hydrocarbyl group. In other embodiments, $R^1$, $R^2$, and $R^3$ may independently be a $C_1$-$C_{20}$, a $C_4$-$C_{18}$, or a $C_6$-$C_{14}$ hydrocarbyl group.

In some embodiments, the hindered hydrocarbyl amine may be represented by a structure of formula (IV)

(IV)

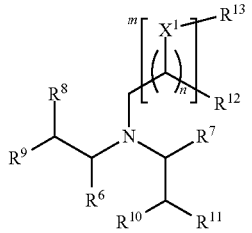

wherein $R^6$ and $R^7$ are independently hydrogen or a $C_1$-$C_{30}$ hydrocarbyl group; $R^8$, $R^9$, $R^{10}$, $R^{11}$, and $R^{12}$ are independently a $C_1$-$C_{30}$ hydrocarbyl group; $R^{14}$ is hydrogen, a $C_1$-$C_{30}$ hydrocarbyl group, or N—$CHR^{14}$—($CR^{15}R^{16}$) wherein $R^{14}$, $R^{15}$, and $R^{16}$ are independently hydrogen or a $C_1$-$C_{30}$ hydrocarbyl group; $X^1$ is a $C_1$-$C_{30}$ hydrocarbyl group, oxygen, an oxygen-containing $C_1$-$C_{30}$ hydrocarbyl group, or N—$CHR^{14}$—($CR^{15}R^{16}$) wherein $R^{14}$, $R^{15}$, and $R^{16}$ are independently hydrogen or a $C_1$-$C_{30}$ hydrocarbyl group; m is an integer from 1 to 20; and n is an integer from 1 to 10. In some embodiments, the hydrocarbyl groups may be a $C_1$-$C_{20}$, a $C_4$-$C_{18}$, or a $C_6$-$C_{14}$ hydrocarbyl group. In some embodiments, $R^8$, $R^9$, $R^{10}$, $R^{11}$, and $R^{12}$ are independently hydrogen or a $C_1$-$C_{20}$ alkyl group. In some embodiments, $R^6$ and $R^7$ are independently hydrogen, a $C_1$-$C_{12}$ alkyl group, or an aryl group. In some embodiments, $X^1$ may be an alkyl or aryl group. Exemplary hindered hydrocarbyl amines that may be represented by formula (II) include, but are not limited to, 2-ethyl-N-(2-ethylhexyl)-N-phenethylhexan-1-amine, N,N'-(((oxybis(ethane-2,1-diyl))bis(oxy))bis(ethane-2,1-diyl))bis(2-ethyl-N-(2-ethylhexyl)hexan-1-amine), N,N'-(((oxybis(ethane-2,1-diyl))bis(oxy))bis(propane-3,1-diyl))bis(2-ethyl-N-(2-ethylhexyl)hexan-1-amine), tris(2-ethylhexyl)amine, 2-ethyl-N-(2-ethylhexyl)-N-(2-methoxyethyl)hexan-1-amine, and combinations thereof.

In some embodiments, the hindered hydrocarbyl amine may be represented by a structure of formula (V)

(V)

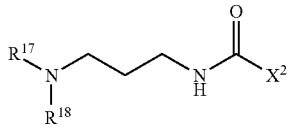

wherein $R^{17}$ and $R^{18}$ are independently a $C_1$-$C_{30}$ hydrocarbyl group; and $X^2$ is a $C_1$-$C_{30}$ group or an oxygen-containing $C_1$-$C_{30}$ hydrocarbyl group. In some embodiments, the hydrocarbyl groups may be a $C_1$-$C_{20}$, a $C_4$-$C_{18}$, or a $C_6$-$C_{14}$ hydrocarbyl group. In some embodiments, $R^{17}$ and $R^{18}$ may independently be a branched alkyl and/or a cyclic-containing alkyl having 6 to 20 carbon atoms. In some embodiments, $X^1$ may be an alkyl, acyl, or aryl group. An exemplary hindered hydrocarbyl amine that may be represented by formula (V) includes, but is not limited to, $N^1$,$N^2$-bis(3-(bis(16-methylheptadecyl)amino)propyl)oxalamide.

Additional exemplary hindered hydrocarbyl amines include, but are not limited to, 2-morpholinoethyl 16-methylheptadecanoate, 2-ethyl-N-(2-ethylhexyl)-N-(2-methylpentyl)hexan-1-amine, 2-ethyl-N-(2-ethylhexyl)-N-(4-methylpentan-2-yl)hexan-1-amine, 2-ethyl-N,N-bis(2-ethylbutyl)hexan-1-amine, bis(2-morpholinoethyl) 9,10-dinonyloctadecanedioate, 2-ethyl-N-isobutyl-N-(4-methylpentan-2-yl)hexan-1-amine, and combinations thereof.

In some embodiments, the aromatic amine may have the formula (VI) or (VII):

(VI)

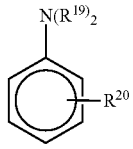

or (VII)

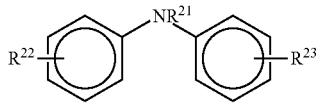

wherein $R^{19}$, $R^{20}$, $R^{21}$, $R^{22}$, and $R^{23}$, are independently hydrogen or a linear or branched $C_1$-$C_{30}$ hydrocarbyl group. In some embodiments, the hydrocarbyl groups may be a $C_1$-$C_{20}$, a $C_4$-$C_{18}$, or a $C_6$-$C_{14}$ hydrocarbyl group. In some embodiments, at least one of the carbon atoms in the aromatic ring may be substituted with a heteroatom. Heteroatoms include sulfur, oxygen, and nitrogen. In one embodiment, the heteroatom may be oxygen. Accordingly, in one embodiment, the aromatic amine may have the structure of formula (VIa) below:

(VIa)

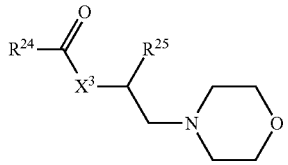

wherein $R^{24}$ and $R^{25}$ are independently hydrogen or a linear or branched $C_1$-$C_{30}$ hydrocarbyl group; and $X^3$ is O, an oxygen-containing $C_1$-$C_{30}$ hydrocarbyl group, NH, or an N-alkyl group. In some embodiments, the hydrocarbyl groups may be a $C_1$-$C_{20}$, a $C_4$-$C_{18}$, or a $C_6$-$C_{14}$ hydrocarbyl group. In other embodiments, $R^{24}$ and $R^{25}$ may independently be hydrogen or a $C_1$-$C_{20}$ alkyl group.

Suitable aromatic amines include, but are not limited to, decyl 2-aminobenzoate, 2-ethoxy-N,N-diethylhexylaniline, 4-ethoxy-N,N-diethylhexylaniline, 2-ethoxy-N,N-dihexylaniline, 4-ethoxy-N,N-dihexylaniline, 4-ethoxy-N,N-bis(2-ethylhexyl)aniline, N,N-dihexylaniline, 2-ethoxy-N,N-dihexylaniline, 4-ethoxy-N,N-dihexylaniline, bis(3-nonylphenyl)amine, bis(4-nonylphenyl)amine, 2-morpholinoethyl 17-methylheptadecanoate, and combinations thereof.

The diamine may be any diamine having at least one carbon atom between the two nitrogen atoms. In some embodiments, the diamine may have a an aromatic ring between the two nitrogen atom as in the formula (VIII):

(VIII)

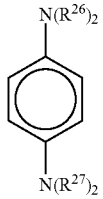

wherein $R^{26}$ and $R^{27}$ are independently hydrogen or a linear or branched $C_1$-$C_{30}$ hydrocarbyl group. In some embodiments, the hydrocarbyl groups may be a $C_1$-$C_{20}$, a $C_4$-$C_{18}$, or a $C_6$-$C_{14}$ hydrocarbyl group. Suitable diamines of this type include, but are not limited to, $N^1$,$N^1$,$N^4$,$N^4$-tetraheptylbenzene-1,4-diamine, $N^1$,$N^1$,$N^4$,$N^4$-tetrapentylbenzene-1,4-diamine, $N^1$,$N^4$-di-sec-butyl-$N^1$,$N^4$-bis(2-ethylhexyl)benzene-1,4-diamine, $N^1$,$N^4$-bis(2-ethylhexyl)-$N^1$,$N^4$-bis(4-methylpentan-2-yl)benzene-1,4-diamine, $N^1$,$N^4$-di-sec-butyl-$N^1$,$N^4$-dipentylbenzene-1,4-diamine, and combinations thereof.

The amine, of whatever type, will be reacted to neutralize the acidic group(s) on the phosphorus ester component, which will comprise the pyrophosphate ester as described above as well as any orthophosphate esters that may be present.

Amount of the Amine Salt

The amount of the substantially sulfur-free alkyl phosphate amine salt in the lubricant composition may be 0.1 to 5 percent by weight. This amount refers to the total amount of the phosphate amine salt or salts, of whatever structure, both ortho-phosphate and pyrophosphate (with the understanding that at least 30 mole percent of the phosphorus atoms are in an alkyl pyrophosphate salt structure). The amounts of the phosphate amine salts in the pyrophosphate structure may be readily calculated therefrom. Alternative amounts of the alkyl phosphate amine salt may be 0.2 to 3 percent, or 0.2 to 1.2 percent, or 0.5 to 2 percent, or 0.6 to 1.7 percent, or 0.6 to 1.5 percent, or 0.7 to 1.2 percent by weight. The amount may be suitable to provide phosphorus to the lubricant formulation in an amount of 200 to 3000 parts per million by weight (ppm), or 400 to 2000 ppm, or 600 to 1500 ppm, or 700 to 1100 ppm, or 1100 to 1800 ppm.

Other Components

Detergent

The lubricant formulations described herein may optionally contain an alkaline earth metal detergent, which may optionally be overbased. Detergents, when they are overbased, may also be referred to as overbased or superbased salts. They are generally homogeneous Newtonian systems having by a metal content in excess of that which would be present for neutralization according to the stoichiometry of the metal and the detergent anion. The amount of excess metal is commonly expressed in terms of metal ratio, that is, the ratio of the total equivalents of the metal to the equivalents of the acidic organic compound. Overbased materials may be prepared by reacting an acidic material (such as carbon dioxide) with an acidic organic compound, an inert reaction medium (e.g., mineral oil), a stoichiometric excess of a metal base, and a promoter such as a phenol or alcohol. The acidic organic material will normally have a sufficient number of carbon atoms, to provide oil-solubility.

Overbased detergents may be characterized by Total Base Number (TBN, ASTM D2896), the amount of strong acid needed to neutralize all of the material's basicity, expressed as mg KOH per gram of sample. Since overbased detergents are commonly provided in a form which contains diluent oil, for the purpose of this document, TBN is to be recalculated to an oil-free basis by dividing by the fraction of the detergent (as supplied) that is not oil. Some useful detergents may have a TBN of 100 to 800, or 150 to 750, or, 400 to 700.

While the metal compounds useful in making the basic metal salts are generally any Group 1 or Group 2 metal compounds (CAS version of the Periodic Table of the Elements), the disclosed technology will typically use an alkaline earth such as Mg, Ca, or Ba, typically Mg or Ca, and often calcium. The anionic portion of the salt can be hydroxide, oxide, carbonate, borate, or nitrate.

In one embodiment the lubricant can contain an overbased sulfonate detergent. Suitable sulfonic acids include sulfonic and thiosulfonic acids, including mono- or polynuclear aromatic or cycloaliphatic compounds. Certain oil-soluble sulfonates can be represented by $R^{13}$-T-$(SO_3^-)_a$ or $R^{14}$—$(SO_3^-)_b$, where a and b are each at least one; T is a cyclic nucleus such as benzene or toluene; $R^{13}$ is an aliphatic group such as alkyl, alkenyl, alkoxy, or alkoxyalkyl; $(R^{13})$-T typically contains a total of at least 15 carbon atoms; and $R^{14}$ is an aliphatic hydrocarbyl group typically containing at least 15 carbon atoms. The groups T, $R^{13}$, and $R^{14}$ can also contain other inorganic or organic substituents. In one embodiment the sulfonate detergent may be a predominantly linear alkylbenzenesulfonate detergent having a metal ratio of at least 8 as described in paragraphs [0026] to [0037] of US Patent Application 2005065045. In some embodiments the linear alkyl group may be attached to the benzene ring anywhere along the linear chain of the alkyl group, but often in the 2, 3 or 4 position of the linear chain, and in some instances predominantly in the 2 position.

Another overbased material is an overbased phenate detergent. The phenols useful in making phenate detergents can be represented by $(R^{15})_a$—Ar—$(OH)_b$, where $R^{15}$ is an aliphatic hydrocarbyl group of 4 to 400 or 6 to 80 or 6 to 30 or 8 to 25 or 8 to 15 carbon atoms; Ar is an aromatic group such as benzene, toluene or naphthalene; a and b are each at least one, the sum of a and b being up to the number of displaceable hydrogens on the aromatic nucleus of Ar, such as 1 to 4 or 1 to 2. There is typically an average of at least 8 aliphatic carbon atoms provided by the $R^{15}$ groups for each phenol compound. Phenate detergents are also sometimes provided as sulfur-bridged species.

In one embodiment, the overbased material may be an overbased saligenin detergent. A general example of such a saligenin derivative can be represented by the formula

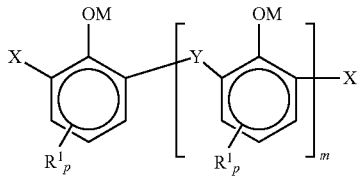

where X is —CHO or —$CH_2OH$, Y is —$CH_2$— or —$CH_2OCH_2$—, and the —CHO groups typically comprise at least 10 mole percent of the X and Y groups; M is hydrogen, ammonium, or a valence of a metal ion (that is, if M is multivalent, one of the valences is satisfied by the illustrated structure and other valences are satisfied by other species such as anions or by another instance of the same structure), $R^1$ is a hydrocarbyl group of 1 to 60 carbon atoms, m is 0 to typically 10, and each p is independently 0, 1, 2, or 3, provided that at least one aromatic ring contains an $R^1$ substituent and that the total number of carbon atoms in all $R^1$ groups is at least 7. When m is 1 or greater, one of the X groups can be hydrogen. Saligenin detergents are disclosed in greater detail in U.S. Pat. No. 6,310,009, with special reference to their methods of synthesis (Column 8 and Example 1) and preferred amounts of the various species of X and Y (Column 6).

Salixarate detergents are overbased materials that can be represented by a compound comprising at least one unit of formula (IX) or formula (X) and each end of the compound having a terminal group of formula (XI) or (XII):

(IX)

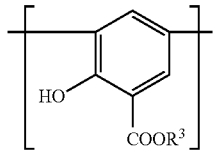

(X)

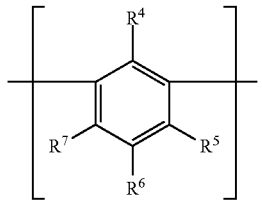

-continued (XI)

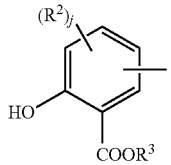

(XII)

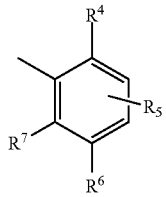

such groups being linked by divalent bridging groups A, which may be the same or different. In formulas (IX)-(XII) $R^3$ is hydrogen, a hydrocarbyl group, or a valence of a metal ion; $R^2$ is hydroxyl or a hydrocarbyl group, and j is 0, 1, or 2; $R^6$ is hydrogen, a hydrocarbyl group, or a hetero-substituted hydrocarbyl group; either $R^4$ is hydroxyl and $R^5$ and $R^7$ are independently either hydrogen, a hydrocarbyl group, or hetero-substituted hydrocarbyl group, or else $R^5$ and $R^7$ are both hydroxyl and $R^4$ is hydrogen, a hydrocarbyl group, or a hetero-substituted hydrocarbyl group; provided that at least one of $R^4$, $R^5$, $R^6$ and $R^7$ is hydrocarbyl containing at least 8 carbon atoms; and wherein the molecules on average contain at least one of unit (IX) or (XI) and at least one of unit (X) or (XII) and the ratio of the total number of units (IX) and (XI) to the total number of units of (X) and (XII) in the composition is 0.1:1 to 2:1. The divalent bridging group "A," which may be the same or different in each occurrence, includes —$CH_2$— and —$CH_2OCH_2$—, either of which may be derived from formaldehyde or a formaldehyde equivalent (e.g., paraform, formalin). Salixarate derivatives and methods of their preparation are described in greater detail in U.S. Pat. No. 6,200,936 and PCT Publication WO 01/56968. It is believed that the salixarate derivatives have a predominantly linear, rather than macrocyclic, structure, although both structures are intended to be encompassed by the term "salixarate."

Glyoxylate detergents are similar overbased materials which are based on an anionic group which, in one embodiment, may have the structure

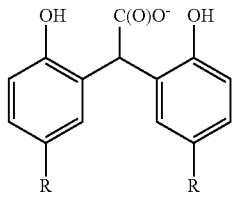

wherein each R is independently an alkyl group containing at least 4 or 8 carbon atoms, provided that the total number of carbon atoms in all such R groups is at least 12 or 16 or 24. Alternatively, each R can be an olefin polymer substituent. Overbased glyoxylic detergents and their methods of preparation are disclosed in greater detail in U.S. Pat. No. 6,310,011 and references cited therein.

The overbased detergent can also be an overbased salicylate, e.g., a calcium salt of a substituted salicylic acid. The salicylic acids may be hydrocarbyl-substituted wherein each substituent contains an average of at least 8 carbon atoms per substituent and 1 to 3 substituents per molecule. The substituents can be polyalkene substituents. In one embodiment, the hydrocarbyl substituent group contains 7 to 300 carbon atoms and can be an alkyl group having a molecular weight of 150 to 2000. Overbased salicylate detergents and their methods of preparation are disclosed in U.S. Pat. Nos. 4,719,023 and 3,372,116.

Other overbased detergents can include overbased detergents having a Mannich base structure, as disclosed in U.S. Pat. No. 6,569,818.

In certain embodiments, the hydrocarbyl substituents on hydroxy-substituted aromatic rings in the above detergents (e.g., phenate, saligenin, salixarate, glyoxylate, or salicylate) are free of or substantially free of $C_{12}$ aliphatic hydrocarbyl groups (e.g., less than 1%, 0.1%, or 0.01% by weight of the substituents are $C_{12}$ aliphatic hydrocarbyl groups). In some embodiments such hydrocarbyl substituents contain at least 14 or at least 18 carbon atoms.

The amount of the overbased detergent, if present in the formulations of the present technology, is typically at least 0.1 weight percent on an oil-free basis, such as 0.2 to 3 or 0.25 to 2, or 0.3 to 1.5 weight percent, or alternatively at least 0.6 weight percent, such as 0.7 to 5 weight percent or 1 to 3 weight percent. Alternatively expressed, the detergent may be in an amount sufficient to provide 0 to 500, or 0 to 100, or 1 to 50 parts by million by weight of alkaline earth metal. Either a single detergent or multiple detergents can be present.

Viscosity Modifier

Another material which may optionally be present is a viscosity modifier. Viscosity modifiers (VM) and dispersant viscosity modifiers (DVM) are well known. Examples of VMs and DVMs may include polymethacrylates, polyacrylates, polyolefins, hydrogenated vinyl aromatic-diene copolymers (e.g., styrene-butadiene, styrene-isoprene), styrene-maleic ester copolymers, and similar polymeric substances including homopolymers, copolymers, and graft copolymers, including polymers having linear, branched, or star-like structures. The DVM may comprise a nitrogen-containing methacrylate polymer or nitrogen-containing olefin polymer, for example, a nitrogen-containing methacrylate polymer derived from methyl methacrylate and dimethylamino-propylamine. The DVM may alternatively comprise a copolymer with units derived from an α-olefin and units derived from a carboxylic acid or anhydride, such as maleic anhydride, in part esterified with a branched primary alcohol and in part reacted with an amine-containing compound.

Examples of commercially available VMs, DVMs and their chemical types may include the following: polyisobutylenes (such as Indopol™ from BP Amoco or Parapol™ from ExxonMobil); olefin copolymers (such as Lubrizol® 7060, 7065, and 7067, and Lucant® HC-2000L, HC-1100, and HC-600 from Lubrizol); hydrogenated styrene-diene copolymers (such as Shellvis™ 40 and 50, from Shell and LZ® 7308, and 7318 from Lubrizol); styrene/maleate copolymers, which are dispersant copolymers (such as LZ® 3702 and 3715 from Lubrizol); polymethacrylates, some of which have dispersant properties (such as those in the Viscoplex™ series from RohMax, the Hitec™ series of viscosity index improvers from Afton, and LZ® 7702, LZ® 7727, LZ® 7725 and LZ® 7720C from Lubrizol); olefin-graft-polymethacrylate polymers (such as Viscoplex™ 2-500 and 2-600 from RohMax); and hydrogenated polyisoprene star polymers (such as Shellvis™ 200 and 260, from Shell). Viscosity modifiers that may be used are described in U.S. Pat. Nos. 5,157,088, 5,256,752 and 5,395,539. The VMs and/or DVMs may be used in the functional fluid at a concentration of up to 50% or to 20% by weight, depending on the application. Concentrations of 1 to 20%, or 1 to 12%, or 3 to 10%, or alternatively 20 to 40%, or 20 to 30% by weight may be used.

Dispersant

Another material which may optionally be present is a dispersant. Dispersants are well known in the field of lubricants and include primarily what is known as ashless dispersants and polymeric dispersants. Ashless dispersants are so-called because, as supplied, they do not contain metal and thus do not normally contribute to sulfated ash when added to a lubricant. However they may, of course, interact with ambient metals once they are added to a lubricant which includes metal-containing species. Ashless dispersants are characterized by a polar group attached to a relatively high molecular weight hydrocarbon chain. Typical ashless dispersants include N-substituted long chain alkenyl succinimides, having a variety of chemical structures including typically

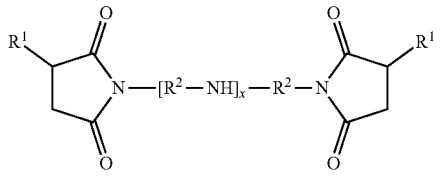

where each $R^1$ is independently an alkyl group, frequently a polyisobutylene group with a molecular weight ($M_n$) of 500-5000 based on the polyisobutylene precursor, and $R^2$ are alkylene groups, commonly ethylene ($C_2H_4$) groups. Such molecules are commonly derived from reaction of an alkenyl acylating agent with a polyamine, and a wide variety of linkages between the two moieties is possible beside the simple imide structure shown above, including a variety of amides and quaternary ammonium salts. In the above structure, the amine portion is shown as an alkylene polyamine, although other aliphatic and aromatic mono- and polyamines may also be used. Also, a variety of modes of linkage of the $R^1$ groups onto the imide structure are possible, including various cyclic linkages. The ratio of the carbonyl groups of the acylating agent to the nitrogen atoms of the amine may be 1:0.5 to 1:3, and in other instances 1:1 to 1:2.75 or 1:1.5 to 1:2.5. Succinimide dispersants are more fully described in U.S. Pat. Nos. 4,234,435 and 3,172,892 and in EP 0355895.

Another class of ashless dispersant is high molecular weight esters. These materials are similar to the above-described succinimides except that they may be seen as having been prepared by reaction of a hydrocarbyl acylating agent and a polyhydric aliphatic alcohol such as glycerol, pentaerythritol, or sorbitol. Such materials are described in more detail in U.S. Pat. No. 3,381,022.

Another class of ashless dispersant is Mannich bases. These are materials formed by the condensation of a higher molecular weight alkyl substituted phenol, an alkylene polyamine, and an aldehyde such as formaldehyde. They are described in more detail in U.S. Pat. No. 3,634,515.

As used herein, the term "condensation product" is intended to encompass esters, amides, imides and other such materials that may be prepared by a condensation reaction of an acid or a reactive equivalent of an acid (e.g., an acid halide, anhydride, or ester) with an alcohol or amine, irrespective of whether a condensation reaction is actually performed to lead directly to the product. Thus, for example, a particular ester may be prepared by a transesterification reaction rather than directly by a condensation reaction. The resulting product is still considered a condensation product.

Other dispersants include polymeric dispersant additives, which may be hydrocarbon-based polymers which contain polar functionality to impart dispersancy characteristics to the polymer.

Dispersants can also be post-treated by reaction with any of a variety of agents. Among these are urea, thiourea, dimercaptothiadiazoles, carbon disulfide, aldehydes, ketones, carboxylic acids, hydrocarbon-substituted succinic anhydrides, nitriles, epoxides, boron compounds, and phosphorus compounds. References detailing such treatment are listed in U.S. Pat. No. 4,654,403.

The amount of the dispersant in a fully formulated lubricant of the present technology may be at least 0.1% of the lubricant composition, or at least 0.3% or 0.5% or 1%, and in certain embodiments at most 9% or 8% or 6% or 4% or 3% or 2% by weight.

Extreme Pressure Agent

Another material which may optionally be present is an extreme pressure agent. In one embodiment the extreme pressure agent is a sulphur-containing compound. In one embodiment the sulphur-containing compound is a sulphurised olefin, a polysulphide, or mixtures thereof.

Examples of the sulphurised olefin include an olefin derived from propylene, isobutylene, pentene, an organic sulphide and/or polysulphide including benzyldisulphide; bis-(chlorobenzyl) disulphide; dibutyl tetrasulphide; di-tertiary butyl polysulphide; and sulphurised methyl ester of oleic acid, a sulphurised alkylphenol, a sulphurised dipentene, a sulphurised terpene, a sulphurised Diels-Alder adduct, an alkyl sulphenyl N'N-dialkyl dithiocarbamates; or mixtures thereof. In one embodiment the sulphurised olefin includes an olefin derived from propylene, isobutylene, pentene or mixtures thereof.

In one embodiment the extreme pressure agent sulphur-containing compound comprising a dimercaptothiadiazole, or mixtures thereof. Examples of the dimercaptothiadiazole include 2,5 dimercapto 1,3 4 thiadiazole or a hydrocarbyl-substituted 2,5-dimercapto-1,3-4-thiadiazole, or oligomers thereof. The oligomers of hydrocarbyl-substituted 2,5-dimercapto-1,3-4-thiadiazole typically form by forming a sulphur-sulphur bond between 2,5-dimercapto-1,3-4-thiadiazole units to form oligomers of two or more of said thiadiazole units. Suitable 2,5 dimercapto 1,3 4 thiadiazole compounds include 2,5-bis(tert-nonyldithio)-1,3,4-thiadiazole or 2-tert-nonyldithio-5-mercapto-1,3,4-thiadiazole.

The number of carbon atoms on the hydrocarbyl substituents of the hydrocarbyl-substituted 2,5-dimercapto-1,3-4-thiadiazole typically include about 1 to about 30, or about 2 to about 20, or about 3 to about 16.

In different embodiments the extreme pressure agent may be present in the lubricating composition in ranges including from 0.01 to 8 wt %, or 0.1 to 6 wt %, or 0.01 to 0.5 wt %, or 0.2 to 0.8 wt %, or 0.9, or 1 to 2, or 3.5 or 5 wt %, based on a total weight of the lubricating composition.

Other conventional components may also be included. Examples include friction modifiers, which are well known to those skilled in the art. A list of friction modifiers that may be used is included in U.S. Pat. Nos. 4,792,410, 5,395,539, 5,484,543 and 6,660,695. U.S. Pat. No. 5,110,488 discloses metal salts of fatty acids and especially zinc salts, useful as friction modifiers. A list of supplemental friction modifiers that may be used may include:

| | |
|---|---|
| fatty phosphites | borated alkoxylated fatty amines |
| fatty acid amides | metal salts of fatty acids |
| fatty epoxides | sulfurized olefins |
| borated fatty epoxides | fatty imidazolines |
| fatty amines | condensation products of carboxylic |
| glycerol esters | acids and polyalkylene-polyamines |
| borated glycerol esters | metal salts of alkyl salicylates |
| alkoxylated fatty amines | amine salts of alkylphosphoric acids |
| oxazolines | ethoxylated alcohols |
| hydroxyalkyl amides | imidazolines |
| dialkyl tartrates | polyhydroxy tertiary amines |
| molybdenum compounds | and mixtures of two or more thereof. |

The amount of friction modifier, if present, may be 0.05 to 5 percent by weight, or 0.1 to 2 percent, or 0.1 to 1.5 percent by weight, or 0.15 to 1 percent, or 0.15 to 0.6 percent.

Another optional component may be an antioxidant. Antioxidants encompass phenolic antioxidants, which may be hindered phenolic antioxidants, one or both ortho positions on a phenolic ring being occupied by bulky groups such as t-butyl. The para position may also be occupied by a hydrocarbyl group or a group bridging two aromatic rings. In certain embodiments the para position is occupied by an ester-containing group, such as, for example, an antioxidant of the formula

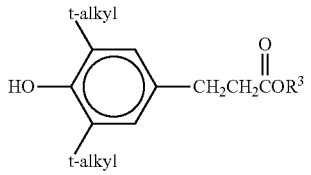

wherein $R^3$ is a hydrocarbyl group such as an alkyl group containing, e.g., 1 to 18 or 2 to 12 or 2 to 8 or 2 to 6 carbon atoms; and t-alkyl can be t-butyl. Such antioxidants are described in greater detail in U.S. Pat. No. 6,559,105.

Antioxidants also include aromatic amines. In one embodiment, an aromatic amine antioxidant can comprise an alkylated diphenylamine such as nonylated diphenylamine or a mixture of a di-nonylated and a mono-nonylated diphenylamine. If an aromatic amine is used as a component of the above-described phosphorus compound, it may itself impart some antioxidant activity such that the amount of any further antioxidant may be appropriately reduced or even eliminated.

Antioxidants also include sulfurized olefins such as mono- or disulfides or mixtures thereof. These materials generally have sulfide linkages of 1 to 10 sulfur atoms, e.g., 1 to 4, or 1 or 2. Materials which can be sulfurized to form the sulfurized organic compositions of the present invention include oils, fatty acids and esters, olefins and polyolefins made thereof, terpenes, or Diels-Alder adducts. Details of methods of preparing some such sulfurized materials can be found in U.S. Pat. Nos. 3,471,404 and 4,191,659.

Molybdenum compounds can also serve as antioxidants, and these materials can also serve in various other functions, such as antiwear agents or friction modifiers. U.S. Pat. No. 4,285,822 discloses lubricating oil compositions containing a molybdenum- and sulfur-containing composition prepared by combining a polar solvent, an acidic molybdenum compound and an oil-soluble basic nitrogen compound to form a molybdenum-containing complex and contacting the complex with carbon disulfide to form the molybdenum- and sulfur-containing composition.

Typical amounts of antioxidants will, of course, depend on the specific antioxidant and its individual effectiveness, but illustrative total amounts can be 0 to 5 percent by weight, or 0.01 to 5 percent by weight, or 0.15 to 4.5 percent, or 0.2 to 4 percent, or 0.2 to 1 percent or 0.2 to 0.7 percent.

Another optional additive is an antiwear agent. Examples of anti-wear agents include phosphorus-containing antiwear/extreme pressure agents in addition to those described above; such as metal-containing or non-metal thiophosphates, phosphoric acid esters and salts, such as amine salts, thereof, phosphorus-containing carboxylic acids, esters, ethers, and amides; phosphonates; and phosphites. In certain embodiments such phosphorus antiwear agent may be present in an amount to deliver 0.001 to 2 percent phosphorus, or 0.015 to 1.5, or 0.02 to 1, or 0.1 to 0.7, or 0.01 to 0.2, or 0.015 to 0.15, or 0.02 to 0.1, or 0.025 to 0.08 percent phosphorus. A material used in some applications may be a zinc dialkyldithiophosphate (ZDP). Non-phosphorus-containing anti-wear agents include borate esters (including borated epoxides), dithiocarbamate compounds, molybdenum-containing compounds, and sulfurized olefins.

Other materials that may be present include tartrate esters, tartramides, and tartrimides. Examples include oleyl tartrimide (the imide formed from oleylamine and tartaric acid) and oleyl diesters (from, e.g., mixed C12-16 alcohols). Other related materials that may be useful include esters, amides, and imides of other hydroxy-carboxylic acids in general, including hydroxy-polycarboxylic acids, for instance, acids such as tartaric acid, citric acid, lactic acid, glycolic acid, hydroxy-propionic acid, hydroxyglutaric acid, and mixtures thereof. These materials may also impart additional functionality to a lubricant beyond antiwear performance. These materials are described in greater detail in US Publication 2006-0079413 and PCT publication WO2010/077630. Such derivatives of (or compounds derived from) a hydroxy-carboxylic acid, if present, may typically be present in the lubricating composition in an amount of 0.01 to 5 weight %, or 0.05 to 5 or 0.1 weight % to 5 weight %, or 0.1 to 1.0 weight percent, or 0.1 to 0.5 weight percent, or 0.2 to 3 weight %, or greater than 0.2 weight % to 3 weight %.

Other additives that may optionally be used in lubricating oils, in their conventional amounts, include pour point depressing agents, extreme pressure agents, color stabilizers and anti-foam agents.

Methods and Application

The disclosed technology provides a method of lubricating a mechanical component, comprising supplying thereto a lubricant formulation as described herein.

In one embodiment, the component is a drivetrain component comprising at least one of a transmission, manual transmission, gear, gearbox, axle gear, automatic transmission, a dual clutch transmission, or combinations thereof. In another embodiment, the transmission may be an automatic transmission or a dual clutch transmission (DCT). Additional exemplary automatic transmissions include, but are not limited to, continuously variable transmissions (CVT), infinitely variable transmissions (IVT), toroidal transmissions, continuously slipping torque converted clutches (CSTCC), and stepped automatic transmissions.

Alternatively, the transmission may be a manual transmission (MT) or gear. In yet another embodiment, the component may be a farm tractor or off-highway vehicle component comprising at least one of a wet-brake, a transmission, a hydraulic, a final drive, a power take-off system, or combinations thereof.

In different embodiments, the lubricating composition may have a composition as described in Table 1. The weight percents (wt %) shown in Table 1 below are on an actives basis.

TABLE 1

| | Embodiments (wt %) | | |
|---|---|---|---|
| Additive | DCT fluid | Off-highway fluid | MT fluid |
| Phos-Amine Salt | 0.01 to 3 | 0.01 to 3 | 0.01 to 3 |
| Dispersant | 0.05 to 4 | 0 to 5 | 1 to 6 |
| Extreme Pressure Agent | 0 to 0.5 | 0 to 3 | 0 to 6 |
| Overbased Detergent | 0 to 1 | 0.5 to 6 | 0.01 to 2 |
| Antioxidant | 0 to 2 | 0 to 3 | 0 to 2 |
| Antiwear Agent | 0.5 to 3 | 0.5 to 3 | 0.01 to 3 |
| Friction modifiers | 0 to 5 | 0.1 to 1.5 | 0 to 5 |
| Viscosity Modifier | 0.1 to 15 | 1 to 60 | 0.1 to 70 |
| Any other performance additive | 0 to 10 | 0 to 6 | 0 to 10 |
| Oil of lubricating viscosity | Balance to 100% | Balance to 100% | Balance to 100% |

The phos-amine salt may also be used in industrial lubricant compositions, such as greases, metal working fluids, industrial gear lubricants, hydraulics oils, turbine oils, circulation oils, or refrigerants. Such lubricant compositions are well known in the art.

Metal Working Fluid

In one embodiment the lubricant composition is a metal working fluid. Typical metal working fluid applications may include metal removal, metal forming, metal treating and metal protection. In some embodiments the metal working oil may be a Group I, Group II or Group III base stock as defined by the American Petroleum Institute. In some embodiments, the metal working oil may be mixed with Group IV or Group V base stock. In one embodiment the lubricant composition contains 0.01 wt % to 15 wt %, or 0.5 wt % to 10 wt % or 1 to 8 wt %, of the phos-amines salts described herein.

In some embodiments the functional fluid compositions include an oil. The oil may include most liquid hydrocarbons, for example, paraffinic, olefinic, naphthenic, aromatic, saturated or unsaturated hydrocarbons. In general, the oil is a water-immiscible, emulsifiable hydrocarbon, and in some embodiments the oil is liquid at room temperature. Oils from a variety of sources, including natural and synthetic oils and mixtures thereof may be used.

Natural oils include animal oils and vegetable oils (e.g., soybean oil, lard oil) as well as solvent-refined or acid-refined mineral oils of the paraffinic, naphthenic, or mixed paraffin-naphthenic types. Oils derived from coal or shale are also useful. Synthetic oils include hydrocarbon oils and halo-substituted hydrocarbon oils such as polymerized and interpolymerized olefins e.g., polybutylenes, polypropylenes, propylene-isobutylene copolymers, chlorinated polybutylenes; alkyl benzenes e.g., dodecylbenzenes, tetradecylbenzenes, dinonylbenzenes, or di-(2-ethylhexyl) benzenes.

Another suitable class of synthetic oils that may be used comprises the esters of dicarboxylic acids (e.g., phthalic acid, succinic acid, alkyl succinic acid, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, pentaerythritol, etc.). Specific examples of these esters include dibutyl adipate, di(2-ethylhexyl)-sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, or a complex ester formed by reacting one mole of sebacic acid with two moles of tetraethylene glycol and two moles of 2-ethyl-hexanoic acid.

Esters useful as synthetic oils also include those made from $C_5$ to $C_{12}$ monocarboxylic acids and polyols and polyol ethers such as neopentyl glycol, trimethylol propane, pentaerythritol, dipentaerythritol, tripentaerythritol, etc.

Unrefined, refined and rerefined oils (and mixtures of each with each other) of the type disclosed hereinabove may be used. Unrefined oils are those obtained directly from a natural or synthetic source without further purification treatment. For example, a shale oil obtained directly from a retorting operation, a petroleum oil obtained directly from distillation or ester oil obtained directly from an esterification process and used without further treatment would be an unrefined oil. Refined oils are similar to the unrefined oils except that they have been further treated in one or more purification steps to improve one or more properties. Many such purification techniques are known to those of skill in the art such as solvent extraction, distillation, acid or base extraction, filtration, percolation, etc. Re-refined oils are obtained by processes similar to those used to obtain refined oils applied to refined oils which have been already used in service. Such re-refined oils are also known as reclaimed or reprocessed oils and often are additionally processed by techniques directed toward removal of spent additives and oil breakdown products.

In some embodiments the oil is a Group II or Group III base stock as defined by the American Petroleum Institute. Optional additional materials may be incorporated in the compositions of the present invention. Typical finished compositions may include lubricity agents such as fatty acids and waxes, anti-wear agents, dispersants, corrosion inhibitors, normal and overbased detergents, demulsifiers, biocidal agents, metal deactivators, or mixtures thereof.

The invention may provide lubricant compositions that include the compound described above as an additive, which may be used in combination with one or more additional additives, and which may optionally also include a solvent or diluent, for example one or more of the oils described above. This composition may be referred to as an additive package or a surfactant package.

Example waxes include petroleum, synthetic, and natural waxes, oxidized waxes, microcrystalline waxes, wool grease (lanolin) and other waxy esters, and mixtures thereof. Petroleum waxes are paraffinic compounds isolated from crude oil via some refining process, such as slack wax and paraffin wax. Synthetic waxes are waxes derived from petrochemicals, such as ethylene or propylene. Synthetic waxes include polyethylene, polypropylene, and ethylene-propylene copolymers. Natural waxes are waxes produced by plants and/or animals or insects. These waxes include beeswax, soy wax and carnauba wax. Insect and animal waxes include beeswax, or spermaceti. Petrolatum and oxidized petrolatum may also be used in these compositions. Petrolatums and oxidized petrolatums may be defined, respectively, as purified mixtures of semisolid hydrocarbons derived from petroleum and their oxidation products. Microcrystalline waxes may be defined as higher melting point waxes purified from petrolatums. The wax(es) may be present in the metal working composition at from 0.1 wt % to 75 wt %, e.g., 0.1 wt % to 50 wt %.

Fatty acids useful herein include monocarboxylic acids of 8 to 35 carbon atoms, and in one embodiment 16 to 24 carbon atoms. Examples of such monocarboxylic acids include unsaturated fatty acids, such as myristoleic acid, palmitoleic acid, sapienic acid, oleic acid, elaidic acid, vaccenic acid, linoleic acid, linoelaidic acid; α-linolenic acid; arachidonic acid; eicosapentaenoic acid; erucic acid, docosahexaenoic acid; and saturated fatty acids, such as caprylic acid; capric acid; lauric acid, myristic acid; palmitic acid; stearic acid, arachidic acid, behenic acid; lignoceric acid, cerotic acid, isostearic acid, gadoleic acid, tall oil fatty acids, or combinations thereof. These acids may be saturated, unsaturated, or have other functional groups, such as hydroxy groups, as in 12-hydroxy stearic acid, from the hydrocarbyl backbone. Other example carboxylic acids are described in U.S. Pat. No. 7,435,707. The fatty acid(s) may be present in the metal working composition at from 0.1 wt % to 50 wt %, or 0.1 wt % to 25 wt %, or 0.1 wt % to 10 wt %.

Examplary overbased detergents include overbased metal sulfonates, overbased metal phenates, overbased metal salicylates, overbased metal saliginates, overbased metal carboxylates, or overbased calcium sulfonate detergents. The overbased detergents contain metals such as Mg, Ba, Sr, Zn, Na, Ca, K, and mixtures thereof. Overbased detergents are metal salts or complexes characterized by a metal content in excess of that which would be present according to the stoichiometry of the metal and the particular acidic organic compound reacted with the metal, e.g., a sulfonic acid.

The term "metal ratio" is used herein to designate the ratio of the total chemical equivalents of the metal in the overbased material (e.g., a metal sulfonate or carboxylate) to the chemical equivalents of the metal in the product which would be expected to result in the reaction between the organic material to be overbased (e.g., sulfonic or carboxylic acid) and the metal-containing reactant used to form the detergent (e.g., calcium hydroxide, barium oxide, etc.) according to the chemical reactivity and stoichiometry of the two reactants. Thus, while in a normal calcium sulfonate, the metal ratio is one, in the overbased sulfonate, the metal ratio is 4.5. Examples of such detergents are described, for example, in U.S. Pat. Nos. 2,616,904; 2,695,910; 2,767,164; 2,767,209; 2,798,852; 2,959,551; 3,147,232; 3,274,135; 4,729,791; 5,484,542 and 8,022,021. The overbased detergents may be used alone or in combination. The overbased detergents may be present in the range from 0.1 wt % to 20%; such as at least 1 wt % or up to 10 wt % of the composition.

Exemplary surfactants include nonionic polyoxyethylene surfactants such as ethoxylated alkyl phenols and ethoxylated aliphatic alcohols, polyethylene glycol esters of fatty, resin and tall oil acids and polyoxyethylene esters of fatty acids or anionic surfactants such as linear alkyl benzene sulfonates, alkyl sulfonates, alkyl ether phosphonates, ether sulfates, sulfosuccinates, and ether carboxylates. The surfactants(s) may be present in the metal working composition at from 0.0001 wt % to 10 wt %, or 0.0001 wt % to 2.5 wt %.

Demulsifiers useful herein include polyethylene glycol, polyethylene oxides, polypropylene alcohol oxides (ethylene oxide-propylene oxide) polymers, polyoxyalkylene alcohol, alkyl amines, amino alcohol, diamines or polyamines reacted sequentially with ethylene oxide or substituted ethylene oxide mixtures, trialkyl phosphates, and combinations thereof. The demulsifier(s) may be present in the corrosion-inhibiting composition at from 0.0001 wt % to 10 wt %, e.g., 0.0001 wt % to 2.5 wt %

The lubricant composition may also include corrosion inhibitors which may be used include thiazoles, triazoles and thiadiazoles. Examples include benzotriazole, tolyltriazole, octyltriazole, decyltriazole, dodecyltriazole, 2-mercaptobenzothiazole, 2,5-dimercapto-1,3,4-thiadiazole, 2-mercapto-5-hydrocarbylthio-1,3,4-thiadiazoles, 2-mercapto-5-hydrocarbyldithio-1,3,4-thiadiazoles, 2,5-bis(hydrocarbylthio)-1,3,4-thiadiazoles, and 2,5-bis-(hydrocarbyldithio)-1,3,4-thiadiazoles. Other suitable inhibitors of corrosion include ether amines; polyethoxylated compounds such as ethoxylated amines, ethoxylated phenols, and ethoxylated alcohols; imidazolines. Other suitable corrosion inhibitors include alkenylsuccinic acids in which the alkenyl group contains 10 or more carbon atoms such as, for example, tetrapropenylsuccinic acid, tetradecenylsuccinic acid, hexadecenylsuccinic acid; long-chain alpha, omega-dicarboxylic acids in the molecular weight range of 600 to 3000; and other similar materials. Other non-limiting examples of such inhibitors may be found in U.S. Pat. Nos. 3,873,465, 3,932,303, 4,066,398, 4,402,907, 4,971,724, 5,055,230, 5,275,744, 5,531,934, 5,611,991, 5,616,544, 5,744,069, 5,750,070, 5,779,938, and 5,785,896; Corrosion Inhibitors, C. C. Nathan, ed., NACE, 1973; I. L. Rozenfeld, Corrosion Inhibitors, McGraw-Hill, 1981; Metals Handbook, 9$^{th}$ Ed., Vol. 13—Corrosion, pp. 478497; Corrosion Inhibitors for Corrosion Control, B. G. Clubley, ed., The Royal Society of Chemistry, 1990; Corrosion Inhibitors, European Federation of Corrosion Publications Number 11, The Institute of Materials, 1994; Corrosion, Vol. 2—Corrosion Control, L. L. Sheir, R. A. Jarman, and G. T. Burstein, eds., Butterworth-Heinemann, 1994, pp. 17:10-17:39; Y. I. Kuznetsov, Organic Inhibitors of Corrosion of Metals, Plenum, 1996; and in V. S. Sastri, Corrosion Inhibitors: Principles and Applications, Wiley, 1998. The corrosion inhibitor(s) may be present in the metal-working composition at from 0.0001 wt % to 5 wt %, e.g., 0.0001 wt % to 3 wt %.

Dispersants which may be included in the composition include those with an oil soluble polymeric hydrocarbon backbone and having functional groups that are capable of associating with particles to be dispersed. The polymeric hydrocarbon backbone may have a weight average molecular weight ranging from 750 to 1500 Daltons. Exemplary functional groups include amines, alcohols, amides, and ester polar moieties which are attached to the polymer backbone, often via a bridging group. Example dispersants include Mannich dispersants, described in U.S. Pat. Nos. 3,697,574 and 3,736,357; ashless succinimide dispersants described in U.S. Pat. Nos. 4,234,435 and 4,636,322; amine dispersants described in U.S. Pat. Nos. 3,219,666, 3,565,804, and 5,633,326; Koch dispersants, described in U.S. Pat. Nos. 5,936,041, 5,643,859, and 5,627,259, and polyalkylene succinimide dispersants, described in U.S. Pat. Nos. 5,851,965, 5,853,434, and 5,792,729. The dispersant(s) may be present in the metal-working composition at from 0.0001 wt % to 10 wt %, e.g., 0.0005 wt % to 2.5 wt %.

In one embodiment the metal working composition disclosed herein may contain at least one additional friction modifier other than the compound of the present invention. The additional friction modifier may be present at 0 wt % to 6 wt %, or 0.01 wt % to 4 wt %, or 0.05 wt % to 2 wt %, or 0.1 wt % to 2 wt % of the metal-working composition.

As used herein the term "fatty alkyl" or "fatty" in relation to friction modifiers means a carbon chain having 10 to 22 carbon atoms, typically a straight carbon chain. Alternatively, the fatty alkyl may be a mono branched alkyl group, with branching typically at the β-position. Examples of mono branched alkyl groups include 2-ethylhexyl, 2-propylheptyl or 2-octyldodecyl.

Examples of suitable friction modifiers include long chain fatty acid derivatives of amines, fatty esters, or fatty epoxides; fatty imidazolines such as condensation products of carboxylic acids and polyalkylene-polyamines; amine salts of alkylphosphoric acids; fatty phosphonates; fatty phosphites; borated phospholipids, borated fatty epoxides; glycerol esters; borated glycerol esters; fatty amines; alkoxylated fatty amines; borated alkoxylated fatty amines; hydroxyl and polyhydroxy fatty amines including tertiary hydroxy fatty amines; hydroxy alkyl amides; metal salts of fatty acids; metal salts of alkyl salicylates; fatty oxazolines; fatty ethoxylated alcohols; condensation products of carboxylic acids and polyalkylene polyamines; or reaction products from fatty carboxylic acids with guanidine, aminoguanidine, urea, or thiourea and salts thereof.

Friction modifiers may also encompass materials such as sulphurised fatty compounds and olefins, molybdenum dialkyldithiophosphates, molybdenum dithiocarbamates, or other oil soluble molybdenum complexes such as Molyvan® 855 (commercially available from R.T. Vanderbilt, Inc) or Sakuralube® S-700 or Sakuralube® S-710 (commercially available from Adeka, Inc). The oil soluble molybdenum complexes assist in lowering the friction, but may compromise seal compatibility.

In one embodiment the friction modifier may be an oil soluble molybdenum complex. The oil soluble molybdenum complex may include molybdenum dithiocarbamate, molybdenum dithiophosphate, molybdenum blue oxide complex or other oil soluble molybdenum complex or mixtures thereof. The oil soluble molybdenum complex may be a mix of molybdenum oxide and hydroxide, so called "blue" oxide. The molybdenum blue oxides have the molybdenum in a mean oxidation state of between 5 and 6 and are mixtures of $MoO_2(OH)$ to $MoO_{2.5}(OH)_{0.5}$. An example of the oil soluble is molybdenum blue oxide complex known by the tradename of Luvodor® MB or Luvador® MBO (commercially available from Lehmann and Voss GmbH), The oil soluble molybdenum complexes may be present at 0 wt % to 5 wt %, or 0.1 wt % to 5 wt % or 1 to 3 wt % of the metal-working composition.

In one embodiment the friction modifier may be a long chain fatty acid ester. In another embodiment the long chain fatty acid ester may be a mono-ester and in another embodiment the long chain fatty acid ester may be a triglyceride such as sunflower oil or soybean oil or the monoester of a polyol and an aliphatic carboxylic acid.

The extreme pressure agent may be a compound containing sulphur and/or phosphorus and/or chlorine. Examples of an extreme pressure agents include a polysulphide, a sulphurised olefin, a thiadiazole, chlorinated paraffins, overbased sulphonates or mixtures thereof.

Examples of a thiadiazole include 2,5-dimercapto-1,3,4-thiadiazole, or oligomers thereof, a hydrocarbyl-substituted 2,5-dimercapto-1,3,4-thiadiazole, a hydrocarbylthio-substituted 2,5-dimercapto-1,3,4-thiadiazole, or oligomers thereof. The oligomers of hydrocarbyl-substituted 2,5-dimercapto-1,3,4-thiadiazole typically form by forming a sulphur-sulphur bond between 2,5-dimercapto-1,3,4-thiadiazole units to form oligomers of two or more of said thiadiazole units. Examples of a suitable thiadiazole compound include at least one of a dimercaptothiadiazole, 2,5-dimercapto-[1,3,4]-thiadiazole, 3,5-dimercapto-[1,2,4]-thiadiazole, 3,4-dimercapto-[1,2,5]-thiadiazole, or 4-5-dimercapto-[1,2,3]-thiadiazole. Typically readily available materials such as 2,5-dimercapto-1,3,4-thiadiazole or a hydrocarbyl-substituted 2,5-dimercapto-1,3,4-thiadiazole or a hydrocarbylthio-substituted 2,5-dimercapto-1,3,4-thiadiazole are commonly utilised. In different embodiments the number of carbon atoms on the hydrocarbyl-substituent group includes 1 to 30, 2 to 25, 4 to 20, 6 to 16, or 8 to 10. The 2,5-dimercapto-1,3,4-thiadiazole may be 2,5-dioctyl dithio-1,3,4-thiadiazole, or 2,5-dinonyl dithio-1,3,4-thiadiazole.

In one embodiment at least 50 wt % of the polysulphide molecules are a mixture of tri- or tetra-sulphides. In other embodiments at least 55 wt %, or at least 60 wt % of the polysulphide molecules are a mixture of tri- or tetra-sulphides. The polysulphide includes a sulphurised organic polysulphide from oils, fatty acids or ester, olefins or polyolefins.

Oils which may be sulphurized include natural or synthetic oils such as mineral oils, lard oil, carboxylate esters derived from aliphatic alcohols and fatty acids or aliphatic carboxylic acids (e.g., myristyl oleate and oleyl oleate), and synthetic unsaturated esters or glycerides.

Fatty acids include those that contain 8 to 30, or 12 to 24 carbon atoms. Examples of fatty acids include oleic, linoleic, linolenic, and tall oil. Sulphurised fatty acid esters prepared from mixed unsaturated fatty acid esters such as are obtained from animal fats and vegetable oils, including tall oil, linseed oil, soybean oil, rapeseed oil, and fish oil.

The polysulphide includes olefins derived from a wide range of alkenes. The alkenes typically have one or more double bonds. The olefins in one embodiment contain 3 to 30 carbon atoms. In other embodiments, olefins contain 3 to 16, or 3 to 9 carbon atoms. In one embodiment the sulphurised olefin includes an olefin derived from propylene, isobutylene, pentene or mixtures thereof. In one embodiment the polysulphide comprises a polyolefin derived from polymerising by known techniques an olefin as described above.

In one embodiment the polysulphide includes dibutyl tetrasulphide, sulphurised methyl ester of oleic acid, sulphurised alkylphenol, sulphurised dipentene, sulphurised dicyclopentadiene, sulphurised terpene, and sulphurised Diels-Alder adducts.

Chlorinated paraffins may include both long chain chlorinate paraffins ($C_{20+}$ and medium chain chlorinated paraffins ($C_{14}$-$C_{17}$). Examples include Choroflo, Paroil and Chlorowax products from Dover Chemical.

Overbased sulphonates have been discussed above. Examples of overbased sulfonates include Lubrizol® 5283C, Lubrizol® 5318A, Lubrizol® 5347LC and Lubrizol® 5358. The extreme pressure agent may be present at 0 wt % to 25 wt %, 1.0 wt % to 15.0 wt %, 2.0 wt % to 10.0 wt % of the metalworking composition.

The metal working fluid may have a composition defined in the following table:

| Metal Working Compositions | | | |
|---|---|---|---|
| | Embodiments (wt %) | | |
| Additive | Heavy Duty Oil | Flute Grinding | Hot Mill Oil for Steel Rolling |
| Phos-Amine Salt | 1-8 | 1-6 | 1-6 |
| Friction Modifier Agent | — | 1-5 | — |
| Extreme Pressure Agent | 0.1-15 | 0.1-5 | 1-15 |
| Phenolic or Aminic Antioxidant | 0-5 | 0-5 | 0-5 |

-continued

| Metal Working Compositions | | | |
|---|---|---|---|
| | Embodiments (wt %) | | |
| Additive | Heavy Duty Oil | Flute Grinding | Hot Mill Oil for Steel Rolling |
| Dispersant | 0-3 | 0-3 | 0-3 |
| Diluent Oil | Balance to 100% | Balance to 100% (blend of 2 oils) | Balance to 100% (blend of Grp II/III and Grp V oil) |

Specific examples of a metal working composition include those summarized in the following table:

| Metal Working Compositions | | | |
|---|---|---|---|
| | Embodiments (wt %) | | |
| Additive | Heavy Duty Oil | Flute Grinding | Hot Mill Oil for Steel Rolling |
| Phos-Amine Salt | 4 | 4 | 4 |
| Friction Modifier Agent | — | 2 | — |
| Extreme Pressure Agent | 7 | 2 | 7 |
| Phenolic or Aminic Antioxidant | 2 | 2 | 2 |
| Dispersant | 1 | 1 | 1 |
| Diluent Oil | Balance to 100% | Balance to 100% (blend of 2 oils) | Balance to 100% (blend of Grp II/III and Grp V oil) |

In order to demonstrate antiwear performance in a metalworking fluid the fluid may be evaluated versus control standards as to wear by four-ball (ASTM 4172) and friction by Microtap. ASTM D665 may be run to insure corrosion protection. ATSM 2272 may be used to determine to insure oxidative stability.

Rolling oils may be evaluated versus control standards as to wear by four-ball (ASTM 4172) and friction by Mini-Traction Machine. ASTM D665 may be used to measure corrosion protection. ASTM D943 may be run versus suitable controls to measure oxidative stability.

Grease

In one embodiment, lubricant may be used in a grease. The grease may have a composition comprising an oil of lubricating viscosity, a grease thickener, and 0.001 wt % to 15 wt % of a phos-amine salt as described above therein. In other embodiments, the phos-amine salt may be present in the lubricant at 0.01 wt % to 5 wt % or 0.002 to 2 wt %, based on a total weight of the lubricant composition.

In one embodiment, the grease may also be a sulphonate grease. Such greases are known in the art. In another embodiment, the sulphonate grease may be a calcium sulphonate grease prepared from overbasing a neutral calcium sulphonate to form amorphous calcium carbonate and subsequently converting it into either calcite, or vaterite or mixtures thereof.

The grease thickener may be any grease thickener known in the art. Suitable grease thickeners include, but are not limited to, metal salts of a carboxylic acid, metal soap grease thickeners, mixed alkali soaps, complex soaps, non-soap grease thickeners, metal salts of such acid-functionalized oils, polyurea and diurea grease thickeners, or calcium sulphonate grease thickeners. Other suitable grease thickeners include, polymer thickening agents, such as polytetrafluoroethylene, polystyrenes, and olefin polymers. Inorganic grease thickeners may also be used. Exemplary inorganic thickeners include clays, organo-clays, silicas, calcium carbonates, carbon black, pigments or copper phthalocyanine. Further thickeners include urea derivatives, such as polyuria or a diurea. Specific examples of a grease include those summarized in the following table:

Grease Additive Package Compositions*

| | Embodiments (wt %) | |
|---|---|---|
| Function/Component | Multi-functional | High Temp-Long Life |
| Phos-Amine Salt | 20-30 | 0.1 to 5.0 |
| Antioxidant | 10 to 20 | 25.0-60.0 |
| Dispersant | 0.50 to 5.0 | — |
| Metal Deactivator | 1.0 to 8.0 | — |
| Antiwear Agent | — | 5.0 to 15.0 |
| Extreme Pressure Agent | 45.0 to 65.0 | 0.1 to 10.0 |
| Rust inhibitor | 1.0 to 5.0 | 30.0 to 40.0 |
| Diluent Oil | Balance to 100% | Balance to 100% |

*The grease additive package is treated at 2 wt % to 5 wt % of a grease composition.

The grease thickening agent may include a metal salt of one or more carboxylic acids that is known in the art of grease formulation. Often the metal is an alkali metal, alkaline earth metal, aluminium or mixtures thereof. Examples of suitable metals include lithium, potassium, sodium, calcium, magnesium, barium, titanium, aluminium and mixtures thereof. The metal may include lithium, calcium, aluminium or mixtures thereof (typically lithium).

The carboxylic acid used in the thickener is often a fatty acid and includes a mono-hydroxycarboxylic acid, a di-hydroxycarboxylic acid, a poly-hydroxycarboxylic acid or mixtures thereof. The carboxylic acid may have 4 to 30, 8 to 27, 19 to 24 or 10 to 20 carbon atoms and includes derivatives thereof such as an ester, a half ester, salts, anhydrides or mixtures thereof. A particularly useful hydroxy-substituted fatty acid is hydroxy stearic acid, wherein one or more hydroxy groups are often located at positions 10-, 11-, 12-, 13- or 14- on the alkyl group. Suitable examples may include 10-hydroxystearic acid, 11-hydroxystearic acid, 12-hydroxystearic acid, 13-hydroxystearic acid, 14-hydroxystearic acid and mixtures thereof. In one embodiment the hydroxy-substituted fatty acid is 12-hydroxystearic acid. Examples of other suitable fatty acids include capric acid, palmitic acid, stearic acid, oleic acid, behenic acid and mixtures thereof.

In one embodiment the carboxylic acid thickener is supplemented with a di-carboxylic acid, a polycarboxylic acid, or mixtures thereof. Suitable examples include hexanedioic acid (adipic), iso-octanedioic acid, octanedioic acid, nonanedioic acid (azelaic acid), decanedioic acid (sebacic acid), undecanedioic acid, dodecanedioic acid, tridecanedioic acid, tetradecanedioic acid, pentadecanoic acid and mixtures thereof. The di-carboxylic acid and poly-carboxylic acid tend to be more expensive than mono-carboxylic acid and as a consequence, most industrial processes using mixtures typically use a molar ratio of dicarboxylic and/or polycarboxylic acid to monocarboxylic acid in the range 1:10, 1:5, 1:4, 1:3, 1:2 The actual ratio of acids used depends on the desired properties of the grease for the actual application. In one embodiment the dicarboxylic acid thickener is nonanedioic acid (azelaic acid) and in another decanedioic acid (sebacic acid), or mixtures thereof.

The grease thickener may include simple metal soap grease thickeners, mixed alkali soaps, complex soaps, non-soap grease thickeners, metal salts of such acid-functionalized oils, polyurea and diurea grease thickeners, calcium sulphonate grease thickeners or mixtures thereof.

The greases thickener may also include or be used with other known polymer thickening agents such polytetrafluoroethylene (commonly known as PTFE), styrenebutadiene rubber, styrene-isoprene, olefin polymers such as polyethylene or polypropylene or olefin co-polymers such as ethylene-propylene or mixtures thereof.

In one embodiment the thickener may also include or be used with other known thickening agents such as inorganic powders including clay, organo-clays, bentonite, montmorillonite, fumed and acid modified silicas, calcium carbonate as calcite, carbon black, pigments, copper phthalocyanine or mixtures thereof.

The grease may also be a sulphonate grease. Sulphonate greases are disclosed in more detail in U.S. Pat. No. 5,308,514. The calcium sulphonate grease may be prepared from overbasing the a neutral calcium sulphonate such that the calcium hydroxide is carbonated to form amorphous calcium carbonate and subsequently converted into either calcite, or vaterite or mixtures thereof, but typically calcite.

The grease thickener may be a urea derivative such as a polyurea or a diurea. Polyurea grease may include tri-urea, tetra-urea or higher homologues, or mixtures thereof. The urea derivatives may include urea-urethane compounds and the urethane compounds, diurea compounds, triurea compounds, tetraurea compounds, polyurea compounds, urea-urethane compounds, diurethane compounds and mixtures thereof. The urea derivative may for instance be a diurea compound such as, urea-urethane compounds, diurethane compounds or mixtures thereof. A more detailed description of urea compounds of this type is disclosed in U.S. Pat. No. 5,512,188 column 2, line 24 to column 23, line 36.

In one embodiment the grease thickener may be polyurea or diurea. The grease thickener is lithium soap or lithium complex thickener.

The amount of grease thickener present in the grease composition includes those in the range from 1 wt % to 50 wt %, or 1 wt % to 30 wt % of the grease composition.

The grease composition comprises an oil of lubricating viscosity as is described above.

A grease composition may be prepared by adding a the phos-amine salt described above to an oil of lubricating viscosity, a grease thickener, and optionally in the presence of other performance additives (as described herein below). The other performance additives may be present at 0 wt % to 10 wt %, or 0.01 wt % to 5 wt %, or 0.1 to 3 wt % of the grease composition.

The grease composition optionally comprises other performance additives. The other performance additives include at least one of metal deactivators, viscosity modifiers, detergents, friction modifiers, antiwear agents, corrosion inhibitors, dispersants, dispersant viscosity modifiers, extreme pressure agents, antioxidants, and mixtures thereof. Each of these other performance additives is described above.

In one embodiment the grease composition optionally further includes at least one other performance additive. The other performance additive compounds include a metal deactivator, a detergent, a dispersant, an antiwear agent, an antioxidant, a corrosion inhibitor (typically a rust inhibitor), or mixtures thereof. Typically, a fully-formulated grease composition will contain one or more of these performance additives. The grease composition may contain corrosion inhibitor or an antioxidant.

Antioxidants include diarylamine alkylated diarylamines, hindered phenols, dithiocarbamates, 1,2-dihydro-2,2,4-trimethylquinoline, hydroxyl thioethers, or mixtures thereof. In one embodiment the grease composition includes an antioxidant, or mixtures thereof. The antioxidant may be present at 0 wt % to 15 wt %, or 0.1 wt % to 10 wt %, or 0.5 wt % to 5 wt %, or 0.5 wt % to 3 wt %, or 0.3 wt % to 1.5 wt % of the grease composition.

The diarylamine alkylated diarylamine may be a phenyl-α-naphthylamine (PANA), an alkylated diphenylamine, or an alkylated phenylnapthylamine, or mixtures thereof. The alkylated diphenylamine may include di-nonylated diphenylamine, nonyl diphenylamine, octyl diphenylamine, di-octylated diphenylamine, or di-decylated diphenylamine. The alkylated diarylamine may include octyl, di-octyl, nonyl, di-nonyl, decyl or di-decyl phenylnapthylamines.

The hindered phenol antioxidant often contains a secondary butyl and/or a tertiary butyl group as a sterically hindering group. The phenol group may be further substituted with a hydrocarbyl group (typically linear or branched alkyl) and/or a bridging group linking to a second aromatic group. The bridging atom may be carbon or sulfur. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant may be an ester and may include, e.g., Irganox™ L-135 from Ciba. A more detailed description of suitable ester-containing hindered phenol antioxidant chemistry is found in U.S. Pat. No. 6,559,105.

The dithiocarbamate anti-oxidant may be metal containing such as molybdenum or zinc dithiocarbamate or it may be "ashless". Ashless refers to the dithiocarbamate as containing no metal and the linking group is typically a methylene group.

The 1,2-dihydro-2,2,4-trimethylquinoline may be present as a unique molecule or oligomerized with up to 5 repeat units and known commercially as "Resin D", available form a number of suppliers.

In one embodiment the grease composition further includes a viscosity modifier. The viscosity modifier is known in the art and may include hydrogenated styrene-butadiene rubbers, ethylene-propylene copolymers, polymethacrylates, polyacrylates, hydrogenated styrene-isoprene polymers, hydrogenated diene polymers, polyalkyl styrenes, polyolefins, esters of maleic anhydride-olefin copolymers (such as those described in International Application WO 2010/014655), esters of maleic anhydride-styrene copolymers, or mixtures thereof.

Some polymers may also be described as dispersant viscosity modifiers (often referred to as DVM) because they exhibit dispersant properties. Polymers of this type include olefins, for example, ethylene propylene copolymers that have been functionalized by reaction with maleic anhydride and an amine. Another type of polymer that may be used is polymethacrylate functionalized with an amine (this type may also be made by incorporating a nitrogen containing co-monomer in a methacrylate polymerization). More detailed description of dispersant viscosity modifiers are disclosed in International Publication WO2006/015130 or U.S. Pat. Nos. 4,863,623; 6,107,257; 6,107,258; and 6,117,825.

The viscosity modifiers may be present at 0 wt % to 15 wt %, or 0 wt % to 10 wt %, or 0.05 wt % to 5 wt %, or 0.2 wt % to 2 wt % of the grease composition.

The grease composition may further include a dispersant, or mixtures thereof. The dispersant may be a succinimide dispersant, a Mannich dispersant, a succinamide dispersant, a polyolefin succinic acid ester, amide, or ester-amide, or mixtures thereof. In one embodiment the dispersant may be present as a single dispersant. In one embodiment the dispersant may be present as a mixture of two or three different dispersants, wherein at least one may be a succinimide dispersant.

The dispersant may be an N-substituted long chain alkenyl succinimide. An example of an N-substituted long chain alkenyl succinimide is polyisobutylene succinimide. Typically the polyisobutylene from which polyisobutylene succinic anhydride is derived has a number average molecular weight of 350 to 5000, or 550 to 3000 or 750 to 2500. Succinimide dispersants and their preparation are disclosed, for instance in U.S. Pat. Nos. 3,172,892, 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, Re 26,433, and 6,165,235, 7,238,650 and EP Patent Application 0 355 895 A.

The dispersants may also be post-treated by conventional methods by a reaction with any of a variety of agents. Among these are boron compounds (such as boric acid), urea, thiourea, dimercaptothiadiazoles, carbon disulphide, aldehydes, ketones, carboxylic acids such as terephthalic acid, hydrocarbon-substituted succinic anhydrides, maleic anhydride, nitriles, epoxides, and phosphorus compounds. In one embodiment the post-treated dispersant is borated. In one embodiment the post-treated dispersant is reacted with dimercaptothiadiazoles. In one embodiment the post-treated dispersant is reacted with phosphoric or phosphorous acid.

In one embodiment the invention provides a grease composition further comprising an overbased metal-containing detergent. The overbased metal-containing detergent may be a calcium or magnesium an overbased detergent.

The overbased metal-containing detergent may be chosen from non-sulphur containing phenates, sulphur containing phenates, sulphonates, salixarates, salicylates, and mixtures thereof, or borated equivalents thereof. The overbased metal-containing detergent may be may be chosen from non-sulphur containing phenates, sulphur containing phenates, sulphonates, and mixtures thereof. The overbased detergent may be borated with a borating agent such as boric acid such as a borated overbased calcium or magnesium sulphonate detergent, or mixtures thereof.

The overbased metal-containing detergent may be present at 0 wt % to 2 wt %, or 0.05 wt % to 1.5 wt %, or 0.1 wt % to 1 wt % of the grease composition.

The grease composition may further include a dispersant, or mixtures thereof as is described above. The dispersant may be a succinimide dispersant, a Mannich dispersant, a succinamide dispersant, a polyolefin succinic acid ester, amide, or ester-amide, or mixtures thereof.

In one embodiment the invention provides a grease composition further comprising a metal-containing detergent. The metal-containing detergent may be a calcium or magnesium detergent. The metal-containing detergent may also be an overbased detergent with total base number ranges from 30 to 500 mg KOH/g Equivalents.

The metal-containing detergent may be chosen from non-sulphur containing phenates, sulphur containing phenates, sulphonates, salixarates, salicylates, and mixtures thereof, or borated equivalents thereof. The metal-containing detergent may be may be chosen from non-sulphur containing phenates, sulphur containing phenates, sulphonates, and mixtures thereof. The detergent may be borated with a borating agent such as boric acid such as a borated overbased calcium or magnesium sulphonate detergent, or mixtures thereof. The detergent may be present at 0 wt % to 6 wt %, or 0.01 wt % to 4 wt %, or 0.05 wt % to 2 wt %, or 0.1 wt % to 2 wt % of the grease composition.

In one embodiment the grease disclosed herein may contain at least one additional friction modifier other than the salt of the present invention. The additional friction modifier may be present at 0 wt % to 6 wt %, or 0.01 wt % to 4 wt %, or 0.05 wt % to 2 wt %, or 0.1 wt % to 2 wt % of the grease composition.

As used herein the term "fatty alkyl" or "fatty" in relation to friction modifiers means a carbon chain having 10 to 22 carbon atoms, typically a straight carbon chain. Alternatively, the fatty alkyl may be a mono branched alkyl group, with branching typically at the β-position. Examples of mono branched alkyl groups include 2-ethylhexyl, 2-propylheptyl or 2-octyldodecyl.

Examples of suitable friction modifiers include long chain fatty acid derivatives of amines, fatty esters, or fatty epoxides; fatty imidazolines such as condensation products of carboxylic acids and polyalkylene-polyamines; amine salts of alkylphosphoric acids; fatty phosphonates; fatty phosphites; borated phospholipids, borated fatty epoxides; glycerol esters; borated glycerol esters; fatty amines; alkoxylated fatty amines; borated alkoxylated fatty amines; hydroxyl and polyhydroxy fatty amines including tertiary hydroxy fatty amines; hydroxy alkyl amides; metal salts of fatty acids; metal salts of alkyl salicylates; fatty oxazolines; fatty ethoxylated alcohols; condensation products of carboxylic acids and polyalkylene polyamines; or reaction products from fatty carboxylic acids with guanidine, aminoguanidine, urea, or thiourea and salts thereof.

Friction modifiers may also encompass materials such as sulphurised fatty compounds and olefins, sulfurized molybdenum dialkyldithiophosphates, sulfurized molybdenum dithiocarbamates, or other oil soluble molybdenum complexes such as Molyvan® 855 (commercially available from R.T. Vanderbilt, Inc) or Sakuralube® S-700 or Sakuralube® S-710 (commercially available from Adeka, Inc). The oil soluble molybdenum complexes assist in lowering the friction, but may compromise seal compatibility.

In one embodiment the friction modifier may be an oil soluble molybdenum complex. The oil soluble molybdenum complex may include sulfurized molybdenum dithiocarbamate, sulfurized molybdenum dithiophosphate, molybdenum blue oxide complex or other oil soluble molybdenum complex or mixtures thereof. The oil soluble molybdenum complex may be a mix of molybdenum oxide and hydroxide, so called "blue" oxide. The molybdenum blue oxides have the molybdenum in a mean oxidation state of between 5 and 6 and are mixtures of MoO2(OH) to MoO2.5(OH)0.5. An example of the oil soluble is molybdenum blue oxide complex known by the tradename of Luvodor® MB or Luvador® MBO (commercially available from Lehmann and Voss GmbH), The oil soluble molybdenum complexes may be present at 0 wt % to 5 wt %, or 0.1 wt % to 5 wt % or 1 to 3 wt % of the grease composition.

In one embodiment the friction modifier may be a long chain fatty acid ester. In another embodiment the long chain fatty acid ester may be a mono-ester and in another embodiment the long chain fatty acid ester may be a triglyceride such as sunflower oil or soybean oil or the monoester of a polyol and an aliphatic carboxylic acid.

The grease composition optionally further includes at least one antiwear agent (other than the salt of the invention) as is described above. Examples of suitable antiwear agents include titanium compounds, oil soluble amine salts of phosphorus compounds, sulphurised olefins, metal dihydrocarbyldithiophosphates (such as zinc dialkyldithiophosphates), phosphites (such as dibutyl or dioleyl phosphite), phosphonates, thiocarbamate-containing compounds, such as thiocarbamate esters, thiocarbamate amides, thiocarbamic ethers, alkylene-coupled thiocarbamates, bis(S-alkyldithiocarb amyl) disulphides, and oil soluble phosphorus amine salts. In one embodiment the grease composition may further include metal dihydrocarbyldithiophosphates (such as zinc dialkyldithiophosphates). The anti-wear may be present at 0 wt % to 5 wt %, or 0.1 wt % to 5 wt % or 1 to 3 wt % of the grease composition.

The extreme pressure agent may be a compound containing sulphur and/or phosphorus. Examples of an extreme pressure agents include a polysulphide, a sulphurised olefin, a thiadiazole, or mixtures thereof.

Examples of a thiadiazole include 2,5-dimercapto-1,3,4-thiadiazole, or oligomers thereof, a hydrocarbyl-substituted 2,5-dimercapto-1,3,4-thiadiazole, a hydrocarbylthio-substituted 2,5-dimercapto-1,3,4-thiadiazole, or oligomers thereof. The oligomers of hydrocarbyl-substituted 2,5-dimercapto-1,3,4-thiadiazole typically form by forming a sulphur-sulphur bond between 2,5-dimercapto-1,3,4-thiadiazole units to form oligomers of two or more of said thiadiazole units. Examples of a suitable thiadiazole compound include at least one of a dimercaptothiadiazole, 2,5-dimercapto-[1,3,4]-thiadiazole, 3,5-dimercapto-[1,2,4]-thiadiazole, 3,4-dimercapto-[1,2,5]-thiadiazole, or 4-5-dimercapto-[1,2,3]-thiadiazole. Typically readily available materials such as 2,5-dimercapto-1,3,4-thiadiazole or a hydrocarbyl-substituted 2,5-dimercapto-1,3,4-thiadiazole or a hydrocarbylthio-substituted 2,5-dimercapto-1,3,4-thiadiazole are commonly utilised. In different embodiments the number of carbon atoms on the hydrocarbyl-substituent group includes 1 to 30, 2 to 25, 4 to 20, 6 to 16, or 8 to 10. The 2,5-dimercapto-1,3,4-thiadiazole may be 2,5-dioctyl dithio-1,3,4-thiadiazole, or 2,5-dinonyl dithio-1,3,4-thiadiazole.

In one embodiment at least 50 wt % of the polysulphide molecules are a mixture of tri- or tetra-sulphides. In other embodiments at least 55 wt %, or at least 60 wt % of the polysulphide molecules are a mixture of tri- or tetra-sulphides.

The polysulphide includes a sulphurised organic polysulphide from oils, fatty acids or ester, olefins or polyolefins.

Oils which may be sulphurized include natural or synthetic oils such as mineral oils, lard oil, carboxylate esters derived from aliphatic alcohols and fatty acids or aliphatic carboxylic acids (e.g., myristyl oleate and oleyl oleate), and synthetic unsaturated esters or glycerides and synthetic sperm whale oil.

Fatty acids include those that contain 8 to 30, or 12 to 24 carbon atoms. Examples of fatty acids include oleic, linoleic, linolenic, and tall oil. Sulphurised fatty acid esters prepared from mixed unsaturated fatty acid esters such as are obtained from animal fats and vegetable oils, including tall oil, linseed oil, soybean oil, rapeseed oil, and fish oil.

The polysulphide includes olefins derived from a wide range of alkenes. The alkenes typically have one or more double bonds. The olefins in one embodiment contain 3 to 30 carbon atoms. In other embodiments, olefins contain 3 to 16, or 3 to 9 carbon atoms. In one embodiment the sulphurised olefin includes an olefin derived from propylene, isobutylene, pentene or mixtures thereof.

In one embodiment the polysulphide comprises a polyolefin derived from polymerising by known techniques an olefin as described above.

In one embodiment the polysulphide includes dibutyl tetrasulphide, sulphurised methyl ester of oleic acid, sulphurised alkylphenol, sulphurised dipentene, sulphurised dicyclopentadiene, sulphurised terpene, and sulphurised Diels-Alder adducts.

The extreme pressure agent may be present at 0 wt % to 5 wt %, 0.01 wt % to 4 wt %, 0.01 wt % to 3.5 wt %, 0.05 wt % to 3 wt %, and 0.1 wt % to 1.5 wt %, or 0.2 wt % to 1 wt % of the grease composition.

Solid additives in a particle or finely divided form may also be used at levels of 0% to 20% by weight. These include graphite, molybdenum disulfide, zinc oxide, boron nitride, or polytetrafluoroethylene. Mixtures of solid additives may also be used.

The metal deactivators may comprise one or more derivatives of benzotriatole, benzimidazole, 2-alkyldithiobenzimidazoles, 2-alkyldithiobenzothiazoles, 2-(N,N-dialkyldithiocarbamoyl)benzothiazoles, 2,5-bis(alkyldithio)-1,3,4-thiadiazoles, 2,5-bis(N,N-dialkyldithiocarbamoyl)-1,3,4-thiadiazoles, 2-alkyldithio-5-mercaptothiadiazoles or mixtures thereof. The metal deactivator may also be described as corrosion inhibitors.

The benzotriazole compounds may include hydrocarbyl substitutions at one or more of the following ring positions 1- or 2- or 4- or 5- or 6- or 7-benzotriazoles. The hydrocarbyl groups may contain from 1 to 30 carbons, and in one embodiment from 1 to 15 carbons, and in one embodiment from 1 to 7 carbons. The metal deactivator may comprise 5-methylbenzotriazole.

The metal deactivator may be present in the grease composition at a concentration in the range up to 5 wt %, or 0.0002 to 2 wt %, or 0.001 to 1 wt %.

The rust inhibitor may comprise one or more metal sulphonates such as calcium sulphonate or magnesium sulphonate, amine salts of carboxylic acids such as octylamine octanoate, condensation products of dodecenyl succinic acid or anhydride and a fatty acid such as oleic acid with a polyamine, e.g. a polyalkylene polyamine such as triethylenetetramine, or half esters of alkenyl succinic acids in which the alkenyl group contains from 8 to 24 carbon atoms with alcohols such as polyglycols.

The rust inhibitors may present in the grease composition at a concentration in the range up to 4 wt %, and in one embodiment in the range from 0.02 wt % to 2 wt %, and in one embodiment in the range from 0.05 wt % to 1 wt %.

The grease composition may comprise:

(a) 0.001 wt % to 10 wt % of a phos-amine salt;

(b) 1 wt % to 20 wt % of a grease thickener;

(c) 0 wt % to 5 wt % of an extreme pressure agent;

(d) 0 wt % to 10 wt % of other performance additives; and (e) balance of an oil of lubricating viscosity.

The grease composition may comprise (a) 0.002 wt % to 5.0 wt % of a phos-amine salt;

(b) 1 wt % to 20 wt % of a grease thickener;

(c) 0.2 wt % to 1 wt % of an extreme pressure agent;

(d) 0.1 wt % to 10 wt % of other performance additives; and (e) balance of an oil of lubricating viscosity.

The grease composition may also be:

Grease Additive Package Compositions*

| Additive | Embodiments (wt %) Multi-functional | High Temp-Long Life |
|---|---|---|
| Salt of the invention | 20-30 | 0.1 to 5.0 |
| Antioxidant | 10 to 20 | 25.0-60.0 |
| Dispersant | 0.50 to 5.0 | — |
| Metal Deactivator | 1.0 to 8.0 | — |
| Antiwear Agent | — | 5.0 to 15.0 |
| Extreme Pressure Agent | 45.0 to 65.0 | 0.1 to 10.0 |
| Rust inhibitor | 1.0 to 5.0 | 30.0 to 40.0 |
| Diluent Oil | Balance to 100% | Balance to 100% |

*The grease additive package is treated at 2 wt % to 5 wt % of a grease composition.

In order to demonstrate improved performance in a grease composition, the composition may be evaluated versus control standards as to ASTM D4172-94(2010): Standard Test Method for Wear Preventive Characteristics of Lubricating Fluid (Four-Ball Method), ASTM D4170-10: Standard Test Method for Fretting Wear Protection by Lubricating Greases, ASTM D5969-11e: Standard Test Method for Corrosion-Preventive Properties of Lubricating Greases in Presence of Dilute Synthetic Sea Water Environments and ASTM D6138-13: Standard Test Method for Determination of Corrosion-Preventive Properties of Lubricating Greases Under Dynamic Wet Conditions (Emcor Test).

Hydraulics Oil, Turbine Oil or Circulating Oil

In one embodiment the lubricant composition contains 0.001 wt % to 5 wt % or 0.002 wt % to 3 wt % or 0.005 to 1 wt % of the phos-amine salts described above.

The lubricant compositions may also contain one or more additional additives. In some embodiments the additional additives may include an antioxidant other than component b); an antiwear agent other than component c); a corrosion inhibitor, a rust inhibitor, a foam inhibitor, a dispersant, a demulsifier, a metal deactivator, a friction modifier, a detergent, an emulsifier, an extreme pressure agent, a pour point depressant, a viscosity modifier, or any combination thereof.

The lubricant may further comprise an antioxidant, or mixtures thereof. The antioxidant may be present at 0 wt % to 4.0 wt %, or 0.02 wt % to 3.0 wt %, or 0.03 wt % to 1.5 wt % of the lubricant.

The diarylamine or alkylated diarylamine may be a phenyl-α-naphthylamine (PANA), an alkylated diphenylamine, or an alkylated phenylnapthylamine, or mixtures thereof. The alkylated diphenylamine may include di-nonylated diphenylamine, nonyl diphenylamine, octyl diphenylamine, di-octylated diphenylamine, di-decylated diphenylamine, decyl diphenylamine, benzyl diphenylamine and mixtures thereof. In one embodiment the diphenylamine may include nonyl diphenylamine, dinonyl diphenylamine, octyl diphenylamine, dioctyl diphenylamine, or mixtures thereof. In one embodiment the alkylated diphenylamine may include nonyl diphenylamine, or dinonyl diphenylamine. The alkylated diarylamine may include octyl, di-octyl, nonyl, di-nonyl, decyl or di-decyl phenylnapthylamines. In one embodiment, the diphenylamine is alkylated with styrene and 2-methyl-2-propene.

The hindered phenol antioxidant often contains a secondary butyl and/or a tertiary butyl group as a sterically hindering group. The phenol group may be further substituted with a hydrocarbyl group (typically linear or branched alkyl) and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant may be an ester and may include, e.g., Irganox™ L-135 from Ciba. A more detailed description of suitable ester-containing hindered phenol antioxidant chemistry is found in U.S. Pat. No. 6,559,105.

Examples of molybdenum dithiocarbamates, which may be used as an antioxidants, include commercial materials sold under the trade names such as Molyvan 822®, Molyvan® A, Molyvan® 855 and from R. T. Vanderbilt Co., Ltd., and Adeka Sakura-Lube™ S-100, S-165, S-600 and 525, or mixtures thereof. An example of a dithiocarbamate which may be used as an antioxidant or antiwear agent is Vanlube® 7723 from R. T. Vanderbilt Co., Ltd.

The antioxidant may include a substituted hydrocarbyl mono-sulfide represented by the formula:

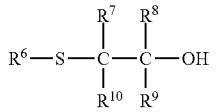

wherein $R^6$ may be a saturated or unsaturated branched or linear alkyl group with 8 to 20 carbon atoms; $R^7$, $R^8$, $R^9$ and $R^{10}$ are independently hydrogen or alkyl containing 1 to 3 carbon atoms. In some embodiments the substituted hydrocarbyl monosulfides include n-dodecyl-2-hydroxyethyl sulfide, 1-(tert-dodecylthio)-2-propanol, or combinations thereof. In some embodiments the substituted hydrocarbyl monosulfide is 1-(tert-dodecylthio)-2-propanol.

The lubricant compositions may also include a dispersant or mixtures thereof. Suitable dispersants include: (i) polyetheramines; (ii) borated succinimide dispersants; (iii) non-borated succinimide dispersants; (iv) Mannich reaction products of a dialkylamine, an aldehyde and a hydrocarbyl substituted phenol; or any combination thereof. In some embodiments the dispersant may be present at 0 wt % to 1.5 wt 5, or 0.01 wt % to 1 wt %, or 0.05 to 0.5 wt % of the overall composition.

Dispersants which may be included in the composition include those with an oil soluble polymeric hydrocarbon backbone and having functional groups that are capable of associating with particles to be dispersed. The polymeric hydrocarbon backbone may have a weight average molecular weight ranging from 750 to 1500 Daltons. Exemplary functional groups include amines, alcohols, amides, and ester polar moieties which are attached to the polymer backbone, often via a bridging group. Example dispersants include Mannich dispersants, described in U.S. Pat. Nos. 3,697,574 and 3,736,357; ashless succinimide dispersants described in U.S. Pat. Nos. 4,234,435 and 4,636,322; amine dispersants described in U.S. Pat. Nos. 3,219,666, 3,565,804, and 5,633,326; Koch dispersants, described in U.S. Pat. Nos. 5,936,041, 5,643,859, and 5,627,259, and polyalkylene succinimide dispersants, described in U.S. Pat. Nos. 5,851,965, 5,853,434, and 5,792,729.

Antifoams, also known as foam inhibitors, are known in the art and include organic silicones and non-silicon foam inhibitors. Examples of organic silicones include dimethyl silicone and polysiloxanes. Examples of non-silicon foam inhibitors include copolymers of ethyl acrylate and 2-ethylhexylacrylate, copolymers of ethyl acrylate, 2-ethylhexylacrylate and vinyl acetate, polyethers, polyacrylates and mixtures thereof. In some embodiments the antifoam is a polyacrylate. Antifoams may be present in the composition from 0.001 wt % to 0.012 wt % or 0.004 wt % or even 0.001 wt % to 0.003 wt %.

Demulsifiers are known in the art and include derivatives of propylene oxide, ethylene oxide, polyoxyalkylene alcohols, alkyl amines, amino alcohols, diamines or polyamines reacted sequentially with ethylene oxide or substituted ethylene oxides or mixtures thereof. Examples of demulsifiers include polyethylene glycols, polyethylene oxides, polypropylene oxides, (ethylene oxide-propylene oxide) polymers and mixtures thereof. In some embodiments the demulsifiers is a polyether. Demulsifiers may be present in the composition from 0.002 wt % to 0.012 wt %.

Pour point depressants are known in the art and include esters of maleic anhydride-styrene copolymers, polymethacrylates; polyacrylates; polyacrylamides; condensation products of haloparaffin waxes and aromatic compounds; vinyl carboxylate polymers; and terpolymers of dialkyl fumarates, vinyl esters of fatty acids, ethylene-vinyl acetate copolymers, alkyl phenol formaldehyde condensation resins, alkyl vinyl ethers and mixtures thereof.

The lubricant compositions may also include a rust inhibitor. Suitable rust inhibitors include hydrocarbyl amine salts of alkylphosphoric acid, hydrocarbyl amine salts of dialkyldithiophosphoric acid, hydrocarbyl amine salts of hydrocarbyl aryl sulphonic acid, fatty carboxylic acids or esters thereof, an ester of a nitrogen-containing carboxylic acid, an ammonium sulfonate, an imidazoline, alkylated succinic acid derivatives reacted with alcohols or ethers, or any combination thereof; or mixtures thereof.

Suitable hydrocarbyl amine salts of alkylphosphoric acid may be represented by the following formula:

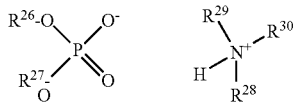

wherein $R^{26}$ and $R^{27}$ are independently hydrogen, alkyl chains or hydrocarbyl, typically at least one of $R^{26}$ and $R^{27}$ are hydrocarbyl. $R^{26}$ and $R^{27}$ contain 4 to 30, or 8 to 25, or 10 to 20, or 13 to 19 carbon atoms. $R^{28}$, $R^{29}$ and $R^{30}$ are independently hydrogen, alkyl branched or linear alkyl chains with 1 to 30, or 4 to 24, or 6 to 20, or 10 to 16 carbon atoms. $R^{28}$, $R^{29}$ and $R^{30}$ are independently hydrogen, alkyl branched or linear alkyl chains, or at least one, or two of $R^{28}$, $R^{29}$ and $R^{30}$ are hydrogen.

Examples of alkyl groups suitable for $R^{28}$, $R^{29}$ and $R^{30}$ include butyl, sec butyl, isobutyl, tert-butyl, pentyl, n-hexyl, sec hexyl, n-octyl, 2-ethyl, hexyl, decyl, undecyl, dodecyl, tridecyl, tetradecyl, pentadecyl, hexadecyl, heptadecyl, octadecyl, octadecenyl, nonadecyl, eicosyl or mixtures thereof.

In one embodiment the hydrocarbyl amine salt of an alkylphosphoric acid is the reaction product of a $C_{14}$ to $C_{18}$ alkylated phosphoric acid with Primene 81R (produced and sold by Rohm & Haas) which is a mixture of $C_{11}$ to $C_{14}$ tertiary alkyl primary amines.

Hydrocarbyl amine salts of dialkyldithiophosphoric acid may include a rust inhibitor such as a hydrocarbyl amine salt of dialkyldithiophosphoric acid. These may be a reaction product of heptyl or octyl or nonyl dithiophosphoric acids with ethylene diamine, morpholine or Primene 81R or mixtures thereof.

The hydrocarbyl amine salts of hydrocarbyl aryl sulphonic acid may include ethylene diamine salt of dinonyl naphthalene sulphonic acid.

Examples of suitable fatty carboxylic acids or esters thereof include glycerol monooleate and oleic acid. An example of a suitable ester of a nitrogen-containing carboxylic acid includes oleyl sarcosine.

The rust inhibitors may be present in the range from 0.02 wt % to 0.2 wt %, from 0.03 wt % to 0.15 wt %, from 0.04 wt % to 0.12 wt %, or from 0.05 wt % to 0.1 wt % of the lubricating oil composition. The rust inhibitors may be used alone or in mixtures thereof.

The lubricant may contain a metal deactivator, or mixtures thereof. Metal deactivators may be chosen from a derivative of benzotriazole (typically tolyltriazole), 1,2,4-triazole, benzimidazole, 2-alkyldithiobenzimidazole or 2-alkyldithiobenzothiazole, 1-amino-2-propanol, a derivative of dimercaptothiadiazole, octylamine octanoate, condensation products of dodecenyl succinic acid or anhydride and/or a fatty acid such as oleic acid with a polyamine. The metal deactivators may also be described as corrosion inhibitors.

The metal deactivators may be present in the range from 0.001 wt % to 0.1 wt %, from 0.01 wt % to 0.04 wt % or from 0.015 wt % to 0.03 wt % of the lubricating oil composition. Metal deactivators may also be present in the composition from 0.002 wt % or 0.004 wt % to 0.02 wt %. The metal deactivator may be used alone or mixtures thereof.

In one embodiment the invention provides a lubricant composition further comprises a metal-containing detergent. The metal-containing detergent may be a calcium or magnesium detergent. The metal-containing detergent may also be an overbased detergent with total base number ranges from 30 to 500 mg KOH/g Equivalents.

The metal-containing detergent may be chosen from non-sulphur containing phenates, sulphur containing phenates, sulphonates, salixarates, salicylates, and mixtures thereof, or borated equivalents thereof. The metal-containing detergent may be may be chosen from non-sulphur containing phenates, sulphur containing phenates, sulphonates, and mixtures thereof. The detergent may be borated with a borating agent such as boric acid such as a borated overbased calcium or magnesium sulphonate detergent, or mixtures thereof. The detergent may be present at 0 wt % to 5 wt %, or 0.001 wt % to 1.5 wt %, or 0.005 wt % to 1 wt %, or 0.01 wt % to 0.5 wt % of the hydraulic composition.

The extreme pressure agent may be a compound containing sulphur and/or phosphorus. Examples of an extreme pressure agents include a polysulphide, a sulphurised olefin, a thiadiazole, or mixtures thereof.

Examples of a thiadiazole include 2,5-dimercapto-1,3,4-thiadiazole, or oligomers thereof, a hydrocarbyl-substituted 2,5-dimercapto-1,3,4-thiadiazole, a hydrocarbylthio-substituted 2,5-dimercapto-1,3,4-thiadiazole, or oligomers thereof. The oligomers of hydrocarbyl-substituted 2,5-dimercapto-1,3,4-thiadiazole typically form by forming a sulphur-sulphur bond between 2,5-dimercapto-1,3,4-thiadiazole units to form oligomers of two or more of said thiadiazole units. Examples of a suitable thiadiazole compound include at least one of a dimercaptothiadiazole, 2,5-dimercapto-[1,3,4]-thiadiazole, 3,5-dimercapto-[1,2,4]-thiadiazole, 3,4-dimercapto-[1,2,5]-thiadiazole, or 4-5-dimercapto-[1,2,3]-thiadiazole. Typically readily available materials such as 2,5-dimercapto-1,3,4-thiadiazole or a hydrocarbyl-substituted 2,5-dimercapto-1,3,4-thiadiazole or a hydrocarbylthio-substituted 2,5-dimercapto-1,3,4-thiadiazole are commonly utilised. In different embodiments the number of carbon atoms on the hydrocarbyl-substituent group includes 1 to 30, 2 to 25, 4 to 20, 6 to 16, or 8 to 10. The 2,5-dimercapto-1,3,4-thiadiazole may be 2,5-dioctyl dithio-1,3,4-thiadiazole, or 2,5-dinonyl dithio-1,3,4-thiadiazole.

The polysulphide includes a sulphurised organic polysulphide from oils, fatty acids or ester, olefins or polyolefins.

Oils which may be sulphurized include natural or synthetic oils such as mineral oils, lard oil, carboxylate esters derived from aliphatic alcohols and fatty acids or aliphatic carboxylic acids (e.g., myristyl oleate and oleyl oleate), and synthetic unsaturated esters or glycerides.

Fatty acids include those that contain 8 to 30, or 12 to 24 carbon atoms. Examples of fatty acids include oleic, linoleic, linolenic, and tall oil. Sulphurised fatty acid esters prepared from mixed unsaturated fatty acid esters such as are obtained from animal fats and vegetable oils, including tall oil, linseed oil, soybean oil, rapeseed oil, and fish oil.

The polysulphide includes olefins derived from a wide range of alkenes. The alkenes typically have one or more double bonds. The olefins in one embodiment contain 3 to 30 carbon atoms. In other embodiments, olefins contain 3 to 16, or 3 to 9 carbon atoms. In one embodiment the sulphurised olefin includes an olefin derived from propylene, isobutylene, pentene or mixtures thereof.

In one embodiment the polysulphide comprises a polyolefin derived from polymerising by known techniques an olefin as described above.

In one embodiment the polysulphide includes dibutyl tetrasulphide, sulphurised methyl ester of oleic acid, sulphurised alkylphenol, sulphurised dipentene, sulphurised di cyclopentadiene, sulphurised terpene, and sulphurised Diels-Alder adducts.

The extreme pressure agent may be present at 0 wt % to 3 wt %, 0.005 wt % to 2 wt %, 0.01 wt % to 1.0 wt % of the hydraulics composition.

The lubricant may further comprise a viscosity modifier, or mixtures thereof.

Viscosity modifiers (often referred to as viscosity index improvers) suitable for use in the invention include polymeric materials including a styrene-butadiene rubber, an olefin copolymer, a hydrogenated styrene-isoprene polymer, a hydrogenated radical isoprene polymer, a poly(meth) acrylic acid ester, a polyalkylstyrene, an hydrogenated alkenylaryl conjugated-diene copolymer, an ester of maleic anhydride-styrene copolymer or mixtures thereof. In some embodiments the viscosity modifier is a poly(meth)acrylic acid ester, an olefin copolymer or mixtures thereof. The viscosity modifiers may be present at 0 wt % to 10 wt %, 0.5 wt % to 8 wt %, 1 wt % to 6 wt % of the lubricant.

In one embodiment the lubricant disclosed herein may contain at least one additional friction modifier other than the salt of the present invention. The additional friction modifier may be present at 0 wt % to 3 wt %, or 0.02 wt % to 2 wt %, or 0.05 wt % to 1 wt %, of the hydraulic composition.

As used herein the term "fatty alkyl" or "fatty" in relation to friction modifiers means a carbon chain having 10 to 22 carbon atoms, typically a straight carbon chain. Alternatively, the fatty alkyl may be a mono branched alkyl group, with branching typically at the β-position. Examples of mono branched alkyl groups include 2-ethylhexyl, 2-propylheptyl or 2-octyldodecyl.

Examples of suitable friction modifiers include long chain fatty acid derivatives of amines, fatty esters, or fatty epoxides; fatty imidazolines such as condensation products of carboxylic acids and polyalkylene-polyamines; amine salts of alkylphosphoric acids; fatty phosphonates; fatty phosphites; borated phospholipids, borated fatty epoxides; glycerol esters; borated glycerol esters; fatty amines; alkoxylated fatty amines; borated alkoxylated fatty amines; hydroxyl and polyhydroxy fatty amines including tertiary hydroxy fatty amines; hydroxy alkyl amides; metal salts of fatty acids; metal salts of alkyl salicylates; fatty oxazolines; fatty ethoxylated alcohols; condensation products of carboxylic acids and polyalkylene polyamines; or reaction products from fatty carboxylic acids with guanidine, aminoguanidine, urea, or thiourea and salts thereof.

In one embodiment the lubricant composition further includes an additional antiwear agent. Typically the additional antiwear agent may be a phosphorus antiwear agent (other than the salt of the present invention), or mixtures thereof. The additional antiwear agent may be present at 0 wt % to 5 wt %, 0.001 wt % to 2 wt %, 0.1 wt % to 1.0 wt % of the lubricant.

The phosphorus antiwear agent may include a phosphorus amine salt, or mixtures thereof. The phosphorus amine salt includes an amine salt of a phosphorus acid ester or mixtures thereof. The amine salt of a phosphorus acid ester includes phosphoric acid esters and amine salts thereof; dialkyldithiophosphoric acid esters and amine salts thereof; phosphites; and amine salts of phosphorus-containing carboxylic esters, ethers, and amides; hydroxy substituted di or tri esters of phosphoric or thiophosphoric acid and amine salts thereof; phosphorylated hydroxy substituted di or tri esters of phosphoric or thiophosphoric acid and amine salts thereof; and mixtures thereof. The amine salt of a phosphorus acid ester may be used alone or in combination.

In one embodiment the oil soluble phosphorus amine salt includes partial amine salt-partial metal salt compounds or mixtures thereof. In one embodiment the phosphorus compound further includes a sulphur atom in the molecule.

Examples of the antiwear agent may include a non-ionic phosphorus compound (typically compounds having phosphorus atoms with an oxidation state of +3 or +5). In one embodiment the amine salt of the phosphorus compound may be ashless, i.e., metal-free (prior to being mixed with other components).

The amines which may be suitable for use as the amine salt include primary amines, secondary amines, tertiary amines, and mixtures thereof. The amines include those with at least one hydrocarbyl group, or, in certain embodiments, two or three hydrocarbyl groups. The hydrocarbyl groups may contain 2 to 30 carbon atoms, or in other embodiments 8 to 26, or 10 to 20, or 13 to 19 carbon atoms.

Primary amines include ethyl amine, propylamine, butyl amine, 2-ethylhexylamine, octylamine, and dodecylamine, as well as such fatty amines as n-octylamine, n-decylamine, n-dodecyl amine, n-tetradecylamine, n-hexadecylamine, n-octadecylamine and oleyamine. Other useful fatty amines include commercially available fatty amines such as "Armeen®" amines (products available from Akzo Chemicals, Chicago, Ill.), such as Armeen C, Armeen O, Armeen OL, Armeen T, Armeen HT, Armeen S and Armeen SD, wherein the letter designation relates to the fatty group, such as coco, oleyl, tallow, or stearyl groups.

Examples of suitable secondary amines include dimethylamine, diethylamine, dipropylamine, dibutylamine, diamylamine, dihexylamine, diheptylamine, methylethylamine, ethylbutylamine and ethylamylamine. The secondary amines may be cyclic amines such as piperidine, piperazine and morpholine.

The amine may also be a tertiary-aliphatic primary amine. The aliphatic group in this case may be an alkyl group containing 2 to 30, or 6 to 26, or 8 to 24 carbon atoms. Tertiary alkyl amines include monoamines such as tert-butylamine, tert-hexylamine, 1-methyl-1-amino-cyclohexane, tert-octylamine, tert-decylamine, tertdodecylamine, tert-tetradecylamine, tert-hexadecylamine, tert-octadecylamine, tert-tetracosanylamine, and tert-octacosanylamine.

In one embodiment the phosphorus acid amine salt includes an amine with C11 to C14 tertiary alkyl primary groups or mixtures thereof. In one embodiment the phosphorus acid amine salt includes an amine with C14 to C18 tertiary alkyl primary amines or mixtures thereof. In one embodiment the phosphorus acid amine salt includes an amine with C18 to C22 tertiary alkyl primary amines or mixtures thereof. Mixtures of amines may also be used. In one embodiment a useful mixture of amines is "Primene® 81R" and "Primene® JMT." Primene® 81R and Primene® JMT (both produced and sold by Rohm & Haas) are mixtures of C11 to C14 tertiary alkyl primary amines and C18 to C22 tertiary alkyl primary amines respectively.

In one embodiment oil soluble amine salts of phosphorus compounds include a sulphur-free amine salt of a phosphorus-containing compound may be obtained/obtainable by a process comprising: reacting an amine with either (i) a hydroxy-substituted di-ester of phosphoric acid, or (ii) a phosphorylated hydroxy-substituted di- or tri-ester of phosphoric acid. A more detailed description of compounds of this type is disclosed in U.S. Pat. No. 8,361,941.

In one embodiment the hydrocarbyl amine salt of an alkylphosphoric acid ester is the reaction product of a C14 to C18 alkylated phosphoric acid with Primene 81R™ (produced and sold by Rohm & Haas) which is a mixture of C11 to C14 tertiary alkyl primary amines.

Examples of hydrocarbyl amine salts of dialkyldithiophosphoric acid esters include the reaction product(s) of isopropyl, methyl-amyl (4-methyl-2-pentyl or mixtures thereof), 2-ethylhexyl, heptyl, octyl or nonyl dithiophosphoric acids with ethylene diamine, morpholine, or Primene 81R™, and mixtures thereof.

In one embodiment the dithiophosphoric acid may be reacted with an epoxide or a glycol. This reaction product is further reacted with a phosphorus acid, anhydride, or lower ester. The epoxide includes an aliphatic epoxide or a styrene oxide. Examples of useful epoxides include ethylene oxide, propylene oxide, butene oxide, octene oxide, dodecene oxide, and styrene oxide. In one embodiment the epoxide may be propylene oxide. The glycols may be aliphatic glycols having from 1 to 12, or from 2 to 6, or 2 to 3 carbon atoms. The dithiophosphoric acids, glycols, epoxides, inorganic phosphorus reagents and methods of reacting the same are described in U.S. Pat. Nos. 3,197,405 and 3,544,465. The resulting acids may then be salted with amines. An example of suitable dithiophosphoric acid is prepared by adding phosphorus pentoxide (about 64 grams) at 58° C. over a period of 45 minutes to 514 grams of hydroxypropyl O,O-di(4-methyl-2-pentyl)phosphorodithioate (prepared by reacting di(4-methyl-2-pentyl)-phosphorodithioic acid with 1.3 moles of propylene oxide at 25° C.). The mixture may be heated at 75° C. for 2.5 hours, mixed with a diatomaceous earth and filtered at 70° C. The filtrate contains 11.8% by weight phosphorus, 15.2% by weight sulphur, and an acid number of 87 (bromophenol blue).

In one embodiment the antiwear additives may include a zinc dialkyldithiophosphate, In other embodiments the compositions of the present invention are substantially free of, or even completely free of zinc dialkyldithiophosphate.

In one embodiment the invention provides for a composition that includes a dithiocarbamate antiwear agent defined in U.S. Pat. No. 4,758,362 column 2, line 35 to column 6, line 11. When present the dithiocarbamate antiwear agent may be present from 0.25 wt %, 0.3 wt %, 0.4 wt % or even 0.5 wt % up to 0.75 wt %, 0.7 wt %, 0.6 wt % or even 0.55 wt % in the overall composition.

The hydraulic lubricant may comprise:

0.01 wt % to 3 wt % of a phos-amine salt, 0.0001 wt % to 0.15 wt % of a corrosion inhibitor chosen from 2,5-bis(tert-dodecyldithio)-1,3,4-thiadiazole, tolyltriazole, or mixtures thereof, an oil of lubricating viscosity, 0.02 wt % to 3 wt % of antioxidant chosen from aminic or phenolic antioxidants, or mixtures thereof, 0.005 wt % to 1.5 wt % of a borated succinimide or a non-borated succinimide, 0.001 wt % to 1.5 wt % of a neutral of slightly overbased calcium naphthalene sulphonate (typically a neutral or slightly overbased calcium dinonyl naphthalene sulphonate), and 0.001 wt % to 2 wt %, or 0.01 wt % to 1 wt % of an antiwear agent (other than the protic salt of the present invention) chosen from zinc dialkyldithiophosphate, zinc dialkylphosphate, amine salt of a phosphorus acid or ester, or mixtures thereof.

The hydraulic lubricant may also comprise a formulation defined in the following table:

Hydraulic Lubricant compositions

| | Embodiments (wt %) | | |
|---|---|---|---|
| Additive | A | B | C |
| Salt of the invention | 0.001 to 5.0 | 0.005 to 3.0 | 0.01 to 1.0 |
| Antioxidant | 0 to 4.0 | 0.02 to 3.0 | 0.03 to 1.5 |
| Dispersant | 0 to 2.0 | 0.005 to 1.5 | 0.01 to 1.0 |
| Detergent | 0 to 5.0 | 0.001 to 1.5 | 0.005 to 1.0 |
| Antiwear Agent | 0 to 5.0 | 0.001 to 2 | 0.1 to 1.0 |
| Friction Modifier | 0 to 3.0 | 0.02 to 2 | 0.05 to 1.0 |
| Viscosity Modifier | 0 to 10.0 | 0.5 to 8.0 | 1.0 to 6.0 |
| Any Other Performance Additive (antifoam/demulsifier/pour point depressant) | 0 to 1.3 | 0.00075 to 0.5 | 0.001 to 0.4 |
| Metal Deactivator | 0 to 0.1 | 0.01 to 0.04 | 0.015 to 0.03 |
| Rust Inhibitor | 0 to 0.2 | 0.03 to 0.15 | 0.04 to 0.12 |
| Extreme Pressure Agent | 0 to 3.0 | 0.005 to 2 | 0.01 to 1.0 |
| Oil of Lubricating Viscosity | Balance to 100% | Balance to 100% | Balance to 100% |

Specific examples of a hydraulic lubricant include those summarized in the following table:

Hydraulic Lubricant compositions*

| | Embodiments (wt %) | | |
|---|---|---|---|
| Additive | A | B | C |
| Salt of the invention | 0 | 0.25 | 0.5 |
| Antioxidant-aminic/phenolic | 0.4 | 0.4 | 0.4 |
| Calcium Sulphonate Detergent | 0.2 | 0.2 | 0.2 |
| Zinc dialkyl dithiophosphate | 0.3 | 0.15 | 0 |
| Any Other Performance Additive (antifoam/demulsifier/pour point depressant) | 0.01 | 0.01 | 0.01 |

-continued

Hydraulic Lubricant compositions*

| | Embodiments (wt %) | | |
|---|---|---|---|
| Additive | A | B | C |
| Triazole Metal Deactivator | 0.005 | 0.005 | 0.005 |
| Oil of Lubricating Viscosity | Balance to 100% | Balance to 100% | Balance to 100% |

Antiwear performance of each lubricant may be evaluated in accordance with ASTM D6973-08e1 Standard Test Method for Indicating Wear Characteristics of Petroleum Hydraulic Fluids in a High Pressure Constant Volume Vane Pump. Antiwear performance may also be evaluated utilizing a standard Falex Block-on-Ring wear and friction test machine. In this test, a standard test block is modified to accept a piece of actual 35VQ pump vain. The vane is in contact with a standard Falex ring in which a load is applied to the fixed vane and the ring rotates. The screen test runs at a similar load, sliding speed and oil temperature conditions as seen in standard 35VQ pump test. The mass of the test vane and ring are measured before and after the test. Performance is judge by the total amount of mass loss measured.

Refrigerant Lubricants

In one embodiment the lubricant disclosed herein may be a refrigeration lubricant or gas compressor lubricant. The working fluid can include a lubricant comprised of (i) one or more ester base oils, (ii) one or more mineral oil base oils, (iii) one or more polyalphaolefin (PAO) base oils, (iii) one more alkyl benzene base oils, (iv) one or more polyalkylene glycol (PAG) base oils, (iv) one or more alkylated naphthalene base oils, (v) one or more polyvinylether base oils or any combination thereof to form an oil of lubricating viscosity and 0.001 wt % to 15 wt % of the phos-amine salts described above. The lubricant may be a working fluid in a compressor used for refrigeration or gas compression. In one embodiment the working fluid may be for a low Global Warming Potential (low GWP) refrigerant system. The working fluid can include a lubricant comprised of ester base oils, mineral oil base oils, polyalphaolefin base oils, polyalkylene glycol base oils or polyvinyl ether base oils alone or in combination to form an oil of lubricating viscosity and 0.001 wt % to 15 wt % of a phos-amine salt and a refrigerant or gas to be compressed.

The ester based oil includes an ester of one or more branched or linear carboxylic acids from C4 to C13. The ester is generally formed by the reaction of the described branched carboxylic acid and one or more polyols.

In some embodiments, the branched carboxylic acid contains at least 5 carbon atoms. In some embodiments, the branched carboxylic acid contains from 4 to 9 carbon atoms. In some embodiments, the polyol used in the preparation of the ester includes neopentyl glycol, glycerol, trimethylol propane, pentaerythritol, dipentaerythritol, tripentaerythritol, or any combination thereof. In some embodiments, the polyol used in the preparation of the ester includes neopentyl glycol, pentaerythritol, dipentaerythritol, or any combination thereof. In some embodiments, the polyol used in the preparation of the ester includes neopentyl glycol. In some embodiments, the polyol used in the preparation of the ester includes pentaerythritol. In some embodiments, the polyol used in the preparation of the ester includes dipentaerythritol.

In some embodiments, the ester is derived from (i) an acid that includes 2-methylbutanoic acid, 3-methylbutanoic acid, or a combination thereof; and (ii) a polyol that includes neopentyl glycol, glycerol, trimethylol propane, pentaerythritol, dipentaerythritol, tripentaerythritol, or any combination thereof.

The lubricant may have the ability to provide an acceptable viscosity working fluid that has good miscibility.

By "acceptable viscosity" it is meant the ester based lubricant and/or the working fluid has a viscosity (as measured by ASTM D445 at 40 degrees C.) of more than 4 cSt. In some embodiments, the ester based lubricant and/or the working fluid has a viscosity at 40° C. from 5 or 32 up to 320, 220, 120, or even 68 cSt.

As noted by above, by "low GWP", it is meant the working fluid has a GWP value (as calculated per the Intergovernmental Panel on Climate Change's 2001 Third Assessment Report) of not greater than 1000, or a value that is less than 1000, less than 500, less than 150, less than 100, or even less than 75. In some embodiments, this GWP value is with regards to the overall working fluid. In other embodiments, this GWP value is with regards to the refrigerant present in the working fluid, where the resulting working fluid may be referred to as a low GWP working fluid.

By "good miscibility" it is meant that the refrigerant or compressed gas and lubricant are miscible, at least at the operating conditions the described working fluid will see during the operation of a refrigeration or gas compression system. In some embodiments, good miscibility may mean that the working fluid (and/or the combination of refrigerant and lubricant) does not show any signs of poor miscibility other than visual haziness at temperatures as low as 0° C., or even −25° C., or even in some embodiments as low as −50° C., or even −60° C.

In some embodiments, the described working fluid may further include one or more additional lubricant components. These additional lubricant components may include (i) one or more esters of one or more linear carboxylic acids, (ii) one or more polyalphaolefin (PAO) base oils, (iii) one more alkyl benzene base oils, (iv) one or more polyalkylene glycol (PAG) base oils, (iv) one or more alkylated naphthalene base oils, or (v) any combination thereof.

Additional lubricants that may be used in the described working fluids include certain silicone oils and mineral oils.

Commercially available mineral oils include Sonneborn® LP 250 commercially available from Sonneborn, Suniso® 3GS, 1GS, 4GS, and 5GS, each commercially available from Sonneborn, and Calumet R015 and RO30 commercially available from Calumet. Commercially available alkyl benzene lubricants include Zerol® 150 and Zerol® 300 commercially available from Shrieve Chemical. Commercially available esters include neopentyl glycol dipelargonate, which is available as Emery® 2917 and Hatcol® 2370. Other useful esters include phosphate esters, dibasic acid esters, and fluoroesters. Of course, different mixtures of different types of lubricants may be used.

In some embodiments, the described working fluid further includes one or more esters of one or more linear carboxylic acids.

The working fluids may also include one or more refrigerants. Suitable non-low GWP refrigerants useful in such embodiments are not overly limited. Examples include R-22, R-134a, R-125, R-143a, or any combination thereof. In some embodiments at least one of the refrigerants is a low GWP refrigerant. In some embodiments, all of the refrigerants present in the working fluid are low GWP refrigerants. In some embodiments, the refrigerant includes R-32, R-290, R-1234yf, R-1234ze(E), R-744, R-152a, R-600, R-600a or any combination thereof. In some embodiments, the refrigerant includes R-32, R-290, R-1234yf, R-1234ze(E) or any combination thereof. In some embodiments, the refrigerant includes R-32. In some embodiments the refrigerant includes R-290. In some embodiments, the refrigerant includes R-1234yf. In some embodiments, the refrigerant includes R-1234ze(E). In some embodiments, the refrigerant includes R-744. In some embodiments, the refrigerant includes R-152a. In some embodiments, the refrigerant includes R-600. In some embodiments, the refrigerant includes R-600a.

In some embodiments, the refrigerant includes R-32, R-600a, R-290, DR-5, DR-7, DR-3, DR-2, R-1234yf, R-1234ze(E), XP-10, HCFC-123, L-41A, L-41B, N-12A, N-12B, L-40, L-20, N-20, N-40A, N-40B, ARM-30A, ARM-21A, ARM-32A, ARM-41A, ARM-42A, ARM-70A, AC-5, AC-5X, HPR1D, LTR4X, LTR6A, D2Y-60, D4Y, D2Y-65, R-744, R-1270, or any combination thereof. In some embodiments, the refrigerant includes R-32, R-600a, R-290, DR-5, DR-7, DR-3, DR-2, R-1234yf, R-1234ze(E), XP-10, HCFC-123, L-41A, L-41B, N-12A, N-12B, L-40, L-20, N-20, N-40A, N-40B, ARM-30A, ARM-21A, ARM-32A, ARM-41A, ARM-42A, ARM-70A, AC-5, AC-5X, HPR1D, LTR4X, LTR6A, D2Y-60, D4Y, D2Y-65, R-1270, or any combination thereof.

It is noted that the described working fluids may in some embodiments also include one or more non-low GWP refrigerant, blended with the low GWP refrigerant, resulting in a low GWP working fluid. Suitable non-low GWP refrigerants useful in such embodiments are not overly limited. Examples include R-22, R-134a, R-125, R-143a, or any combination thereof.

The described working fluids, at least in regards to how they would be found in the evaporator of the refrigeration system in which they are used, may be from 5 to 50 wt % lubricant, and from 95 to 50 wt % refrigerant. In some embodiments, the working fluid is from 10 to 40 wt % lubricant, or even from 10 to 30 or 10 to 20 wt % lubricant.

The described working fluids, at least in regards to how they would be found in the sump of the refrigeration system in which they are used, may be from 1 to 50, or even 5 to 50 wt % refrigerant, and from 99 to 50 or even 95 to 50 wt % lubricant. In some embodiments, the working fluid is from 90 to 60 or even 95 to 60 wt % lubricant, or even from 90 to 70 or even 95 to 70, or 90 to 80 or even 95 to 80 wt % lubricant.

The described working fluids may include other components for the purpose of enhancing or providing certain functionality to the composition, or in some cases to reduce the cost of the composition.

The described working fluids may further include one or more performance additives. Suitable examples of performance additives include antioxidants, metal passivators and/or deactivators, corrosion inhibitors, antifoams, antiwear inhibitors, corrosion inhibitors, pour point depressants, viscosity improvers, tackifiers, metal deactivators, extreme pressure additives, friction modifiers, lubricity additives, foam inhibitors, emulsifiers, demulsifiers, acid catchers, or mixtures thereof.

In some embodiments, the lubricant compositions include an antioxidant. In some embodiments, the lubricant compositions include a metal passivator, wherein the metal passivator may include a corrosion inhibitor and/or a metal deactivator. In some embodiments, the lubricant compositions include a corrosion inhibitor. In still other embodiments, the lubricant compositions include a combination of a metal deactivator and a corrosion inhibitor. In still further embodiments, th the lubricant compositions include the combination of an antioxidant, a metal deactivator and a corrosion inhibitor. In any of these embodiments, the lubricant compositions include one or more additional performance additives.

The antioxidants include butylated hydroxytoluene (BHT), butylatedhydroxyanisole sole (BHA), phenyl-a-naphthylamine (PANA), octylated/butylated diphenylamine, high molecular weight phenolic antioxidants, hindered bisphenolic antioxidant, di-alpha-tocopherol, di-tertiary butyl phenol. Other useful antioxidants are described in U.S. Pat. No. 6,534,454.

In some embodiments, the antioxidant includes one or more of:

(i) Hexamethylenebis(3,5-di-tert-butyl-4-hydroxyhydrocinnamate), CAS registration number 35074-77-2, available commercially from BASF;

(ii) N-phenylbenzenamine, reaction products with 2,4,4-trimethylpentene, CAS registration number 68411-46-1, available commercially from BASF;

(iii) Phenyl-a- and/or phenyl-b-naphthylamine, for example N-phenyl-ar-(1,1,3,3-tetramethylbutyl)-1-naphthalenamine, available commercially from BASF;

(iv) Tetrakis[methylene(3,5-di-tert-butyl-4-hydroxyhydrocinnamate)] methane, CAS registration number 6683-19-8;

(v) Thiodiethylenebis (3,5-di-tert-butyl-4-hydroxyhydrocinnamate), CAS registration number 41484-35-9, which is also listed as thiodiethylenebis (3,5-di-tert-butyl-4-hydroxy-hydro-cinnamate) in 21 C.F.R. § 178.3570;

(vi) Butylatedhydroxytoluene (BHT);

(vii) Butylatedhydroxyanisole (BHA), (viii) Bis(4-(1,1,3,3-tetramethylbutyl)phenyl)amine, available commercially from BASF; and (ix) Benzenepropanoic acid, 3,5-bis(1,1-dimethylethyl)-4-hydroxy-, thiodi-2,1-ethanediyl ester, available commercially from BASF.

The antioxidants may be present in the composition from 0.01% to 6.0% or from 0.02%, to 1%. The additive may be present in the composition at 1%, 0.5%, or less. These various ranges are typically applied to all of the antioxidants present in the overall composition. However, in some embodiments, these ranges may also be applied to individual antioxidants.

The metal passivators include both metal deactivators and corrosion inhibitors.

Suitable metal deactivators include triazoles or substituted triazoles. For example, tolyltriazole or tolutriazole may be utilized. Suitable examples of metal deactivator include one or more of:

(i) One or more tolu-triazoles, for example N,N-Bis(2-ethylhexyl)-ar-methyl-1H-benzotriazole-1-methanamine, CAS registration number 94270-86-70, sold commercially by BASF under the trade name Irgamet 39;

(ii) One or more fatty acids derived from animal and/or vegetable sources, and/or the hydrogenated forms of such fatty acids, for example Neo-Fat™ which is commercially available from Akzo Novel Chemicals, Ltd.

Suitable corrosion inhibitors include one or more of:

(i) N-Methyl-N-(1-oxo-9-octadecenyl)glycine, CAS registration number 110-25-8;

(ii) Phosphoric acid, mono- and diisooctyl esters, reacted with tert-alkyl and (C12-C14) primary amines, CAS registration number 68187-67-7;

(iii) Dodecanoic Acid;

(iv) Triphenyl phosphorothionate, CAS registration number 597-82-0; and (v) Phosphoric acid, mono- and dihexyl esters, compounds with tetramethylnonylamines and C11-14 alkylamines.

In one embodiment, the metal passivator is comprised of a corrosion additive and a metal deactivator. One useful additive is the N-acyl derivative of sarcosine, such as an N-acyl derivative of sarcosine. One example is N-methyl-N-(1-oxo-9-octadecenyl) glycine. This derivative is available from BASF under the trade name SARKO-SYL™ O. Another additive is an imidazoline such as Amine O™ commercially available from BASF.

The metal passivators may be present in the composition from 0.01% to 6.0% or from 0.02%, to 0.1%. The additive may be present in the composition at 0.05% or less. These various ranges are typically applied to all of the metal passivator additives present in the overall composition. However, in some embodiments, these ranges may also be applied to individual corrosion inhibitors and/or metal deactivators. The ranges above may also be applied to the combined total of all corrosion inhibitors, metal deactivators and antioxidants present in the overall composition.

The compositions described herein may also include one or more additional performance additives. Suitable additives include antiwear inhibitors, rust/corrosion inhibitors and/or metal deactivators (other than those described above), pour point depressants, viscosity improvers, tackifiers, extreme pressure (EP) additives, friction modifiers, foam inhibitors, emulsifiers, and demulsifiers.

To aid in preventing wear on the metal surface, the present invention may utilize additional anti-wear inhibitor/EP additive and friction modifiers. Anti-wear inhibitors, EP additives, and friction modifiers are available off the shelf from a variety of vendors and manufacturers. Some of these additives may perform more than one task. One product that may provide anti-wear, EP, reduced friction and corrosion inhibition is phosphorus amine salt such as Irgalube 349, which is commercially available from BASF. Another anti-wear/EP inhibitor/friction modifier is a phosphorus compound such as is triphenyl phosphothionate (TPPT), which is commercially available from BASF under the trade name Irgalube TPPT. Another anti-wear/EP inhibitor/friction modifier is a phosphorus compound such as is tricresyl phosphate (TCP), which is commercially available from Chemtura under the trade name Kronitex TCP. Another antiwear/EP inhibitor/friction modifier is a phosphorus compound such as is t-butylphenyl phosphate, which is commercially available from ICL Industrial Products under the trade name Syn-O-Ad 8478. The anti-wear inhibitors, EP, and friction modifiers are typically 0.1% to 4% of the composition and may be used separately or in combination.

In some embodiments, the composition further includes an additive from the group comprising: viscosity modifiers include ethylene vinyl acetate, polybutenes, polyisobutylenes, polymethacrylates, olefin copolymers, esters of styrene maleic anhydride copolymers, hydrogenated styrene-diene copolymers, hydrogenated radial polyisoprene, alkylated polystyrene, fumed silicas, and complex esters; and tackifiers like natural rubber solubilized in oils.

The addition of a viscosity modifier, thickener, and/or tackifier provides adhesiveness and improves the viscosity and viscosity index of the lubricant. Some applications and environmental conditions may require an additional tacky surface film that protects equipment from corrosion and wear. In this embodiment, the viscosity modifier, thickener/tackifier is 1 to 20 wt % of the lubricant. However, the viscosity modifier, thickener/tackifier may be from 0.5 to 30 wt %. An example of a material Functional V-584 a Natural Rubber viscosity modifier/tackifier, which is available from Functional Products, Inc., Macedonia, Ohio. Another example is a complex ester CG 5000 that is also a multi-functional product, viscosity modifier, pour point depressant, and friction modifier from Inolex Chemical Co. Philadelphia, Pa.

Other oils and/or components may be also added to the composition in the range of 0.1 to 75% or even 0.1 to 50% or even 0.1 to 30%. These oils could include white petroleum oils, synthetic esters (as described in U.S. Pat. No. 6,534,454), severely hydro-treated petroleum oil (known in the industry as "Group II or III petroleum oils"), esters of one or more linear carboxylic acids, polyalphaolefin (PAO) base oils, alkyl benzene base oils, polyalkylene glycol (PAG) base oils, alkylated naphthalene base oils, or any combination thereof.

The lubricant can be used in a refrigeration system, where the refrigeration system includes a compressor and a working fluid, where the working fluid includes a lubricant and a refrigerant. Any of the working fluids described above may be used in the described refrigeration system.

The lubricant may also be able to allow for providing a method of operating a refrigeration system. The described method includes the step of: (I) supplying to the refrigeration system a working fluid that includes a lubricant and a refrigerant. Any of the working fluids described above may be used in the described methods of operating any of the described refrigeration systems.

The present methods, systems and compositions are thus adaptable for use in connection with a wide variety of heat transfer systems in general and refrigeration systems in particular, such as air-conditioning (including both stationary and mobile air conditioning systems), refrigeration, heat-pump, or gas compression systems such as industrial or hydrocarbon gas processing systems. compression systems such as are used in hydrocarbon gas processing or industrial gas processing systems. As used herein, the term "refrigeration system" refers generally to any system or apparatus, or any part or portion of such a system or apparatus, which employs a refrigerant to provide cooling and/or heating. Such refrigeration systems include, for example, air conditioners, electric refrigerators, chillers, or heat pumps.

Compressor Lubricant compositions

| | Embodiments (wt %) | | |
|---|---|---|---|
| Additive | A | B | C |
| Salt of the invention | 0 to 5.0 | 0.001 to 3.0 | 0.005 to 1.0 |
| Antioxidant | 0 to 6.0 | 0.01 to 3.0 | 0.03 to 2 |
| Antiwear/EP Agent | 0 to 4.0 | 0.0 to 2 | 0.1 to 1.0 |
| Metal Deactivator/ Corrosion Inhibitor | 0 to 6 | 0.0 to 0.5 | 0.015 to 0.1 |
| Oil of Lubricating Viscosity | Balance to 100% | Balance to 100% | Balance to 100% |

The wear performance of the refrigerant lubricant may be determined by employing the methodology of ASTM D3233-93(2009)e1 Standard Test Methods for Measurement of Extreme Pressure Propoerties of fluid Lubricants and Vee Block Methods.

Industrial Gear

The lubricants of the invention may include an industrial additive package, which may also be referred to as an industrial lubricant additive package. In other words, the lubricants are designed to be industrial lubricants, or additive packages for making the same. The lubricants do not relate to automotive gear lubricants or other lubricant compositions.

In some embodiments the industrial lubricant additive package includes a demulsifier, a dispersant, and a metal deactivator. Any combination of conventional additive packages designed for industrial application may be used. The invention in some embodiments specifies the additive package is essentially free, if not completely free of, the compatibiliser described herein, or at least do not contain the type of compatibiliser specified by the invention in the amounts specified.

The additives which may be present in the industrial additive package include a foam inhibitor, a demulsifier, a pour point depressant, an antioxidant, a dispersant, a metal deactivator (such as a copper deactivator), an antiwear agent, an extreme pressure agent, a viscosity modifier, or some mixture thereof. The additives may each be present in the range from 50 ppm, 75 ppm, 100 ppm or even 150 ppm up to 5 wt %, 4 wt %, 3 wt %, 2 wt % or even 1.5 wt %, or from 75 ppm to 0.5 wt %, from 100 ppm to 0.4 wt %, or from 150 ppm to 0.3 wt %, where the wt % values are with regards to the overall lubricant composition. In other embodiments the overall industrial additive package may be present from 1 to 20, or from 1 to 10 wt % of the overall lubricant composition. However it is noted that some additives, including viscosity modifying polymers, which may alternatively be considered as part of the base fluid, may be present in higher amounts including up to 30 wt %, 40 wt %, or even 50 wt % when considered separate from the base fluid. The additives may be used alone or as mixtures thereof.

The lubricant may also include antifoam agent. The antifoam agent may include organic silicones and non-silicon foam inhibitors. Examples of organic silicones include dimethyl silicone and polysiloxanes. Examples of non-silicon foam inhibitors include polyethers, polyacrylates and mixtures thereof as well as copolymers of ethyl acrylate, 2-ethylhexylacrylate, and optionally vinyl acetate. In some embodiments the antifoam agent may be a polyacrylate. Antifoam agents may be present in the composition from 0.001 wt % to 0.012 wt % or 0.004 wt % or even 0.001 wt % to 0.003 wt %.

The lubricant may also include demulsifier. The demulsifier may include derivatives of propylene oxide, ethylene oxide, polyoxyalkylene alcohols, alkyl amines, amino alcohols, diamines or polyamines reacted sequentially with ethylene oxide or substituted ethylene oxides or mixtures thereof. Examples of a demulsifier include polyethylene glycols, polyethylene oxides, polypropylene oxides, (ethylene oxide-propylene oxide) polymers and mixtures thereof. The demulsifier may be a polyethers. The demulsifier may be present in the composition from 0.002 wt % to 0.2 wt %.

The lubricant may include a pour point depressant. The pour point depressant may include esters of maleic anhydride-styrene copolymers, polymethacrylates; polyacrylates; polyacrylamides; condensation products of haloparaffin waxes and aromatic compounds; vinyl carboxylate polymers; and terpolymers of dialkyl fumarates, vinyl esters of fatty acids, ethylene-vinyl acetate copolymers, alkyl phenol formaldehyde condensation resins, alkyl vinyl ethers and mixtures thereof.

The lubricant may also include a rust inhibitor, other than some of the additives described above.

The lubricant may also include a rust inhibitor. Suitable rust inhibitors include hydrocarbyl amine salts of alkylphosphoric acid, hydrocarbyl amine salts of dialkyldithiophosphoric acid, hydrocarbyl amine salts of hydrocarbyl aryl sulphonic acid, fatty carboxylic acids or esters thereof, an ester of a nitrogen-containing carboxylic acid, an ammonium sulfonate, an imidazoline, or any combination thereof; or mixtures thereof.

Suitable hydrocarbyl amine salts of alkylphosphoric acid may be represented by the following formula:

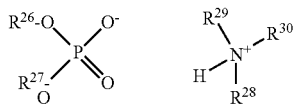

wherein $R^{26}$ and $R^{27}$ are independently hydrogen, alkyl chains or hydrocarbyl, typically at least one of $R^{26}$ and $R^{27}$ are hydrocarbyl. $R^{26}$ and $R^{27}$ contain 4 to 30, or 8 to 25, or 10 to 20, or 13 to 19 carbon atoms. $R^{28}$, $R^{29}$ and $R^{30}$ are independently hydrogen, alkyl branched or linear alkyl chains with 1 to 30, or 4 to 24, or 6 to 20, or 10 to 16 carbon atoms. $R^{28}$, $R^{29}$ and $R^{30}$ are independently hydrogen, alkyl branched or linear alkyl chains, or at least one, or two of $R^{28}$, $R^{29}$ and $R^{30}$ are hydrogen.

Examples of alkyl groups suitable for $R^{28}$, $R^{29}$ and $R^{30}$ include butyl, sec butyl, isobutyl, tert-butyl, pentyl, n-hexyl, sec hexyl, n-octyl, 2-ethyl, hexyl, decyl, undecyl, dodecyl, tridecyl, tetradecyl, pentadecyl, hexadecyl, heptadecyl, octadecyl, octadecenyl, nonadecyl, eicosyl or mixtures thereof.

In one embodiment the hydrocarbyl amine salt of an alkylphosphoric acid may be the reaction product of a $C_{14}$ to $C_{18}$ alkylated phosphoric acid with Primene 81R (produced and sold by Rohm & Haas) which may be a mixture of $C_{11}$ to $C_{14}$ tertiary alkyl primary amines.

Hydrocarbyl amine salts of dialkyldithiophosphoric acid may include a rust inhibitor such as a hydrocarbyl amine salt of dialkyldithiophosphoric acid. These may be a reaction product of heptyl or octyl or nonyl dithiophosphoric acids with ethylene diamine, morpholine or Primene 81R or mixtures thereof.

The hydrocarbyl amine salts of hydrocarbyl aryl sulphonic acid may include ethylene diamine salt of dinonyl naphthalene sulphonic acid.

Examples of suitable fatty carboxylic acids or esters thereof include glycerol monooleate and oleic acid. An example of a suitable ester of a nitrogen-containing carboxylic acid includes oleyl sarcosine.

The lubricant may contain a metal deactivator, or mixtures thereof. Metal deactivators may be chosen from a derivative of benzotriazole (typically tolyltriazole), 1,2,4-triazole, benzimidazole, 2-alkyldithiobenzimidazole or 2-alkyldithiobenzothiazole, 1-amino-2-propanol, a derivative of dimercaptothiadiazole, octylamine octanoate, condensation products of dodecenyl succinic acid or anhydride and/or a fatty acid such as oleic acid with a polyamine. The metal deactivators may also be described as corrosion inhibitors. The metal deactivators may be present in the range from 0.001 wt % to 0.5 wt %, from 0.01 wt % to 0.04 wt % or from 0.015 wt % to 0.03 wt % of the lubricating oil composition. Metal deactivators may also be present in the composition from 0.002 wt % or 0.004 wt % to 0.02 wt %. The metal deactivator may be used alone or mixtures thereof.

The lubricants may also include antioxidant, or mixtures thereof. The antioxidants, including (i) an alkylated diphenylamine, and (ii) a substituted hydrocarbyl mono-sulfide. In some embodiments the alkylated diphenylamines include bis-nonylated diphenylamine and bis-octylated diphenylamine. In some embodiments the substituted hydrocarbyl monosulfides include n-dodecyl-2-hydroxyethyl sulfide, 1-(tert-dodecylthio)-2-propanol, or combinations thereof. In some embodiments the substituted hydrocarbyl monosulfide may be 1-(tert-dodecylthio)-2-propanol. The antioxidant package may also include sterically hindered phenols. Examples of suitable hydrocarbyl groups for the sterically hindered phenols include 2-ethylhexyl or n-butyl ester, dodecyl or mixtures thereof. Examples of methylene-bridged sterically hindered phenols include 4,4'-methylene-bis(6-tert-butyl o-cresol), 4,4'-methylene-bis(2-tert-amyl-o-cresol), 2,2'-methylene-bis(4-methyl-6-tert-butylphenol), 4,4'-methylene-bis(2,6-di-tertbutylphenol) or mixtures thereof.

The antioxidants may be present in the composition from 0.01 wt % to 6.0 wt % or from 0.02 wt % to 1 wt %. The additive may be present in the composition at 1 wt %, 0.5 wt %, or less.

The lubricant may also include nitrogen-containing dispersants, for example a hydrocarbyl substituted nitrogen containing additive. Suitable hydrocarbyl substituted nitrogen containing additives include ashless dispersants and polymeric dispersants. Ashless dispersants are so-named because, as supplied, they do not contain metal and thus do not normally contribute to sulfated ash when added to a lubricant. However they may, of course, interact with ambient metals once they are added to a lubricant which includes metal-containing species. Ashless dispersants are characterized by a polar group attached to a relatively high molecular weight hydrocarbon chain. Examples of such materials include succinimide dispersants, Mannich dispersants, and borated derivatives thereof.

The lubricant may also include sulfur-containing compounds. Suitable sulfur-containing compounds include sulfurized olefins and polysulfides. The sulfurized olefin or polysulfides may be derived from isobutylene, butylene, propylene, ethylene, or some combination thereof. In some examples the sulfur-containing compound is a sulfurized olefin derived from any of the natural oils or synthetic oils described above, or even some combination thereof. For example the sulfurized olefin may be derived from vegetable oil. The sulfurized olefin may be present in the lubricant composition from 0 wt % to 5.0 wt % or from 0.01 wt % to 4.0 wt % or from 0.1 wt % to 3.0 wt %.

The lubricant may also include phosphorus containing compound, such as a fatty phosphite. The phosphorus containing compound may include a hydrocarbyl phosphite, a phosphoric acid ester, an amine salt of a phosphoric acid ester, or any combination thereof. In some embodiments the phosphorus containing compound includes a hydrocarbyl phosphite, an ester thereof, or a combination thereof. In some embodiments the phosphorus containing compound includes a hydrocarbyl phosphite. In some embodiments the hydrocarbyl phosphite may be an alkyl phosphite. By alkyl it is meant an alkyl group containing only carbon and hydrogen atoms, however either saturated or unsaturated alkyl groups are contemplated or mixtures thereof. In some embodiments the phosphorus containing compound includes an alkyl phosphite that has a fully saturated alkyl group. In some embodiments the phosphorus containing compound includes an alkyl phosphite that has an alkyl group with some unsaturation, for example, one double bond between carbon atoms. Such unsaturated alkyl groups may also be referred to as alkenyl groups, but are included within the term "alkyl group" as used herein unless otherwise noted. In some embodiments the phosphorus containing compound includes an alkyl phosphite, a phosphoric acid ester, an amine salt of a phosphoric acid ester, or any combination thereof. In some embodiments the phosphorus containing compound includes an alkyl phosphite, an ester thereof, or a combination thereof. In some embodiments the phosphorus containing compound includes an alkyl phosphite. In some embodiments the phosphorus containing compound includes an alkenyl phosphite, a phosphoric acid ester, an amine salt of a phosphoric acid ester, or any combination thereof. In some embodiments the phosphorus containing compound includes an alkenyl phosphite, an ester thereof, or a combination thereof. In some embodiments the phosphorus containing compound includes an alkenyl phosphite. In some embodiments the phosphorus containing compound includes dialkyl hydrogen phosphites. In some embodiments the phosphorus-containing compound is essentially free of, or even completely free of, phosphoric acid esters and/or amine salts thereof. In some embodiments the phosphorus-containing compound may be described as a fatty phosphite. Suitable phosphites include those having at least one hydrocarbyl group with 4 or more, or 8 or more, or 12 or more, carbon atoms. Typical ranges for the number of carbon atoms on the hydrocarbyl group include 8 to 30, or 10 to 24, or 12 to 22, or 14 to 20, or 16 to 18. The phosphite may be a mono-hydrocarbyl substituted phosphite, a di-hydrocarbyl substituted phosphite, or a tri-hydrocarbyl substituted phosphite. In one embodiment the phosphite may be sulphur-free i.e., the phosphite is not a thiophosphite. The phosphite having at least one hydrocarbyl group with 4 or more carbon atoms may be represented by the formulae:

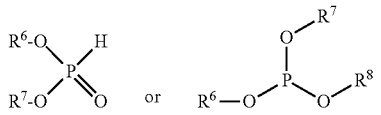

wherein at least one of $R^6$, $R^7$ and $R^8$ may be a hydrocarbyl group containing at least 4 carbon atoms and the other may be hydrogen or a hydrocarbyl group. In one embodiment $R^6$, $R^7$ and $R^8$ are all hydrocarbyl groups. The hydrocarbyl groups may be alkyl, cycloalkyl, aryl, acyclic or mixtures thereof. In the formula with all three groups $R^6$, $R^7$ and $R^8$, the compound may be a tri-hydrocarbyl substituted phosphite i.e., $R^6$, $R^7$ and $R^8$ are all hydrocarbyl groups and in some embodiments may be alkyl groups.

The alkyl groups may be linear or branched, typically linear, and saturated or unsaturated, typically saturated. Examples of alkyl groups for $R^6$, $R^7$ and $R^8$ include octyl, 2-ethylhexyl, nonyl, decyl, undecyl, dodecyl, tridecyl, tetradecyl, pentadecyl, hexadecyl, heptadecyl, octadecyl, octadecenyl, nonadecyl, eicosyl or mixtures thereof. In some embodiments the fatty phosphite component the lubricant composition overall is essentially free of, or even completely free of phosphoric acid ester and/or amine salts thereof. In some embodiments the fatty phosphite comprises an alkenyl phosphite or esters thereof, for example esters of dimethyl hydrogen phosphite. The dimethyl hydrogen phosphite may be esterified, and in some embodiments transesterified, by reaction with an alcohol, for example oleyl alcohol.

The lubricant may also include one or more phosphorous amine salts, but in amounts such that the additive package, or in other embodiments the resulting industrial lubricant compositions, contains no more than 1.0 wt % of such materials, or even no more than 0.75 wt % or 0.6 wt %. In other embodiments the industrial lubricant additive packages, or the resulting industrial lubricant compositions, are essentially free of or even completely free of phosphorous amine salts.

The lubricant may also include one or more antiwear additives and/or extreme pressure agents, one or more rust and/or corrosion inhibitors, one or more foam inhibitors, one or more demulsifiers, or any combination thereof.

In some embodiments the industrial lubricant additive packages, or the resulting industrial lubricant compositions, are essentially free of or even completely free of phosphorous amine salts, dispersants, or both.

In some embodiments the industrial lubricant additive packages, or the resulting industrial lubricant compositions, include a demulsifier, a corrosion inhibitor, a friction modifier, or combination of two or more thereof. In some embodiments the corrosion inhibitor includes a tolyltriazole. In still other embodiments the industrial additive packages, or the resulting industrial lubricant compositions, include one or more sulfurized olefins or polysulfides; one or more phosphorus amine salts; one or more thiophosphate esters, one or more thiadiazoles, tolyltriazoles, polyethers, and/or alkenyl amines; one or more ester copolymers; one or more carboxylic esters; one or more succinimide dispersants, or any combination thereof.

The industrial lubricant additive package may be present in the overall industrial lubricant from 1 wt % to 5 wt %, or in other embodiments from 1 wt %, 1.5 wt %, or even 2 wt % up to 2 wt %, 3 wt %, 4 wt %, 5 wt %, 7 wt % or even 10 wt %. Amounts of the industrial gear additive package that may be present in the industrial gear concentrate lubricant are the corresponding amounts to the wt % above, where the values are considered without the oil present (i.e. they may be treated as wt % values along with the actual amount of oil present).

The lubricant may also include a derivative of a hydroxy-carboxylic acid. Suitable acids may include from 1 to 5 or 2 carboxy groups or from 1 to 5 or 2 hydroxy groups. In some embodiments the friction modifier may be derivable from a hydroxy-carboxylic acid represented by the formula:

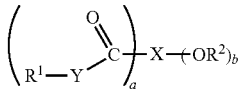

wherein: a and b may be independently integers of 1 to 5, or 1 to 2; X may be an aliphatic or alicyclic group, or an aliphatic or alicyclic group containing an oxygen atom in the carbon chain, or a substituted group of the foregoing types, said group containing up to 6 carbon atoms and having a+b available points of attachment; each Y may be independently —O—, >NH, or >$NR^3$ or two Y's together representing the nitrogen of an imide structure $R^4$—N<formed between two carbonyl groups; and each $R^3$ and $R^4$ may be independently hydrogen or a hydrocarbyl group, provided that at least one $R^1$ and $R^3$ group may be a hydrocarbyl group; each $R^2$ may be independently hydrogen, a hydrocarbyl group or an acyl group, further provided that at least one —$OR^2$ group is located on a carbon atom within X that is α or β to at least one of the —C(O)—Y—$R^1$ groups, and further provided that at least on $R^2$ is hydrogen. The hydroxy-carboxylic acid is reacted with an alcohol and/or an amine, via a condensation reaction, forming the derivative of a hydroxy-carboxylic acid, which may also be referred to herein as a friction modifier additive. In one embodiment the hydroxy-carboxylic acid used in the preparation of the derivative of a hydroxy-carboxylic acid is represented by the formula:

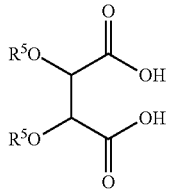

wherein each $R^5$ may independently be H or a hydrocarbyl group, or wherein the $R^5$ groups together form a ring. In one embodiment, where $R^5$ is H, the condensation product is optionally further functionalized by acylation or reaction with a boron compound. In another embodiment the friction modifier is not borated. In any of the embodiments above, the hydroxy-carboxylic acid may be tartaric acid, citric acid, or combinations thereof, and may also be a reactive equivalent of such acids (including esters, acid halides, or anhydrides).

The resulting friction modifiers may include imide, di-ester, di-amide, or ester-amide derivatives of tartaric acid, citric acid, or mixtures thereof. In one embodiment the derivative of hydroxycarboxylic acid includes an imide, a di-ester, a di-amide, an imide amide, an imide ester or an ester-amide derivative of tartaric acid or citric acid. In one embodiment the derivative of hydroxycarboxylic acid includes an imide, a di-ester, a di-amide, an imide amide, an imide ester or an ester-amide derivative of tartaric acid. In one embodiment the derivative of hydroxycarboxylic acid includes an ester derivative of tartaric acid. In one embodiment the derivative of hydroxycarboxylic acid includes an imide and/or amide derivative of tartaric acid. The amines used in the preparation of the friction modifier may have the formula RR'NH wherein R and R' each independently represent H, a hydrocarbon-based radical of 1 or 8 to 30 or 150 carbon atoms, that is, 1 to 150 or 8 to 30 or 1 to 30 or 8 to 150 atoms. Amines having a range of carbon atoms with a lower limit of 2, 3, 4, 6, 10, or 12 carbon atoms and an upper limit of 120, 80, 48, 24, 20, 18, or 16 carbon atoms may also be used. In one embodiment, each of the groups R and R' has 8 or 6 to 30 or 12 carbon atoms. In one embodiment, the sum of carbon atoms in R and R' is at least 8. R and R' may be linear or branched. The alcohols useful for preparing the friction modifier will similarly contain 1 or 8 to 30 or 150 carbon atoms. Alcohols having a range of carbon atoms from a lower limit of 2, 3, 4, 6, 10, or 12 carbon atoms and an upper limit of 120, 80, 48, 24, 20, 18, or 16 carbon atoms may also be used. In certain embodiments the number of carbon atoms in the alcohol-derived group may be 8 to 24, 10 to 18, 12 to 16, or 13 carbon atoms. The alcohols and amines may be linear or branched, and, if branched, the branching may occur at any point in the chain and the branching may be of any length. In some embodiments the alcohols and/or amines used include branched compounds, and in still other embodiments, the alcohols and amines used are at least 50%, 75% or even 80% branched. In other embodiments the alcohols are linear. In some embodiments, the alcohol and/or amine have at least 6 carbon atoms. Accordingly, certain embodiments the product prepared from branched alcohols and/or amines of at least 6 carbon atoms, for instance, branched $C_{6-18}$ or $C_{8-18}$ alcohols or branched $C_{12-16}$ alcohols, either as single materials or as mixtures. Specific examples include 2-ethylhexanol and isotridecyl alcohol, the latter of which may represent a commercial grade mixture of various isomers. Also, certain embodiments the product prepared from linear alcohols of at least 6 carbon atoms, for instance, linear $C_{6-18}$ or $C_{8-18}$ alcohols or linear $C_{12-16}$ alcohols, either as single materials or as mixtures. The tartaric acid used for preparing the tartrates, tartrimides, or tartramides may be the commercially available type (obtained from Sargent Welch), and it exists in one or more isomeric forms such as d-tartaric acid, l-tartaric acid, d,l-tartaric acid or meso-tartaric acid, often depending on the source (natural) or method of synthesis (e.g. from maleic acid). These derivatives may also be prepared from functional equivalents to the diacid readily apparent to those skilled in the art, such as esters, acid chlorides, or anhydrides.

In some embodiments the additive package includes one or more corrosion inhibitors, one or more dispersants, one or more antiwear and/or extreme pressure additives, one or more extreme pressure agents, one or more antifoam agents, one or more detergents, and optionally some amount of base oil or similar solvent as a diluent.

The additional additives may be present in the overall industrial gear lubricant composition from 0.1 wt % to 30 wt %, or from a minimum level of 0.1 wt %, 1 wt % or even 2 wt % up to a maximum of 30 wt %, 20 wt %, 10 wt %, 5 wt %, or even 2 wt %, or from 0.1 wt % to 30 wt %, from 0.1 wt % to 20 wt %, from 1 wt % to 20 wt %, from 1 wt % to 10 wt %, from 1 wt % to 5 wt %, or even about 2 wt %. These ranges and limits may be applied to each individual additional additive present in the composition, or to all of the additional additives present.

The Industrial Gear lubricant may comprise:

0.01 wt % to 5 wt % of a phos-amine salt, 0.0001 wt % to 0.15 wt % of a corrosion inhibitor chosen from 2,5-bis(tert-dodecyldithio)-1,3,4-thiadiazole, tolyltriazole, or mixtures thereof, an oil of lubricating viscosity, 0.02 wt % to 3 wt % of antioxidant chosen from aminic or phenolic antioxidants, or mixtures thereof, 0.005 wt % to 1.5 wt % of a borated succinimide or a non-borated succinimide, 0.001 wt % to 1.5 wt % of a neutral or slightly overbased calcium naphthalene sulphonate (typically a neutral or slightly overbased calcium dinonyl naphthalene sulphonate), and 0.001 wt % to 2 wt %, or 0.01 wt % to 1 wt % of an antiwear agent (other than the protic salt of the present invention) chosen from zinc dialkyldithiophosphate, zinc dialkylphosphate, amine salt of a phosphorus acid or ester, or mixtures thereof.

The Industrial Gear lubricant may also comprise a formulation defined in the following table:

| Industrial Gear Lubricant compositions | | | |
|---|---|---|---|
| | Embodiments (wt %) | | |
| Additive | A | B | C |
| Salt of the invention | 0 to 5.0 | 0.01 to 3.0 | 0.005 to 1.0 |
| Sulfurized Olefin | 0 to 5.0 | 0.01 to 4.0 | 0.1 to 3 |
| Dispersant | 0 to 2.0 | 0.005 to 1.5 | 0.01 to 1.0 |
| Antifoam Agent | 0.001 to 0.012 | 0.001 to 0.004 | 0.001 to 0.003 |
| Demulsifier | 0.002 to 2 | .0025 to 0.5 | 0.005 to 0.04 |
| Metal Deactivator | 0.001 to 0.5 | 0.01 to 0.04 | 0.015 to 0.03 |
| Rust Inhibitor | 0.001 to 1.0 | 0.005 to 0.5 | 0.01 to 0.25 |
| Amine Phosphate | 0 to 3.0 | 0.005 to 2 | 0.01 to 1.0 |
| Oil of Lubricating Viscosity | Balance to 100% | Balance to 100% | Balance to 100% |

Specific examples of an Industrial Gear lubricant include those summarized in the following table:

| Industrial Gear Lubricant compositions* | | | |
|---|---|---|---|
| | Embodiments (wt %) | | |
| Additive | A | B | C |
| Salt of the invention | 0 | 0.25 | 0.5 |
| Dispersant | 0.1 | 0.1 | 0.1 |
| Polyacrylate Antifoam Agent | 0.02 | 0.02 | 0.02 |
| Alkoxylated Demulsifier | 0.01 | 0.01 | 0.01 |
| Thiazole/Triazole Metal Deactivators | 0.035 | 0.035 | 0.035 |
| Fatty Amine Rust Inhibitor | 0.05 | 0.05 | 0.05 |
| Sulfurized Olefin | 1.0 | 1.0 | 1.0 |
| Oil of Lubricating Viscosity | Balance to 100% | Balance to 100% | Balance to 100% |

Antiwear performance of each lubricant may be evaluated in accordance with ASTM D2782-02(2008) Standard Test Method for Measurement of Extreme-Pressure Properties of Lubricating Fluids (Timken Method), ASTM D2783-03 (2009) Standard Test Method for Measurement of Extreme-Pressure Properties of Lubricating Fluids (Four-Ball Method), ASTM D4172-94(2010) Standard Test Method for Wear Preventive Characteristics of Lubricating Fluid (Four-Ball Method) and ASTM D5182-97(2014) Standard Test Method for Evaluating the Scuffing Load Capacity of Oils (FZG Visual Method).

The phos-amine salts may also be used as an engine lubricant. The engine or engine components may be made of an alloy comprising lead or copper. In one embodiment, the engine or engine components may have surfaces comprising lead. The engine components may have a surface of steel or aluminum (typically a surface of steel).

An aluminum surface may be derived from an aluminum alloy that may be a eutectic or hyper-eutectic aluminum alloy (such as those derived from aluminum silicates, aluminum oxides, or other ceramic materials). The aluminum surface may be present on a cylinder bore, cylinder block, or piston ring having an aluminum alloy, or aluminum composite.

The internal combustion engine may or may not have an Exhaust Gas Recirculation system. The internal combustion engine may be fitted with an emission control system or a turbocharger. Examples of the emission control system include diesel particulate filters (DPF), or systems employing selective catalytic reduction (SCR).

In one embodiment, the internal combustion engine may be a diesel fueled engine (typically a heavy duty diesel engine), a gasoline fueled engine, a natural gas-fueled engine or a mixed gasoline/alcohol fueled engine. In one embodiment, the internal combustion engine may be a diesel fueled engine and in another embodiment a gasoline fueled engine. In one embodiment, the internal combustion engine may be a heavy duty diesel engine.

The internal combustion engine may be a 2-stroke or 4-stroke engine. Suitable internal combustion engines include marine diesel engines, aviation piston engines, low-load diesel engines, and automobile and truck engines.

The lubricant composition for an internal combustion engine may be suitable for any engine lubricant irrespective of the sulfur, phosphorus or sulfated ash (ASTM D-874) content. The lubricating composition may be characterized as having at least one of (i) a sulfur content of 0.2 wt % to 0.4 wt % or less, (ii) a phosphorus content of 0.08 wt % to 0.15 wt %, and (iii) a sulfated ash content of 0.5 wt % to 1.5 wt % or less. The lubricating composition may also be characterized as having (i) a sulfur content of 0.5 wt % or less, (ii) a phosphorus content of 0.1 wt % or less, and (iii) a sulfated ash content of 0.5 wt % to 1.5 wt % or less. In yet another embodiment, the lubricating composition may be characterized as having a sulfated ash content of 0.5 wt % to 1.2 wt %. Specific examples of engine lubricant include those summarized in the following table:

| | Embodiments (wt %) | | |
|---|---|---|---|
| Additive | A | B | C |
| Phos-Amine Salt | 0.01 to 3 | 0.01 to 3 | 0.01 to 3 |
| Boron-Containing Compound | 0.0 to 8 | 0.05 to 4 | 0.05 to 3 |
| Nitrogen-Containing Dispersant | 0.05 to 12 | 0.5 to 8 | 1 to 5 |
| Dispersant Viscosity Modifier | 0 to 5 | 0 to 4 | 0.05 to 2 |
| Overbased Detergent | 0 to 15 | 0.1 to 8 | 0.5 to 3 |
| Antioxidant | 0 to 15 | 0.1 to 10 | 0.5 to 5 |
| Phosphorous Antiwear Agent | 0.1 to 15 | 0.2 to 6 | 0.3 to 2 |
| Friction Modifier | 0 to 6 | 0.05 to 4 | 0.1 to 2 |
| Viscosity Modifier | 0 to 10 | 0.5 to 8 | 1 to 6 |
| Any Other Performance Additive | 0 to 10 | 0 to 8 | 0 to 6 |
| Oil of Lubricating Viscosity | Balance to 100% | Balance to 100% | Balance to 100% |

The additives for the engine lubricant may be as described herein above. Suitable boron-containing compounds include borate esters or borate alcohols.

The borate ester may be prepared by the reaction of a boron compound and at least one compound selected from epoxy compounds, halohydrin compounds, epihalohydrin compounds, alcohols and mixtures thereof. The alcohols include dihydric alcohols, trihydric alcohols or higher alcohols, with the proviso for one embodiment that hydroxyl groups are on adjacent carbon atoms, i.e., vicinal.

Boron compounds suitable for preparing the borate ester include the various forms selected from the group consisting of boric acid (including metaboric acid, $HBO_2$, orthoboric acid, $H_3BO_3$, and tetraboric acid, $H_2B_4O_7$), boric oxide, boron trioxide and alkyl borates. The borate ester may also be prepared from boron halides.

In one embodiment, suitable borate ester compounds include triethyl borate, tripropyl borate, triisopropyl borate, tributyl borate, tripentyl borate, trihexyl borate, tricyclohexyl borate, trioctyl borate, triisooctyl borate, tridecyl borate, tri ($C_{8-10}$) borate, tri ($C_{12-15}$ borate) and oleyl borate, or mixtures thereof.

In one embodiment, the boron-containing compound is a borated fatty acid ester of glycerol. The borated fatty acid esters of glycerol are prepared by borating a fatty acid ester of glycerol with boric acid with removal of the water of reaction. In one embodiment, there is sufficient boron present such that each boron will react with from 1.5 to 2.5 hydroxyl groups present in the reaction mixture.

The reaction may be carried out at a temperature in the range of 60° C. to 135° C., in the absence or presence of any suitable organic solvent such as methanol, benzene, xylenes, toluene, neutral oil and the like.

Fatty acid esters of glycerol can be prepared by a variety of methods well known in the art. Many of these esters, such as glycerol monooleate and glycerol tallowate, are manufactured on a commercial scale. The esters useful for this invention are oil-soluble and may be prepared from $C_8$ to $C_{22}$ fatty acids or mixtures thereof such as are found in natural products. The fatty acid may be saturated or unsaturated. Certain compounds found in acids from natural sources may include licanic acid which contains one keto group. In one embodiment, the $C_8$ to $C_{22}$ fatty acids are those of the formula $R^{10}$—COOH wherein $R^{10}$ is alkyl or alkenyl.

In one embodiment, the fatty acid ester of glycerol is a monoester of glycerol, however, mixtures of mono- and diesters may be used. The mixture of mono- and diester can contains at least 40% of the monoester. In one embodiment, mixtures of mono- and diesters of glycerol contain from 40 to 60 percent by weight of the monoester. For example, commercial glycerol monooleate contains a mixture of from 45% to 55% by weight monoester and from 55% to 45% diester.

In one embodiment, the fatty acids include oleic, stearic, isostearic, palmitic, myristic, palmitoleic, linoleic, lauric, linolenic, and eleostearic, and the acids from the natural products tallow, palm oil, olive oil, peanut oil, corn oil, neat's foot oil and the like. In one embodiment, the fatty acid is oleic acid.

The boron-containing compound may be employed in the lubricating oil composition at a sufficient concentration to provide the lubricating oil composition with a boron level in the range of from 5 ppm to 2000 ppm, and in one embodiment 15 ppm to 600 ppm, and in one embodiment 20 ppm to 300 ppm.

The following examples provide illustrations of the disclosed technology. These examples are non-exhaustive and are not intended to limit the scope of the invention.

The amount of each chemical component described is presented exclusive of any solvent or diluent oil, which may be customarily present in the commercial material, that is, on an active chemical basis, unless otherwise indicated. However, unless otherwise indicated, each chemical or composition referred to herein should be interpreted as being a commercial grade material which may contain the isomers, by-products, derivatives, and other such materials which are normally understood to be present in the commercial grade.

It is known that some of the materials described herein may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

The invention herein may be better understood with reference to the following examples.

EXAMPLES

General Procedure for Formation of Phosphate Acid Esters

Alcohol is charged to a dry multi-necked flange flask fitted with a condenser, an overhead mechanical stirrer, nitrogen inlet, and thermocouple. The flask is heated to between 40 and 70° C. and then phosphorus pentoxide is slowly added, while maintaining the temperature at between 40 and 80° C. The mixture is then heated to 60 to 90° C. and stirred for an additional 3 to 20 hours. Any excess alcohol may be removed by vacuum distillation. The molar ratio of the alcohol to phosphorus pentoxide ($P_2O_5$) may be 4:1 to 2.5:1, i.e. for every phosphorus there is typically 2 to 1.25 equivalents alcohol.

General Procedure for Formation of Salts

A phosphate ester mixture (produced as described above) is charged to a 3-neck round bottom flask fitted with a condenser, magnetic stirrer, nitrogen inlet, and thermocouple. An amine is added to the flask at 0.95 equivalents basis, over approximately 1 hour. During this time an exotherm is observed. The mixture is then heated to at least 100° C. and held for 3 to 5 hours.

The examples described above are common to all of the sulfur-free alkyl phosphate amine salts described herein. Those skilled in the art will recognize that adjustments in stoichiometry, reaction time, reaction temperature may be required to achieve the desired product(s) with varying starting materials.

Formation of Phos-Amine Salts of Formula IV

Bis-2-ethylhexylamine (463.6 g) is charged to a multi-necked 2 L flask equipped with a nitrogen inlet, thermocouple, condenser, overhead stirrer and cooling bath. Dichlormethane (2.5 L) is added to the flask, followed by phenylacetaldehyde (300 g) and an exotherm is observed. After the exotherm subsides, sodium triacetoxyborohydride (STAB) (415.18 g) is added in two portions and the reaction mixture is then stirred under a nitrogen blanket overnight. At this point 25 wt %, aqueous sodium hydroxide is added (750 ml) and a precipitate is formed. The mixture is then filtered through calcined diatomaceous earth and the organic filtrates are washed with water until a neutral pH is detected. The organic filtrates are then dried over sodium sulfate, filtered and concentrated under reduced pressure to leave a pale orange oil comprising sterically hindered amine derivatives.

Formation of Phos-Amine Salts of Formula V

In another example, n-n-dialkyl 1,3-diminopropane such as Duomeen 218i available from AkzoNobel (207.8 g) is charged to a multi-neck 1 L flask equipped with a nitrogen inlet, thermocouple, condenser (with Dean-Stark trap) and overhead stirrer. Dimethyl oxalate (19.7 g) is added and the mixture is heated to 90° C. and stirred for 2 hours. The mixture is then heated further to 155° C. and held for a further 4 hours (collecting methanol). Any remaining methanol is removed under reduced pressure using a rotary evaporation, leaving a product comprising oxalamide derivatives.

Formation of Phos-Amine Salts of Formula VI

4-Ethoxyaniline (175 g) is charged to a multi-necked 2 L flask equipped with a nitrogen inlet, thermocouple, condenser and overhead stirrer. Dimethylformamide (318 ml) is then added followed by 2-ethylhexyl bromide (740 g) and finally potassium carbonate (705 g). The reaction is heated to 145° C. and stirred under a nitrogen blanket for 12 hours then cooled. The reaction mixture is filtered and water is added (1.5 L). The mixture is then extracted with in ethyl acetate (4×700 ml). The organics are then dried with magnesium sulfate, filtered and concentrated under reduced pressure. Upon storage, the product is filtered one remaining time. The resulting product comprises alkoxy aniline derivatives.

In another example, isostearic acid (300 g) was charged to a multi-necked 1 L flask equipped with a nitrogen inlet, thermocouple, condenser (with Dean-Stark trap) and overhead stirrer. 2-morpholinoethanol (171.9 g) is added to the flask and the reaction mixture is heated with stirring to 190° C. and held for 8 hours, collecting 17.9 g of water. The reaction is cooled to 160° C. and concentrated under vacuum for 30 minutes. The resulting product comprises morpholine ester derivatives.

Another exemplary phos-amine salt having the structure of formula VI is decyl 2-aminobenzoate that may be purchased from Alfa Chemistry of Holtsville, N.Y., U.S.A.

Formation of Phos-Amine Salts of Formula VII

Formation of these materials is well known to persons of ordinary skill in the art. Exemplary materials having the structure of formula V include 4,4'-dinonyldiphenylamine that may be purchased from Alfa Chemistry of Holtsville, N.Y., U.S.A.

Formation of Phos-Amine Salts of Formula VIII

Para-phenylenediamine (143 g) is charged to a multi-necked 5 L flask equipped with a nitrogen inlet, thermocouple, condenser and overhead stirrer. Dimethylformamide (694.9 g) is then added to the flask, followed by 1-bromopentane (1198.4 g) and potassium carbonate (1461.7 g). The reaction is then heated to 140° C. and held with while stirring under a nitrogen purge for 24 hours. Upon cooling, water is added to the flask (2 L) to dissolve the solids. The aqueous layer is then drained and the organic layer is taken up in ethyl acetate (1 L). The organic phase is then washed 4 times using 1 L of ethyl acetate each time. The washed organic phase is then dried with magnesium sulfate and filtered. The solvent is then removed under reduced pressure. The crude material is then purified with column chromatography, beginning with heptane as an eluent and then eluting the product with a mixture of ethyl acetate: heptane (1:5), yielding a phenyldiamine derivative.

In another example, di-sec-butyl-p-phenelendiamine (50 g) is charged to a multi-necked 2 L flask equipped with a nitrogen inlet, thermocouple, condenser, overhead stirrer and cooling bath. Dichloromethane (1.2 L) is added to the flask, followed by sodium triacetoxyborohydride (STAB). 2-ethylhexylaldehyde is then mixed with 100 ml of dichloromethane and added to the reaction flask over 30 minutes, resulting in an exotherm. Once the exotherm subsides, the reaction is allowed to stir for 3 days. The reaction mixture is then transferred to a larger flask and saturated sodium bicarbonate is then added (750 ml) with vigorous stirring. The organic layer is separated from the aqueous layer and washed with brine (1 L) then dried with the addition of sodium sulfate. Upon filtration, the filtrates are then concentrated under reduced pressure to leave the crude product comprising phenyldiamine derivatives.

Those skilled in the art will recognize that adjustments in stoichiometry, reaction time, reaction temperature and purification method may be required to achieve the desired product with varying starting materials. Those skilled in the art will recognize that adjustments to the above examples, including, adjustments in stoichiometry, reaction time, reaction temperature and purification method may be required to achieve the desired product with varying starting materials.

Various materials were synthesized using the same or similar procedures described above and are summarized in Table 2, Table 3, and Table 4 below.

TABLE 2

| Alcohol used to make phosphate ester | Phosphate |
|---|---|
| 4-Methyl-2-pentanol | P1 |
| 2-Ethyl-1-hexanol | P3 |

TABLE 3

| Amine | |
|---|---|
| 4-ethoxy-N,N-dihexylaniline | AM1 |
| 2-ethoxy-N,N-dihexylaniline | AM2 |
| 2-ethyl-N-(2-ethylhexyl)-N-phenethylhexan-1-amine | AM3 |
| N1,N1,N4,N4-tetrapentylbenzene-1,4-diamine | AM4 |
| N1,N4-bis(2-ethylhexyl)-N1,N4-bis(4-methylpentan-2-yl)benzene-1,4-diamine | AM5 |
| N1,N4-di-sec-butyl-N1,N4-bis(2-ethylhexyl)benzene-1,4-diamine | AM6 |
| decyl 2-aminobenzoate | AM7 |
| bis(3-nonylphenyl)amine | AM8 |
| 2-morpholinoethyl 17-methyloctadecanoate | AM9 |
| N,N'-(((oxybis(ethane-2,1-diyl))bis(oxy))bis(propane-3,1-diyl))bis(2-ethyl-N-(2-ethylhexyl)hexan-1-amine) | AM10 |
| tris(2-ethylhexyl)amine | AM11 |
| 2-ethyl-N-(2-ethylhexyl)-N-(2-methoxyethyl)hexan-1-amine | AM12 |
| N1,N2-bis(3-(bis(16-methylheptadecyl)amino)propyl)oxalamide | AM13 |
| N,N-dihexylaniline | AM14 |
| 2-Ethylhexylamine | AMComp |

TABLE 4

| Example | Amine | Phosphate |
|---|---|---|
| EX1 | AM1 | P1 |
| EX2 | AM2 | P1 |
| EX3 | AM3 | P1 |
| EX4 | AM4 | P1 |
| EX5 | AM5 | P1 |
| EX6 | AM6 | P1 |
| EX7 | AM8 | P1 |
| EX8 | AM9 | P1 |
| EX9 | AM10 | P1 |
| EX10 | AM11 | P1 |
| EX11 | AM12 | P1 |
| EX12 | AM13 | P1 |
| COMP1 | AMComp | P3 |
| COMP2 | AMComp | P1 |

The resulting phos-amine salts were then added to a lubricating composition as summarized in Table 5 below.

TABLE 5

| Function/Component | | Baseline Formulation wt % on an actives basis |
|---|---|---|
| Base Oils | PAO - 4 cSt | 66 |
| | PAO - 100 cSt | 24 |
| Dispersant package | Borated PiB succinimide type | 0.67 |
| | PiB succinimide amide/ester with DMTD type (TBN = 4) | 0.51 |
| S containing EP package | Sulfurized olefin | 4.6 |
| Corrosion inhibitor package | Alkenyl imidazoline and a substituted thiadiazole | 0.235 |

TABLE 5-continued

| Function/Component | | Baseline Formulation wt % on an actives basis |
|---|---|---|
| Antifoam | Acrylate type | 0.03 |
| Antiwear package | Phos-amine salts (or comparative) | 500 ppm phosphorous by weight* |
| Diluent Oil | | Balance to 100 |

*All phos-salts are added to provide the same amount (in ppm) of phosphorous to the composition, but the actual wt % of the phos-amine amine salt varies with molecular structure.

The prepared lubricant compositions were tested for anti-wear and seals compatibility. The seals compatibility of the lubricant compositions are tested according to ASTM D 5662. For the compatibility tests, three parameters are tested, the difference in volume, hardness, and tensile strength. Ideally, the effect of the lubricant compositions would have a minimal impact on these properties.

Dumbbell-shaped pieces of a fluoro-elastomeric seal material are immersed in the lubricant compositions for 240 hours at 150° C. The difference in volume between the start of test (SOT) & that at the end of test (EOT) is recorded as % volume change (ASTM D471).

The change in Shore hardness of the pieces is then measured between SOT & EOT (ASTM D2240). A negative change in hardness indicates the specimen has softened and a positive change indicates hardening.

Finally, the dumbbell-shaped pieces are placed in a tensile strength measuring machine. The ends of each piece are pulled apart until the piece ruptures and the tensile strength is measured (ASTM D412). A "fresh" piece not exposed to the lubricant compositions is used as a control. The % difference between the rupture length of the pieces exposed to the lubricant composition and the control is the rupture elongation measurement.

The results of the compatibility tests are shown in Table 6 below. As shown in the table, the comparative formulations (COMP1 and COMP2) ruptures much sooner under load than the exemplary formulations (EX1, EX7, and EX10).

TABLE 6

| Compatibility Test Results | COMP1 | COMP2 | EX1 | EX7 | EX10 |
|---|---|---|---|---|---|
| % volume change | 1.9 | 1.3 | 1.7 | 1.2 | 2.4 |
| Shore hardness change | 8 | 2 | 2 | 4 | 1 |
| % Elongation at rupture | −59.1 | −48.4 | −23.6 | −35.8 | −12.2 |

The seals compatibility of the lubricant compositions are tested using a High Frequency Reciprocating Rig (HFRR). The protocol is as follows:

| | |
|---|---|
| Load | 100 g and 300 g |
| Duration | 60 minutes |
| Frequency | 20 Hz |
| Temperature | Isothermal at 100° C. |
| Metallurgy | Standard steel ball on Steel |

The results are shown in Table 7 below.

TABLE 7

| Example | Amine | Phosphate | Wear 100 g | Wear 300 g |
|---|---|---|---|---|
| EX1 | AM1 | P1 | 140 | 172 |
| EX2 | AM2 | P1 | 148 | 169 |
| EX3 | AM3 | P1 | 144 | 177 |
| EX4 | AM4 | P1 | 130 | 173 |
| EX5 | AM5 | P1 | 138 | 159 |
| EX6 | AM6 | P1 | 141 | 161 |
| EX8 | AM9 | P1 | 154 | 152 |
| EX9 | AM10 | P1 | 147 | 176 |
| EX11 | AM12 | P1 | 135 | 173 |
| EX12 | AM13 | P1 | 154 | 183 |
| COMP1 | AMComp | P3 | 209 | 176 |

Accordingly, in one embodiment, a lubricant composition comprising an oil of lubricating viscosity and about 0.01 to about 5 percent by weight of a substantially sulfur-free alkyl phosphate amine salt ("phos-amine salt") is disclosed. At least about 30 mole percent of the phosphorus atoms are in an alkyl pyrophosphate salt structure and at least about 80 mole percent of the alkyl groups of the phosphate structure are secondary alkyl groups of about 3 to about 12 carbon atoms. The amine portion is a hydrocarbyl amine that is a hindered hydrocarbyl amine, an aromatic hydrocarbyl amine, or a combination thereof.

The phos-amine salt may comprise a species represented by formula (I) or (II):

(I)

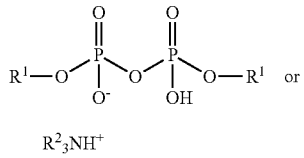

or (II)

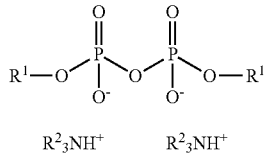

The phos-amine salt is prepared or preparable by the reaction of phosphorus pentoxide with a secondary alcohol having about 3 to about 12 carbon atoms and reacting the product thereof with a hydrocarbyl amine. The hydrocarbyl amine may comprise at least one $C_1$-$C_{30}$, $C_1$-$C_{20}$, $C_4$-$C_{18}$, or $C_6$-$C_{14}$ hydrocarbyl group. In the reaction to prepare the alkyl phosphate amine salt, the phosphorus pentoxide may be reacted with about 2.2 to about 3.1 moles, or about 2.3 to about 2.8 moles, or 2.4 to 2.4 per mole of P2O5, of the secondary alcohol at a temperature of about 30° C. to about 60° C.

The alkyl phosphate amine salt may comprise up to about 60 mole percent of the phosphorus atoms in mono- or di-alkyl-orthophosphate salt structures. In other embodiments, the alkyl phosphate amine salt may comprise at least about 50 to about 80, or 55 to 65 mole percent of the phosphorus atoms in an alkyl pyrophosphate salt structure.

In other embodiments, the hydrocarbyl amine can be a hindered amine represented by formula (III)

$$R^3—NR^5—R^4 \quad \text{(III)}$$

wherein $R^3$, $R^4$, and $R^5$ are independently a $C_1$-$C_{30}$ hydrocarbyl group. In other embodiments, $R^3$, $R^4$, and $R^5$ can independently be a $C_1$-$C_{20}$, $C_4$-$C_{18}$, or $C_6$-$C_{14}$ hydrocarbyl group. In another embodiment, the hindered hydrocarbyl amine may have at least one aromatic group.

In other embodiments, the hydrocarbyl amine can be an aromatic amine having an alkyl group attached directly to a nitrogen atom that salts with the phosphate and wherein the nitrogen atom may optionally be further alkylated. In yet other embodiments the hydrocarbyl amine can be a tertiary alkyl amine with at least two branched alkyl groups. The at least two branched alkyl groups can independently be branched at the α or the β position. In yet other embodiments, the at least two branched alkyl groups can both be branched at the β position. In some embodiments, the alkyl group or groups of the alkylphosphate structure may comprise 4-methylpent-2-yl groups.

In one embodiment, the lubricant composition the oil of lubricating viscosity may have a kinematic viscosity at 100° C. by ASTM D445 of about 3 to about 7.5, or about 3.6 to about 6, or about 3.5 to about 5 mm2/s. In another embodiment, the oil of lubricating viscosity may comprise a poly alpha olefin having a kinematic viscosity at 100° C. by ASTM D445 of about 3 to about 7.5.

In other embodiments, the lubricant composition may optionally comprise an overbased alkaline earth metal detergent in an amount to provide 1 to about 500, or 1 to about 100, or 10 to about 50 parts by million by weight alkaline earth metal. In some embodiments, the lubricant composition may optionally comprise 1 to about 30, or about 5 to about 15, percent by weight of a polymeric viscosity index modifier. In yet other embodiments, the lubricant composition may optionally comprise an extreme pressure agent. In other embodiments, a composition prepared by admixing the components as described above is disclosed.

Methods of lubricating a mechanical device are also disclosed. The methods may comprise supplying any of the lubricant compositions described above to the mechanical device. Exemplary mechanical devices include, but are not limited to, gears, axels, manual transmissions, automatic transmission (or a dual clutch transmission "DCT").

In other embodiments, methods of reducing seal deterioration are disclosed. The methods may comprise supplying any of the lubricant compositions described above to the mechanical device. In one embodiment, the seal elongation of a fluoro-elastomeric seal at rupture is less than 40% using ASTM D 5662.

In other embodiments, methods of preparing a substantially sulfur-free alkyl phosphate amine salt ("phos-amine salt") are also disclosed. The methods may comprise reacting phosphorus pentoxide with about an equivalent amount of a secondary alcohol or a mixture of secondary alcohols having about 3 to about 12 carbon atoms, at a temperature of about 40 to about 60° C., and reacting the product thereof with an amine. At least about 30 mole percent of the phosphorus atoms may be in an alkyl pyrophosphate salt structure; wherein at least about 80 mole percent of the alkyl groups are secondary alkyl groups of about 3 to about 12 carbon atoms. The amine may be a hydrocarbyl amine that is a hindered hydrocarbyl amine, an aromatic hydrocarbyl amine, or a combination thereof.

Each of the documents referred to above is incorporated herein by reference, including any prior applications, whether or not specifically listed above, from which priority is claimed. The mention of any document is not an admission that such document qualifies as prior art or constitutes the general knowledge of the skilled person in any jurisdiction. Except in the Examples, or where otherwise explicitly indicated, all numerical quantities in this description specifying amounts of materials, reaction conditions, molecular weights, number of carbon atoms, and the like, are to be understood as optionally modified by the word "about." It is to be understood that the upper and lower amount, range, and ratio limits set forth herein may be independently combined. Similarly, the ranges and amounts for each element of the invention can be used together with ranges or amounts for any of the other elements.

As used herein, the transitional term "comprising," which is synonymous with "including," "containing," or "characterized by," is inclusive or open-ended and does not exclude additional, un-recited elements or method steps. However, in each recitation of "comprising" herein, it is intended that the term also encompass, as alternative embodiments, the phrases "consisting essentially of" and "consisting of," where "consisting of" excludes any element or step not specified and "consisting essentially of" permits the inclusion of additional un-recited elements or steps that do not materially affect the essential or basic and novel characteristics of the composition or method under consideration. The expression "consisting of" or "consisting essentially of," when applied to an element of a claim, is intended to restrict all species of the type represented by that element, notwithstanding the presence of "comprising" elsewhere in the claim.

While certain representative embodiments and details have been shown for the purpose of illustrating the subject invention, it will be apparent to those skilled in this art that various changes and modifications can be made therein without departing from the scope of the subject invention. In this regard, the scope of the invention is to be limited only by the following claims.

What is claimed is:

1. A method of reducing fluoro-elastomeric seal deterioration in a mechanical device comprising supplying thereto a lubricant composition comprising an oil of lubricating viscosity and about 0.01 to about 5 percent by weight of a substantially sulfur-free alkyl phosphate amine salt ("phos-amine salt") wherein the phos-amine salt is prepared or preparable by:

a. the reaction of phosphorus pentoxide with a secondary alcohol having about 3 to about 12 carbon atoms; and b. an amine that is a secondary or tertiary hydrocarbyl amine that is a hindered hydrocarbyl amine, wherein the phos-amine salt has at least about 50 to about 80 mole percent of the phosphorus atoms in an alkyl pyrophosphate salt structure and at least about 80 mole percent of the alkyl groups are secondary alkyl groups of about 3 to about 12 carbon atoms.

2. The method of claim 1 wherein the phos-amine salt comprises a species represented by formula (I) or (II):

(I)

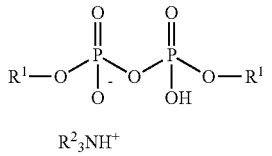

$R^2{}_3NH^+$ or (II)

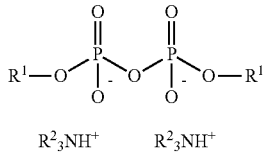

$R^2{}_3NH^+$ $R^2{}_3NH^+$ wherein each $R^1$ is independently a secondary alkyl group of about 3 to about 12 carbon atoms and each $R^2$ is independently hydrogen or a hydrocarbyl group or an ester-containing group, and at least one $R^2$ group is a hydrocarbyl group or an ester-containing group.

3. The method of claim 1, wherein said hindered hydrocarbyl amine has at least one aromatic group.

4. The method of claim 1, wherein said hydrocarbyl amine comprises at least one $C_1$-$C_{30}$ hydrocarbyl group.

5. The method of claim 1 wherein, in the reaction to prepare the alkyl phosphate amine salt, the phosphorus pentoxide is reacted with about 2.2 to about 3.1 moles per mole of $P_2O_5$, of the secondary alcohol at a temperature of about 30° C. to about 60° C.

6. The method of claim 1 wherein the alkyl phosphate amine salt comprises up to about 60 mole percent of the phosphorus atoms in mono- or di-alkyl-orthophosphate salt structures.

7. The method of claim 1 wherein the alkyl phosphate amine salt comprises 55 to 65 mole percent of the phosphorus atoms in an alkyl pyrophosphate salt structure.

8. The method of claim 1, wherein the amine is a tertiary alkyl amine with at least two branched alkyl groups.

9. The method of claim 8, wherein the at least two branched alkyl groups are independently branched at the α or the β position.

10. The method of claim 9, wherein the at least two branched alkyl groups are both branched at the β position.

11. The method of claim 1 wherein the alkyl group or groups of the alkylphosphate structure comprise 4-methyl-pent-2-yl groups.

12. The method of claim 1 wherein the oil of lubricating viscosity has a kinematic viscosity at 100° C. by ASTM D445 of about 3 to about 7.5 $mm^2/s$.

13. The method of claim 1 wherein the oil of lubricating viscosity comprises a poly alpha olefin having a kinematic viscosity at 100° C. by ASTM D445 of about 3 to about 7.5.

14. The method of claim 1, wherein a seal elongation of the fluoro-elastomeric seal at rupture is less than 40% using ASTM D 5662.

* * * * *